US009165567B2

(12) United States Patent
Visser et al.

(10) Patent No.: US 9,165,567 B2
(45) Date of Patent: Oct. 20, 2015

(54) SYSTEMS, METHODS, AND APPARATUS FOR SPEECH FEATURE DETECTION

(75) Inventors: Erik Visser, San Diego, CA (US); Ian Ernan Liu, San Diego, CA (US); Jongwon Shin, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 705 days.

(21) Appl. No.: 13/092,502

(22) Filed: Apr. 22, 2011

(65) Prior Publication Data

US 2011/0264447 A1 Oct. 27, 2011

Related U.S. Application Data

(60) Provisional application No. 61/327,009, filed on Apr. 22, 2010.

(51) Int. Cl.
*G10L 21/00* (2013.01)
*G10L 25/78* (2013.01)

(52) U.S. Cl.
CPC ..... *G10L 25/78* (2013.01)

(58) Field of Classification Search
USPC ..... 704/254, 240, 233, 231, 226, 221, 214, 704/208; 381/92, 110; 367/124
See application file for complete search history.

(56) References Cited

U.S. PATENT DOCUMENTS

| | | | | |
|---|---|---|---|---|
| 5,649,055 | A | 7/1997 | Gupta et al. | |
| 5,774,849 | A | 6/1998 | Benyassine et al. | |
| 6,317,711 | B1 | 11/2001 | Muroi | |
| 6,535,851 | B1 | 3/2003 | Fanty et al. | |
| 6,570,986 | B1 | 5/2003 | Wu et al. | |
| 6,850,887 | B2 | 2/2005 | Epstein et al. | |
| 7,016,832 | B2 | 3/2006 | Choi | |
| 7,024,353 | B2 | 4/2006 | Ramabadran | |
| 7,171,357 | B2 | 1/2007 | Boland | |
| 8,175,291 | B2 | 5/2012 | Chan et al. | |
| 8,219,391 | B2 | 7/2012 | Preuss et al. | |
| 8,260,609 | B2 | 9/2012 | Rajendran et al. | |
| 8,374,851 | B2 | 2/2013 | Unno et al. | |
| 8,724,829 | B2 | 5/2014 | Visser et al. | |
| 2001/0034601 | A1* | 10/2001 | Chujo et al. | 704/233 |
| 2002/0172364 | A1* | 11/2002 | Mauro | 380/270 |
| 2003/0053639 | A1 | 3/2003 | Beaucoup et al. | |
| 2003/0061036 | A1* | 3/2003 | Garudadri et al. | 704/208 |

(Continued)

FOREIGN PATENT DOCUMENTS

| | | | |
|---|---|---|---|
| CN | 1623186 | A | 6/2005 |
| CN | 101010722 | A | 8/2007 |

(Continued)

OTHER PUBLICATIONS

International Search Report and Written Opinion—PCT/US2011/033654—ISA EPO—Aug. 12, 2011.

(Continued)

*Primary Examiner* — Douglas Godbold
*Assistant Examiner* — Mark Villena
(74) *Attorney, Agent, or Firm* — Scott A. Barker

(57) ABSTRACT

Implementations and applications are disclosed for detection of a transition in a voice activity state of an audio signal, based on a change in energy that is consistent in time across a range of frequencies of the signal. For example, such detection may be based on a time derivative of energy for each of a number of different frequency components of the signal.

50 Claims, 47 Drawing Sheets

(56) References Cited

U.S. PATENT DOCUMENTS

| | | | | |
|---|---|---|---|---|
| 2003/0061042 | A1* | 3/2003 | Garudadri | 704/254 |
| 2004/0042626 | A1* | 3/2004 | Balan et al. | 381/110 |
| 2005/0038651 | A1* | 2/2005 | Zhang et al. | 704/233 |
| 2005/0108004 | A1* | 5/2005 | Otani et al. | 704/205 |
| 2005/0131688 | A1* | 6/2005 | Goronzy et al. | 704/240 |
| 2005/0143978 | A1* | 6/2005 | Martin et al. | 704/208 |
| 2005/0246166 | A1 | 11/2005 | Creamer et al. | |
| 2006/0111901 | A1 | 5/2006 | Woo | |
| 2006/0217973 | A1* | 9/2006 | Gao et al. | 704/221 |
| 2006/0270467 | A1 | 11/2006 | Song et al. | |
| 2007/0010999 | A1 | 1/2007 | Klein et al. | |
| 2007/0021958 | A1* | 1/2007 | Visser et al. | 704/226 |
| 2007/0036342 | A1* | 2/2007 | Boillot et al. | 379/406.01 |
| 2007/0154031 | A1 | 7/2007 | Avendano et al. | |
| 2007/0192094 | A1* | 8/2007 | Garudadri | 704/231 |
| 2007/0265842 | A1* | 11/2007 | Jarvinen et al. | 704/214 |
| 2008/0019548 | A1 | 1/2008 | Avendano | |
| 2008/0071531 | A1* | 3/2008 | Ong et al. | 704/231 |
| 2008/0170728 | A1 | 7/2008 | Faller | |
| 2009/0089053 | A1* | 4/2009 | Wang et al. | 704/233 |
| 2009/0304203 | A1 | 12/2009 | Haykin et al. | |
| 2010/0110834 | A1* | 5/2010 | Kim et al. | 367/124 |
| 2010/0128894 | A1* | 5/2010 | Petit et al. | 381/92 |
| 2012/0130713 | A1 | 5/2012 | Shin et al. | |

FOREIGN PATENT DOCUMENTS

| | | | |
|---|---|---|---|
| CN | 101236250 | A | 8/2008 |
| CN | 101548313 | A | 9/2009 |
| EP | 1953734 | A2 | 8/2008 |
| JP | H03211599 | A | 9/1991 |
| JP | H08314497 | A | 11/1996 |
| JP | H09204199 | A | 8/1997 |
| JP | 2000515987 | A | 11/2000 |
| JP | 2003076394 | A | 3/2003 |
| JP | 2008257110 | A | 10/2008 |
| JP | 2009092994 | A * | 4/2009 |
| WO | 9801847 | A1 | 1/1998 |
| WO | 2008016935 | | 2/2008 |
| WO | WO2008143569 | A1 | 11/2008 |
| WO | 2009086017 | A1 | 7/2009 |
| WO | 2010038386 | A1 | 4/2010 |
| WO | 2010048620 | A1 | 4/2010 |

OTHER PUBLICATIONS

D. Wang., "An Auditory Scene Analysis Approach to Speech Segregation", Available Apr. 19, 2011 online at http://www.ipam.ucla.edu/publications/es2005/es2005_5399.ppt.

D. Wang., "Effects of Reverberation on Pitch, Onset/Offset, and Binaural Cues", Available Apr. 19, 2011 online at http://labrosa.ee.columbia.edu/Montreal2004/talks/deliang2.pdf.

D. Wang, et al., "Auditory Segmentation and Unvoiced Speech Segregation", Available Apr. 19, 2011 online at http://www.cse.ohio-state.edu/~dwang/talks/Hanse04.ppt.

G. Hu, et al., "Auditory Segmentation Based on Event Detection", Wkshp. on Stat. and Percep. Audio Proc. SAPA-2004, Jeju, KR, 6 pp. Available online Apr. 19, 2011 at www.cse.ohio-state.edu/~dwang/papers/Hu-Wang.sapa04.pdf.

G. Hu, et al., "Auditory Segmentation Based on Onset and Offset Analysis", IEEE Trans. ASLP, vol. 15, No. 2, Feb. 2007, pp. 396-405. Available online Apr. 19, 2011 at http://www.cse.ohio-state.edu/~dwang/papers/Hu-Wang.taslp07.pdf.

G. Hu, et al., "Auditory Segmentation Based on Onset and Offset Analysis", Technical Report OSU-CISRC-1/05-TR04, Ohio State Univ., pp. 1-11.

G. Hu, et al., "Separation of Stop Consonants", Proc. IEEE Int'l Conf. ASSP, 2003, pp. II-749-II-752. Available online Apr. 19, 2011 at http://www.cse.ohio-state.edu/~dwang/papers/Hu-Wang.icassp03.pdf.

G. Hu., "Monaural speech organization and segregation", Ph.D. thesis, Ohio State Univ., 2006, 202 pp.

J. Kim, et al., "Design of a VAD Algorithm for Variable Rate Coder in CDMA Mobile Communication Systems", IITA-2025-143, Institute of Information Technology Assessment, Korea, pp. 1-13.

K.V. Sorensen, et al., "Speech presence detection in the time-frequency domain using minimum statistics", Proc. 6th Nordic Sig. Proc. Symp. NORSIG 2004, Jun. 9-11, Espoo, Fl, pp. 340-343.

R. Martin., "Statistical methods for the enhancement of noisy speech", Intl Wkshp. Acoust. Echo and Noise Control (IWAENC2003), Sep. 2003, Kyoto, JP, 6 pp.

Rainer Martin: "Noise Power Spectral Density Estimation Based on Optimal Smoothing and Minimum Statistics" IEEE Transactions on Speech and Audio Processing, IEEE Service Center, New York, NY, US, vol. 9, No. 5, Jul. 1, 2001 (Jul. 1, 2001), pp. 504-512, XP011054118.

S. Srinivasan., "A Computational Auditory Scene Analysis System for Robust Speech Recognition", To appear in Proc. Interspeech 2006, Sep. 17-21, Pittsburgh, PA, 4 pp.

T. Esch, et al., "A Modified Minimum Statistics Algorithm for Reducing Time Varying Harmonic Noise", Paper 3, 4 pp. Available Apr. 20, 2011 online at http://www.ind.rwth-aachen.de/fileadmin/publications/esch10a.pdf.

V. Stouten, et al., "Application of minimum statistics and minima controlled recursive averaging methods to estimate a cepstral noise model for robust ASR", 4 pp. Available Apr. 20, 2011 online at http://www.esat.kuleuven.be/psi/spraak/cgi-bin/get_file.cgi?/vstouten/icassp06/stouten.pdf.

Y. Shao, et al., "A Computational Auditory Scene Analysis System for Speech Segregation and Robust Speech Recognition", Technical Report OSU-CISRC-8/07-TR62, pp. 1-20.

Y.-S. Park, et al., "A Probabilistic Combination Method of Minimum Statistics and Soft Decision for Robust Noise Power Estimation in Speech Enhancement", IEEE Sig. Proc. Let., vol. 15, 2008, pp. 95-98.

Beritelli F, et al., "A Multi-Channel Speech/Silence Detector Based on Time Delay Estimation and Fuzzy Classification", 1999 IEEE International Conference on Acoustics, Speech, and Signal Processing. Phoenix, AZ, Mar. 15-19, 1999; [IEEE International Conference on Acoustics, Speech, and Signal Processing (ICASSP)], New York, NY : IEEE, US, Mar. 15, 1999, pp. 93-96, XP000898270, ISBN: 978-0-7803-5042-7.

Ishizuka K, et al., "Speech Activity Detection for Multi -Party Conversation Analyses Based on Likelihood Ratio Test on Spatial Magnitude", IEEE Transactions on Audio, Speech and Language Processing, IEEE Service Center, New York, NY, USA, vol. 18, No. 6, Aug. 1, 2010, pp. 1354-1365, XP011329203, ISSN: 1558-7916, DOI: 10.1109/TASL.2009.2033955.

Karray L, et al., "Towards improving speech detection robustness for speech recognition in adverse conditions", Speech Communication, Elsevier Science Publishers, Amsterdam, NL, vol. 40, No. 3, May 1, 2003, pp. 261-276, XP002267781, ISSN: 0167-6393, DOI: 10.1016/S0167-6393 (02)00066-3 page 263, section 2.3, first paragraph.

Pfau T, et al., "Multispeaker speech activity detection for the ICSI meeting recorder".

Automatic Speech Recognition and Understanding, 2001. ASRU01. IEEE Workshop on Dec. 9-13, 2001, Piscataway, NJ, USA,IEEE, Dec. 9, 2001, pp. 107-110, XP010603688, ISBN: 978-0-7803-7343-3.

Nagata Y., et al., "Target Signal Detection System Using Two Directional Microphones," Transactions of the Institute of Electronics, Information and Communication Engineers, Dec. 2000, vol. J83-A, No. 12, pp. 1445-1454.

* cited by examiner

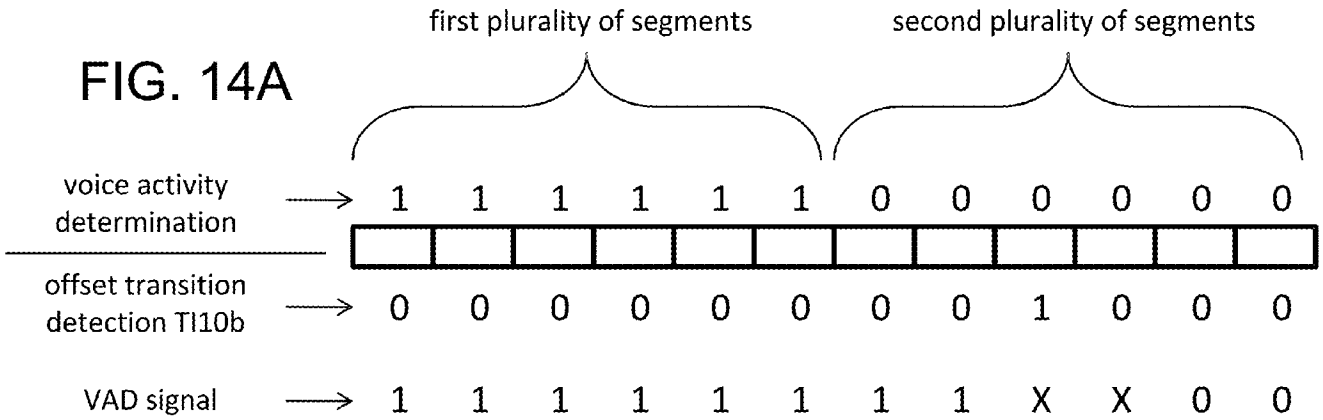
FIG. 14A
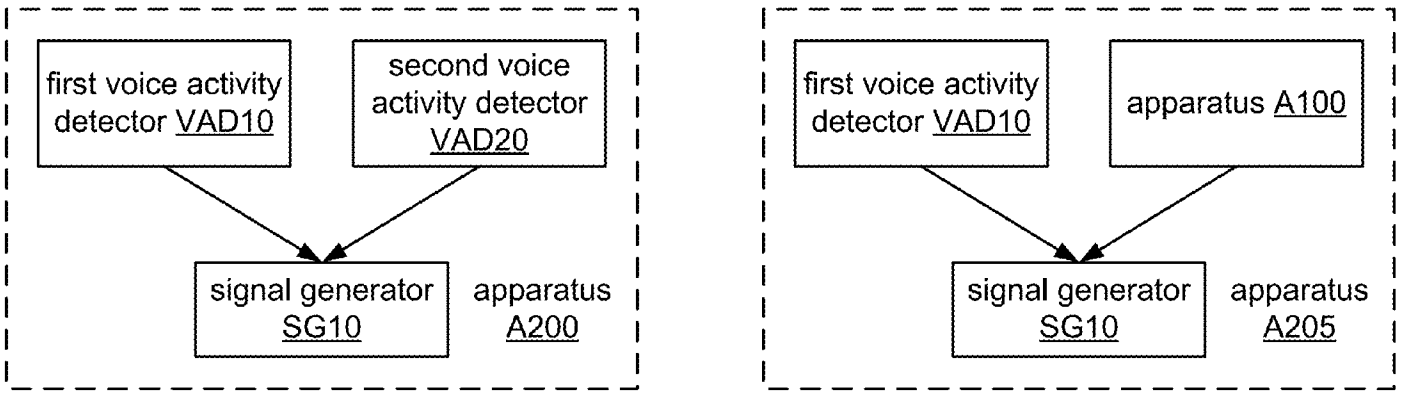
FIG. 14B
FIG. 14C (P && G) || ON || OFF
(P && G) && (ON || OFF)
(P && G) && LF
(P && G && LF) || ON || OFF
(PB && GB)
(PB && GB) || ON || OFF
(PB && GB) || LF
(PB && GB) || LF || ON || OFF
(P && G) || LF
( (P && G) || LF ) && (SC || ON || OFF)

SYSTEMS, METHODS, AND APPARATUS FOR SPEECH FEATURE DETECTION

CLAIM OF PRIORITY UNDER 35 U.S.C. §119

The present application for patent claims priority to Provisional Application No. 61/327,009, entitled "SYSTEMS, METHODS, AND APPARATUS FOR SPEECH FEATURE DETECTION," filed Apr. 22, 2010, and assigned to the assignee hereof.

BACKGROUND

1. Field

This disclosure relates to processing of speech signals.

2. Background

Many activities that were previously performed in quiet office or home environments are being performed today in acoustically variable situations like a car, a street, or a café. For example, a person may desire to communicate with another person using a voice communication channel. The channel may be provided, for example, by a mobile wireless handset or headset, a walkie-talkie, a two-way radio, a car-kit, or another communications device. Consequently, a substantial amount of voice communication is taking place using mobile devices (e.g., smartphones, handsets, and/or headsets) in environments where users are surrounded by other people, with the kind of noise content that is typically encountered where people tend to gather. Such noise tends to distract or annoy a user at the far end of a telephone conversation. Moreover, many standard automated business transactions (e.g., account balance or stock quote checks) employ voice recognition based data inquiry, and the accuracy of these systems may be significantly impeded by interfering noise.

For applications in which communication occurs in noisy environments, it may be desirable to separate a desired speech signal from background noise. Noise may be defined as the combination of all signals interfering with or otherwise degrading the desired signal. Background noise may include numerous noise signals generated within the acoustic environment, such as background conversations of other people, as well as reflections and reverberation generated from the desired signal and/or any of the other signals. Unless the desired speech signal is separated from the background noise, it may be difficult to make reliable and efficient use of it. In one particular example, a speech signal is generated in a noisy environment, and speech processing methods are used to separate the speech signal from the environmental noise.

Noise encountered in a mobile environment may include a variety of different components, such as competing talkers, music, babble, street noise, and/or airport noise. As the signature of such noise is typically nonstationary and close to the user's own frequency signature, the noise may be hard to model using traditional single microphone or fixed beamforming type methods. Single microphone noise reduction techniques typically require significant parameter tuning to achieve optimal performance. For example, a suitable noise reference may not be directly available in such cases, and it may be necessary to derive a noise reference indirectly. Therefore multiple microphone based advanced signal processing may be desirable to support the use of mobile devices for voice communications in noisy environments.

SUMMARY

A method of processing an audio signal according to a general configuration includes determining, for each of a first plurality of consecutive segments of the audio signal, that voice activity is present in the segment. This method also includes determining, for each of a second plurality of consecutive segments of the audio signal that occurs immediately after the first plurality of consecutive segments in the audio signal, that voice activity is not present in the segment. This method also includes detecting that a transition in a voice activity state of the audio signal occurs during one among the second plurality of consecutive segments that is not the first segment to occur among the second plurality, and producing a voice activity detection signal that has, for each segment in the first plurality and for each segment in the second plurality, a corresponding value that indicates one among activity and lack of activity. In this method, for each of the first plurality of consecutive segments, the corresponding value of the voice activity detection signal indicates activity. In this method, for each of the second plurality of consecutive segments that occurs before the segment in which the detected transition occurs, and based on said determining, for at least one segment of the first plurality, that voice activity is present in the segment, the corresponding value of the voice activity detection signal indicates activity, and for each of the second plurality of consecutive segments that occurs after the segment in which the detected transition occurs, and in response to said detecting that a transition in the speech activity state of the audio signal occurs, the corresponding value of the voice activity detection signal indicates a lack of activity. Computer-readable media having tangible structures that store machine-executable instructions that when executed by one or more processors cause the one or more processors to perform such a method are also disclosed.

An apparatus for processing an audio signal according to another general configuration includes means for determining, for each of a first plurality of consecutive segments of the audio signal, that voice activity is present in the segment. This apparatus also includes means for determining, for each of a second plurality of consecutive segments of the audio signal that occurs immediately after the first plurality of consecutive segments in the audio signal, that voice activity is not present in the segment. This apparatus also includes means for detecting that a transition in a voice activity state of the audio signal occurs during one among the second plurality of consecutive segments, and means for producing a voice activity detection signal that has, for each segment in the first plurality and for each segment in the second plurality, a corresponding value that indicates one among activity and lack of activity. In this apparatus, for each of the first plurality of consecutive segments, the corresponding value of the voice activity detection signal indicates activity. In this apparatus, for each of the second plurality of consecutive segments that occurs before the segment in which the detected transition occurs, and based on said determining, for at least one segment of the first plurality, that voice activity is present in the segment, the corresponding value of the voice activity detection signal indicates activity. In this apparatus, for each of the second plurality of consecutive segments that occurs after the segment in which the detected transition occurs, and in response to said detecting that a transition in the speech activity state of the audio signal occurs, the corresponding value of the voice activity detection signal indicates a lack of activity.

An apparatus for processing an audio signal according to another configuration includes a first voice activity detector configured to determine, for each of a first plurality of consecutive segments of the audio signal, that voice activity is present in the segment. The first voice activity detector is also configured to determine, for each of a second plurality of consecutive segments of the audio signal that occurs immediately after the first plurality of consecutive segments in the audio signal, that voice activity is not present in the segment. This apparatus also includes a second voice activity detector configured to detect that a transition in a voice activity state of the audio signal occurs during one among the second plurality of consecutive segments; and a signal generator configured to produce a voice activity detection signal that has, for each segment in the first plurality and for each segment in the second plurality, a corresponding value that indicates one among activity and lack of activity. In this apparatus, for each of the first plurality of consecutive segments, the corresponding value of the voice activity detection signal indicates activity. In this apparatus, for each of the second plurality of consecutive segments that occurs before the segment in which the detected transition occurs, and based on said determining, for at least one segment of the first plurality, that voice activity is present in the segment, the corresponding value of the voice activity detection signal indicates activity. In this apparatus, for each of the second plurality of consecutive segments that occurs after the segment in which the detected transition occurs, and in response to said detecting that a transition in the speech activity state of the audio signal occurs, the corresponding value of the voice activity detection signal indicates a lack of activity.

BRIEF DESCRIPTION OF THE DRAWINGS

FIG. 14A illustrates an example of an operation of an implementation of method M200.

FIG. 14B shows a block diagram of an apparatus A200 according to a general configuration.

FIG. 14C shows a block diagram of an implementation A205 of apparatus A200.

DETAILED DESCRIPTION

In a speech processing application (e.g., a voice communications application, such as telephony), it may be desirable to perform accurate detection of segments of an audio signal that carry speech information. Such voice activity detection (VAD) may be important, for example, in preserving the speech information. Speech coders (also called coder-decoders (codecs) or vocoders) are typically configured to allocate more bits to encode segments that are identified as speech than to encode segments that are identified as noise, such that a misidentification of a segment carrying speech information may reduce the quality of that information in the decoded segment. In another example, a noise reduction system may aggressively attenuate low-energy unvoiced speech segments if a voice activity detection stage fails to identify these segments as speech.

Recent interest in wideband (WB) and super-wideband (SWB) codecs places emphasis on preserving high-frequency speech information, which may be important for high-quality speech as well as intelligibility. Consonants typically have energy that is generally consistent in time across a high-frequency range (e.g., from four to eight kilohertz). Although the high-frequency energy of a consonant is typically low compared to the low-frequency energy of a vowel, the level of environmental noise is usually lower in the high frequencies.

Figure 1B:
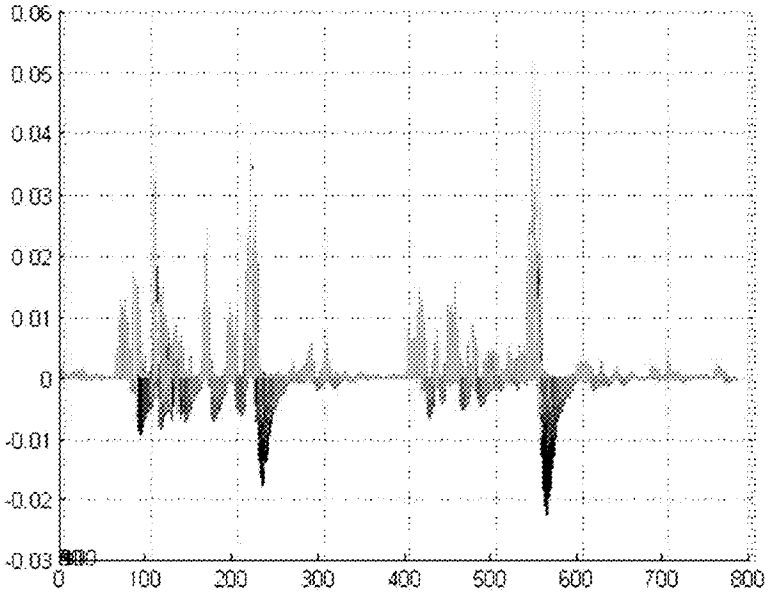
FIGS. 1A and 1B show top and side views, respectively, of a plot of the first-order derivative of high-frequency spectrum power (vertical axis) over time (horizontal axis; the front-back axis indicates frequency×100 Hz).
Figure 1A:
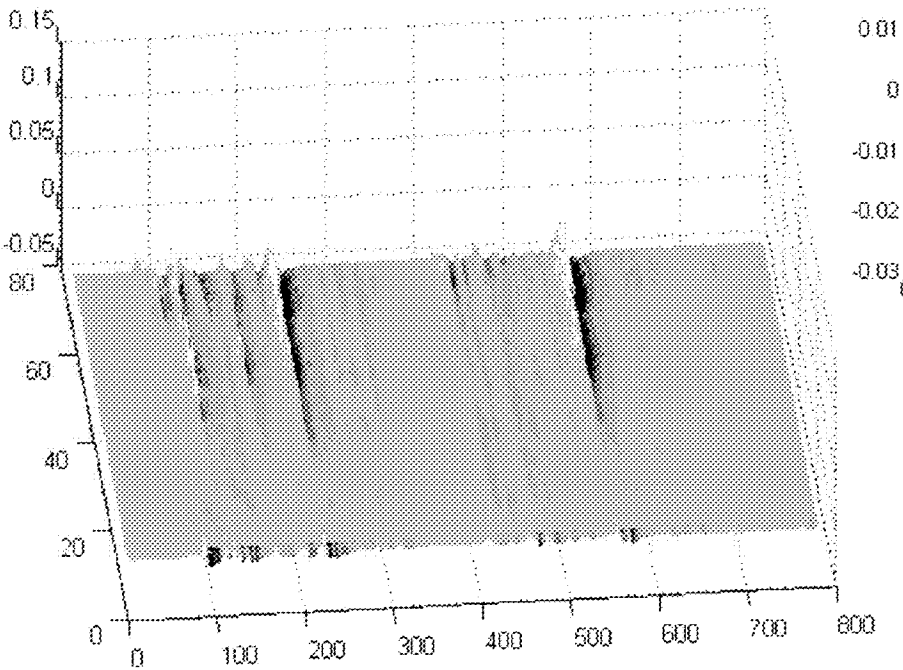

FIGS. 1A and 1B show an example of the first-order derivative of spectrogram power of a segment of recorded speech over time. In these figures, speech onsets (as indicated by the simultaneous occurrence of positive values over a wide high-frequency range) and speech offsets (as indicated by the simultaneous occurrence of negative values over a wide high-frequency range) can be clearly discerned.

Figures 47A, 47B:
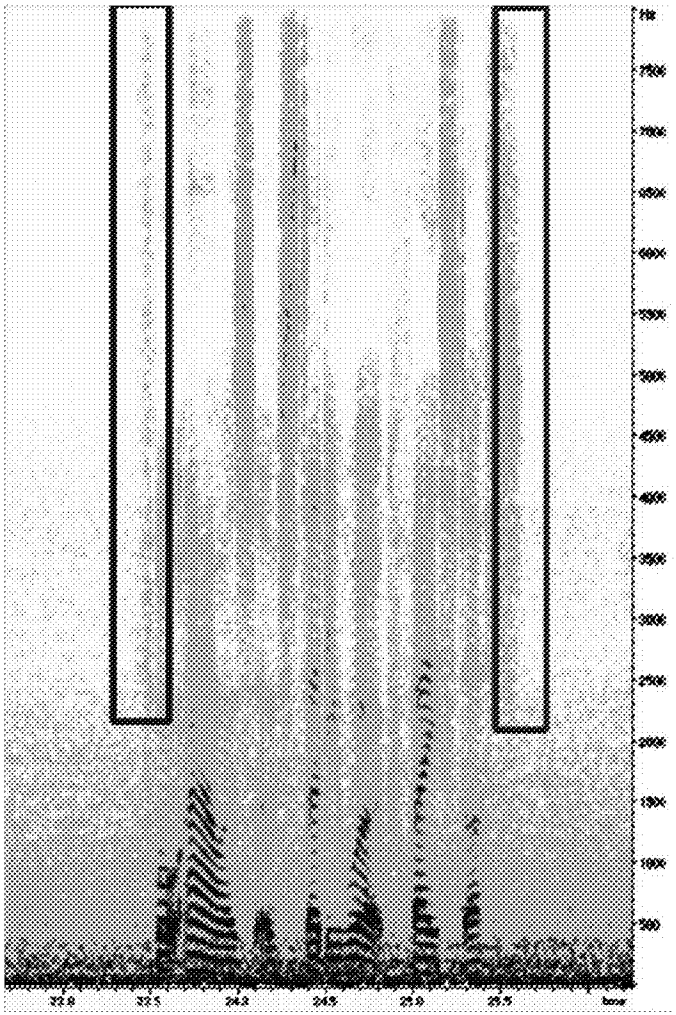
FIG. 47A shows a spectrogram indicating high-frequency onset and offset activity.
FIG. 47B lists several combinations of VAD strategies.

It may be desirable to perform detection of speech onsets and/or offsets based on the principle that a coherent and detectable energy change occurs over multiple frequencies at the onset and offset of speech. Such an energy change may be detected, for example, by computing first-order time derivatives of energy (i.e., rate of change of energy over time) over frequency components in a desired frequency range (e.g., a high-frequency range, such as from four to eight kHz). By comparing the amplitudes of these derivatives to threshold values, one can compute an activation indication for each frequency bin and combine (e.g., average) the activation indications over the frequency range for each time interval (e.g., for each 10-msec frame) to obtain a VAD statistic. In such case, a speech onset may be indicated when a large number of frequency bands show a sharp increase in energy that is coherent in time, and a speech offset may be indicated when a large number of frequency bands show a sharp decrease in energy that is coherent in time. Such a statistic is referred to herein as "high-frequency speech continuity." FIG. 47A shows a spectrogram in which coherent high-frequency activity due to an onset and coherent high-frequency activity due to an offset are outlined.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B" or "A is the same as B"). Similarly, the term "in response to" is used to indicate any of its ordinary meanings, including "in response to at least."

References to a "location" of a microphone of a multimicrophone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample (or "bin") of a frequency-domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The near-field may be defined as that region of space which is less than one wavelength away from a sound receiver (e.g., a microphone or array of microphones). Under this definition, the distance to the boundary of the region varies inversely with frequency. At frequencies of two hundred, seven hundred, and two thousand hertz, for example, the distance to a one-wavelength boundary is about 170, forty-nine, and seventeen centimeters, respectively. It may be useful instead to consider the near-field/far-field boundary to be at a particular distance from the microphone or array (e.g., fifty centimeters from the microphone or from a microphone of the array or from the centroid of the array, or one meter or 1.5 meters from the microphone or from a microphone of the array or from the centroid of the array).

Unless the context indicates otherwise, the term "offset" is used herein as an antonym of the term "onset."

Figure 2A:
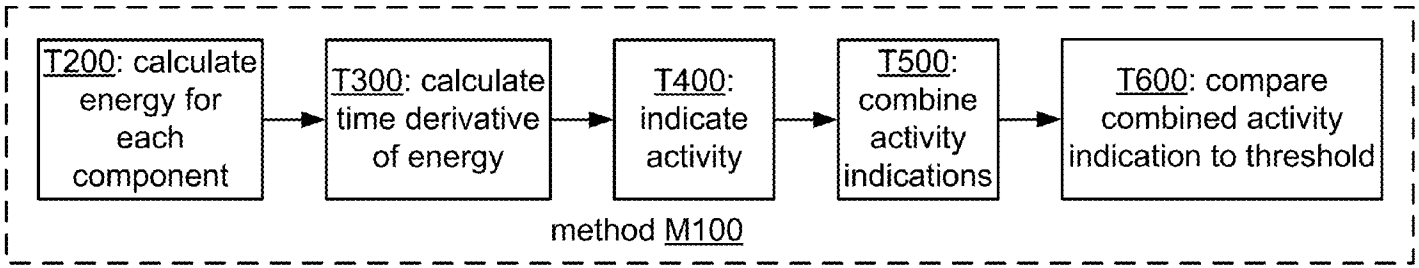
FIG. 2A shows a flowchart of a method M100 according to a general configuration.

FIG. 2A shows a flowchart of a method M100 according to a general configuration that includes tasks T200, T300, T400, T500, and T600. Method M100 is typically configured to iterate over each of a series of segments of an audio signal to indicate whether a transition in voice activity state is present in the segment. Typical segment lengths range from about five or ten milliseconds to about forty or fifty milliseconds, and the segments may be overlapping (e.g., with adjacent segments overlapping by 25% or 50%) or nonoverlapping. In one particular example, the signal is divided into a series of nonoverlapping segments or "frames", each having a length of ten milliseconds. A segment as processed by method M100 may also be a segment (i.e., a "subframe") of a larger segment as processed by a different operation, or vice versa.

Figure 2B:
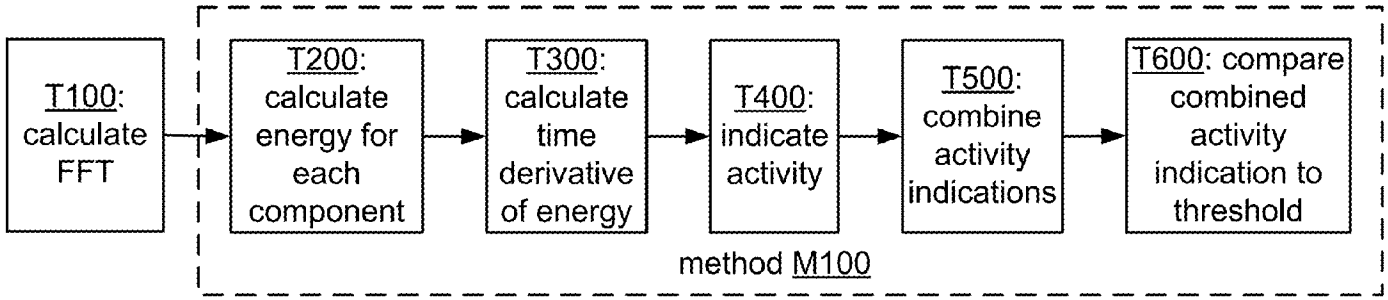
FIG. 2B shows a flowchart for an application of method M100.

Task T200 calculates a value of the energy E(k,n) (also called "power" or "intensity") for each frequency component k of segment n over a desired frequency range. FIG. 2B shows a flowchart for an application of method M100 in which the audio signal is provided in the frequency domain. This application includes a task T100 that obtains a frequency-domain signal (e.g., by calculating a fast Fourier transform of the audio signal). In such case, task T200 may be configured to calculate the energy based on the magnitude of the corresponding frequency component (e.g., as the squared magnitude).

In an alternative implementation, method M100 is configured to receive the audio signal as a plurality of time-domain subband signals (e.g., from a filter bank). In such case, task T200 may be configured to calculate the energy based on a sum of the squares of the time-domain sample values of the corresponding subband (e.g., as the sum, or as the sum normalized by the number of samples (e.g., average squared value)). A subband scheme may also be used in a frequency-domain implementation of task T200 (e.g., by calculating a value of the energy for each subband as the average energy, or as the square of the average magnitude, of the frequency bins in the subband k). In any of these time-domain and frequency-domain cases, the subband division scheme may be uniform, such that each subband has substantially the same width (e.g., within about ten percent). Alternatively, the subband division scheme may be nonuniform, such as a transcendental scheme (e.g., a scheme based on the Bark scale) or a logarithmic scheme (e.g., a scheme based on the Mel scale). In one such example, the edges of a set of seven Bark scale subbands correspond to the frequencies 20, 300, 630, 1080, 1720, 2700, 4400, and 7700 Hz. Such an arrangement of subbands may be used in a wideband speech processing system that has a sampling rate of 16 kHz. In other examples of such a division scheme, the lower subband is omitted to obtain a six-subband arrangement and/or the high-frequency limit is increased from 7700 Hz to 8000 Hz. Another example of a nonuniform subband division scheme is the four-band quasi-Bark scheme 300-510 Hz, 510-920 Hz, 920-1480 Hz, and 1480-4000 Hz. Such an arrangement of subbands may be used in a narrowband speech processing system that has a sampling rate of 8 kHz.

It may be desirable for task T200 to calculate the value of the energy as a temporally smoothed value. For example, task T200 may be configured to calculate the energy according to an expression such as $E(k,n)=\beta E_u(k,n)+(1-\beta)E(k,n-1)$, where $E_u(k,n)$ is an unsmoothed value of the energy calculated as described above; E(k,n) and E(k,n−1) are the current and previous smoothed values, respectively; and β is a smoothing factor. The value of smoothing factor β may range from 0 (maximum smoothing, no updating) to 1 (no smoothing), and typical values for smoothing factor β (which may be different for onset detection than for offset detection) include 0.05, 0.1, 0.2, 0.25, and 0.3.

It may be desirable for the desired frequency range to extend above 2000 Hz. Alternatively or additionally, it may be desirable for the desired frequency range to include at least part of the top half of the frequency range of the audio signal (e.g., at least part of the range of from 2000 to 4000 Hz for an audio signal sampled at eight kHz, or at least part of the range of from 4000 to 8000 Hz for an audio signal sampled at sixteen kHz). In one example, task T200 is configured to calculate energy values over the range of from four to eight kilohertz. In another example, task T200 is configured to calculate energy values over the range of from 500 Hz to eight kHz.

Task T300 calculates a time derivative of energy for each frequency component of the segment. In one example, task T300 is configured to calculate the time derivative of energy as an energy difference ΔE(k,n) for each frequency component k of each frame n [e.g., according to an expression such as $\Delta E(k,n)=E(k,n)-E(k,n-1)$].

It may be desirable for task T300 to calculate ΔE(k,n) as a temporally smoothed value. For example, task T300 may be configured to calculate the time derivative of energy according to an expression such as $\Delta E(k,n)=\alpha[E(k,n)-E(k,n-1)]+(1-\alpha)[\Delta E(k,n-1)]$, where α is a smoothing factor. Such temporal smoothing may help to increase reliability of the onset and/or offset detection (e.g., by deemphasizing noisy artifacts). The value of smoothing factor α may range from 0 (maximum smoothing, no updating) to 1 (no smoothing), and typical values for smoothing factor α include 0.05, 0.1, 0.2, 0.25, and 0.3. For onset detection, it may be desirable to use little or no smoothing (e.g., to allow a quick response). It may be desirable to vary the value of smoothing factor α and/or β, for onset and/or for offset, based on an onset detection result.

Task T400 produces an activity indication A(k,n) for each frequency component of the segment. Task T400 may be configured to calculate A(k,n) as a binary value, for example, by comparing ΔE(k,n) to an activation threshold.

It may be desirable for the activation threshold to have a positive value $T_{act-on}$ for detection of speech onsets. In one such example, task T400 is configured to calculate an onset activation parameter $A_{on}(k,n)$ according to an expression such as $$A_{on}(k,n)=\begin{cases}1, & \Delta E(k,n)>T_{act-on}\\ 0, & \text{otherwise}\end{cases}$$

or $$A_{on}(k,n)=\begin{cases}1, & \Delta E(k,n)\geq T_{act-on}\\ 0, & \text{otherwise.}\end{cases}$$

It may be desirable for the activation threshold to have a negative value $T_{act-off}$ for detection of speech offsets. In one such example, task T400 is configured to calculate an offset activation parameter $A_{off}(k,n)$ according to an expression such as $$A_{off}(k,n) = \begin{cases} 1, & \Delta E(k,n) < T_{act-off} \\ 0, & \text{otherwise} \end{cases}$$

or $$A_{off}(k,n) = \begin{cases} 1, & \Delta E(k,n) \leq T_{act-off} \\ 0, & \text{otherwise} \end{cases}$$

In another such example, task T400 is configured to calculate $A_{off}(k,n)$ according to an expression such as $$A_{off}(k,n) = \begin{cases} -1, & \Delta E(k,n) < T_{act-off} \\ 0, & \text{otherwise} \end{cases}$$

or $$A_{off}(k,n) = \begin{cases} -1, & \Delta E(k,n) \leq T_{act-off} \\ 0, & \text{otherwise.} \end{cases}$$

Task T500 combines the activity indications for segment n to produce a segment activity indication S(n). In one example, task T500 is configured to calculate S(n) as the sum of the values A(k,n) for the segment. In another example, task T500 is configured to calculate S(n) as a normalized sum (e.g., the mean) of the values A(k,n) for the segment.

Task T600 compares the value of the combined activity indication S(n) to a transition detection threshold value $T_{tx}$. In one example, task T600 indicates the presence of a transition in voice activity state if S(n) is greater than (alternatively, not less than) $T_{tx}$. For a case in which the values of A(k,n) [e.g., of $A_{off}(k,n)$] may be negative, as in the example above, task T600 may be configured to indicate the presence of a transition in voice activity state if S(n) is less than (alternatively, not greater than) the transition detection threshold value $T_{tx}$.

Figure 2C:
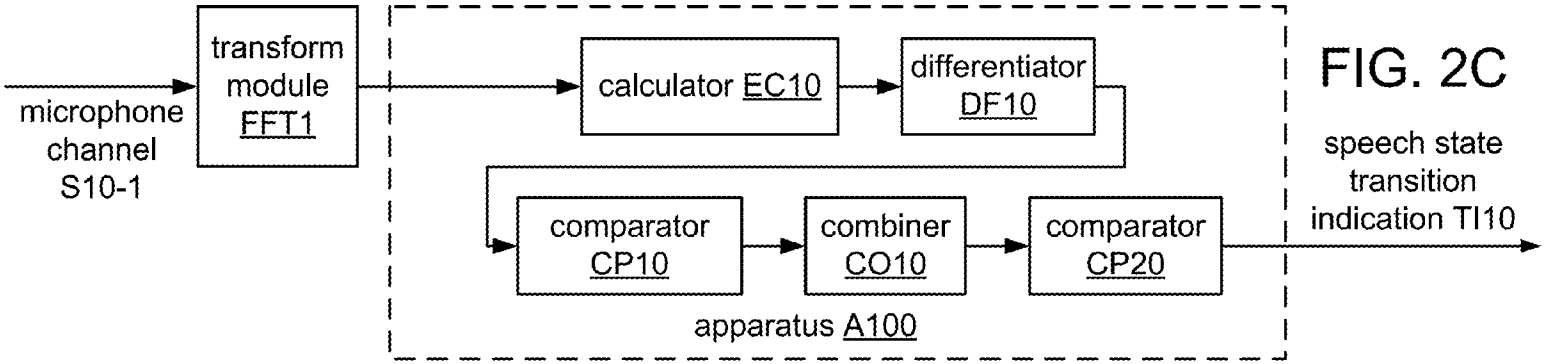
FIG. 2C shows a block diagram of an apparatus A100 according to a general configuration.

FIG. 2C shows a block diagram of an apparatus A100 according to a general configuration that includes a calculator EC10, a differentiator DF10, a first comparator CP10, a combiner CO10, and a second comparator CP20. Apparatus A100 is typically configured to produce, for each of a series of segments of an audio signal, an indication of whether a transition in voice activity state is present in the segment. Calculator EC10 is configured to calculate a value of the energy for each frequency component of the segment over a desired frequency range (e.g., as described herein with reference to task T200). In this particular example, a transform module FFT1 performs a fast Fourier transform on a segment of a channel S10-1 of a multichannel signal to provide apparatus A100 (e.g., calculator EC10) with the segment in the frequency domain. Differentiator DF10 is configured to calculate a time derivative of energy for each frequency component of the segment (e.g., as described herein with reference to task T300). Comparator CP10 is configured to produce an activity indication for each frequency component of the segment (e.g., as described herein with reference to task T400). Combiner C010 is configured to combine the activity indications for the segment to produce a segment activity indication (e.g., as described herein with reference to task T500). Comparator CP20 is configured to compare the value of the segment activity indication to a transition detection threshold value (e.g., as described herein with reference to task T600).

Figure 41C:
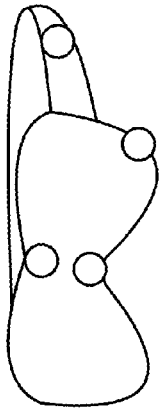
FIGS. 41A-C show additional examples of portable audio sensing devices.
Figure 41B:
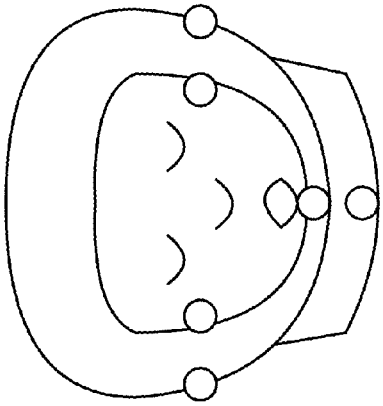
Figure 41A:
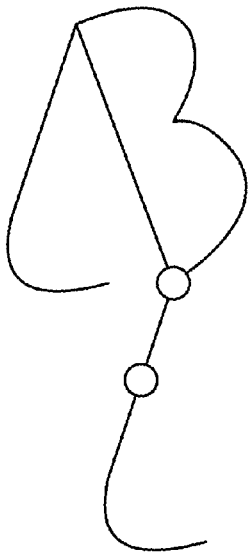
Figure 41D:
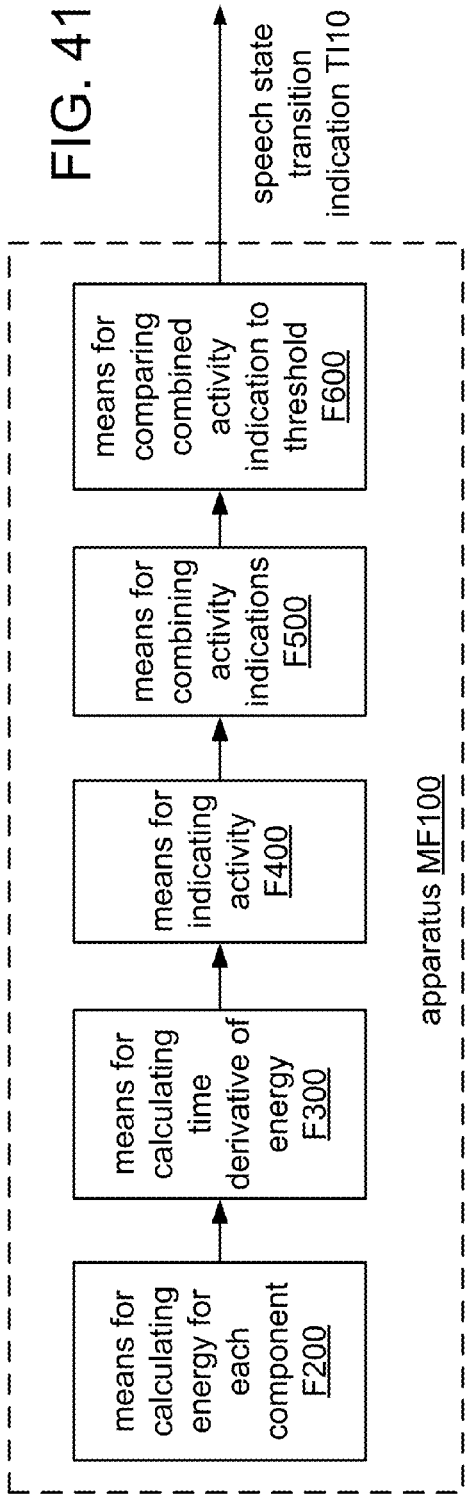
FIG. 41D shows a block diagram of an apparatus MF100 according to a general configuration.

FIG. 41D shows a block diagram of an apparatus MF100 according to a general configuration. Apparatus MF100 is typically configured to process each of a series of segments of an audio signal to indicate whether a transition in voice activity state is present in the segment. Apparatus MF100 includes means F200 for calculating energy for each component of the segment over a desired frequency range (e.g., as disclosed herein with reference to task T200). Apparatus MF100 also includes means F300 for calculating a time derivative of energy for each component (e.g., as disclosed herein with reference to task T300). Apparatus MF100 also includes means F400 for indicating activity for each component (e.g., as disclosed herein with reference to task T400). Apparatus MF100 also includes means F500 for combining the activity indications (e.g., as disclosed herein with reference to task T500). Apparatus MF100 also includes means F600 for comparing the combined activity indication to a threshold (e.g., as disclosed herein with reference to task T600) to produce a speech state transition indication TI10.

Figure 3A:
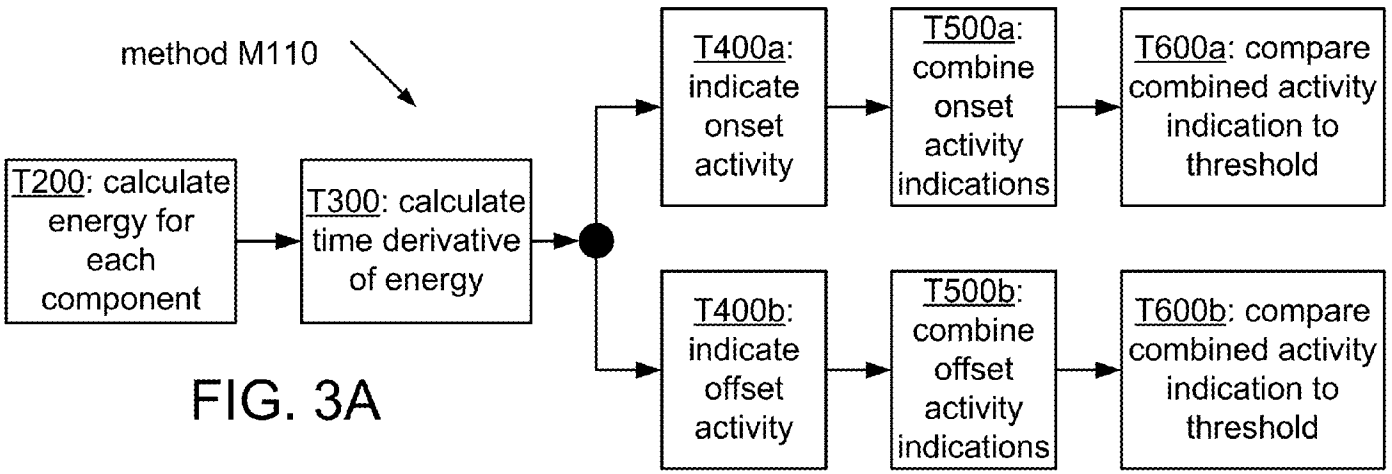
FIG. 3A shows a flowchart for an implementation M110 of method M100.
Figure 3B:
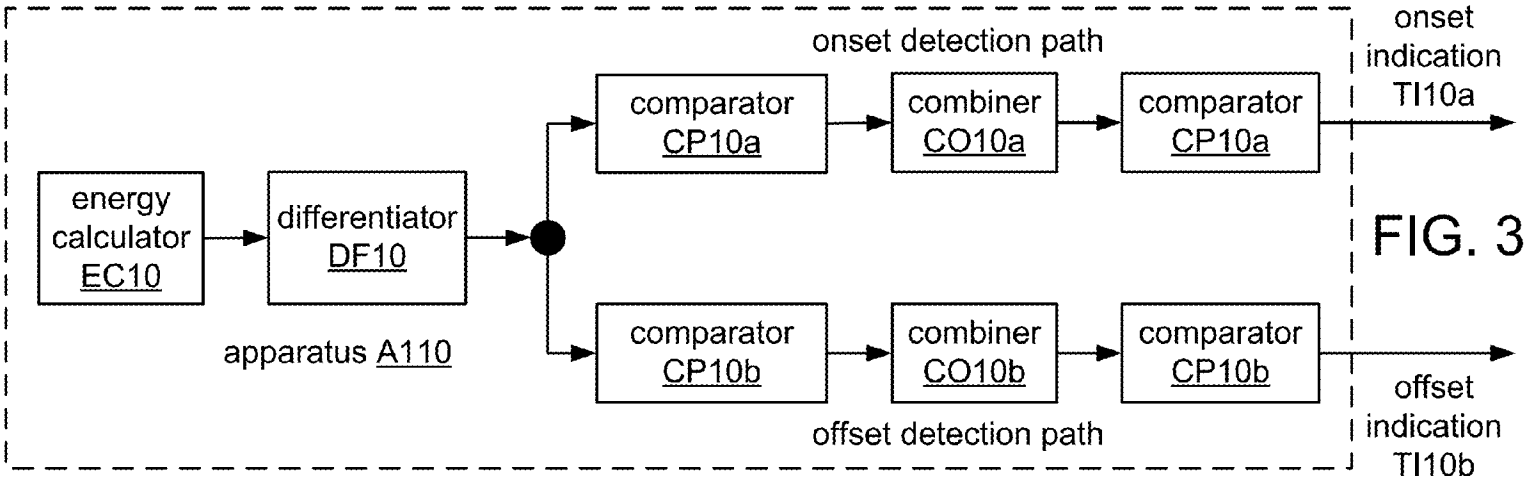
FIG. 3B shows a block diagram for an implementation A110 of apparatus A100.

It may be desirable for a system (e.g., a portable audio sensing device) to perform an instance of method M100 that is configured to detect onsets and another instance of method M100 that is configured to detect offsets, with each instance of method M100 typically having different respective threshold values. Alternatively, it may be desirable for such a system to perform an implementation of method M100 which combines the instances. FIG. 3A shows a flowchart of such an implementation M110 of method M100 that includes multiple instances T400*a*, T400*b* of activity indication task T400; T500*a*, T500*b* of combining task T500; and T600*a*, T600*b* of state transition indication task T600. FIG. 3B shows a block diagram of a corresponding implementation A110 of apparatus A100 that includes multiple instances CP10*a*, CP10*b* of comparator CP10; CO10*a*, CO10*b* of combiner C010, and CP20*a*, CP20*b* of comparator CP20.

It may be desirable to combine onset and offset indications as described above into a single metric. Such a combined onset/offset score may be used to support accurate tracking of speech activity (e.g., changes in near-end speech energy) over time, even in different noise environments and sound pressure levels. Use of a combined onset/offset score mechanism may also result in easier tuning of an onset/offset VAD.

Figure 4A:
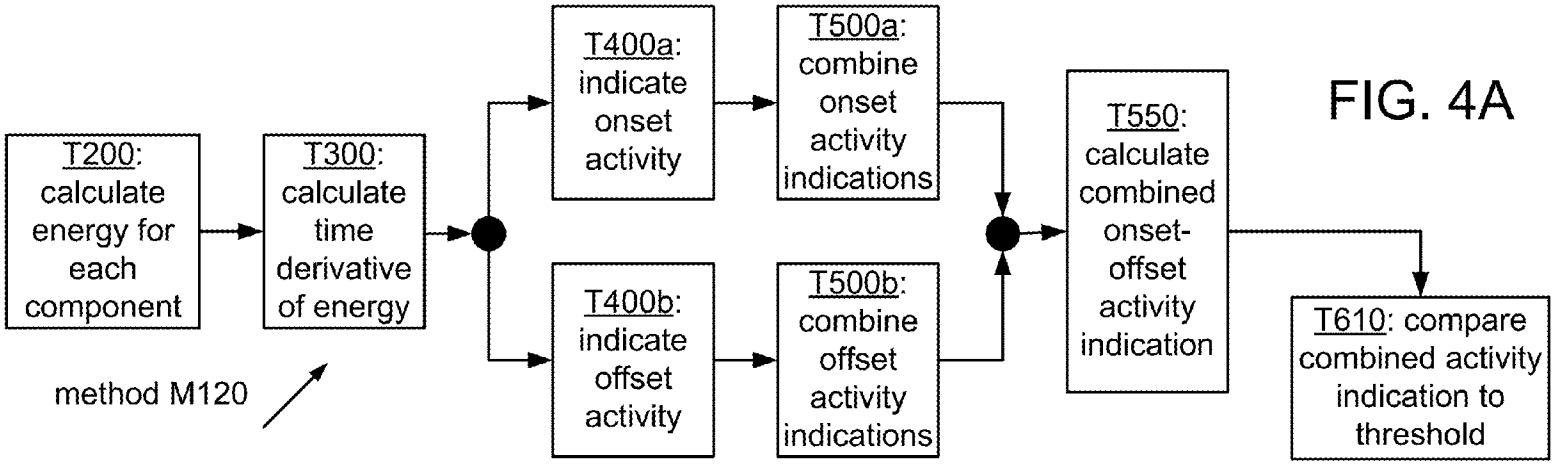
FIG. 4A shows a flowchart for an implementation M120 of method M100.
Figure 4B:
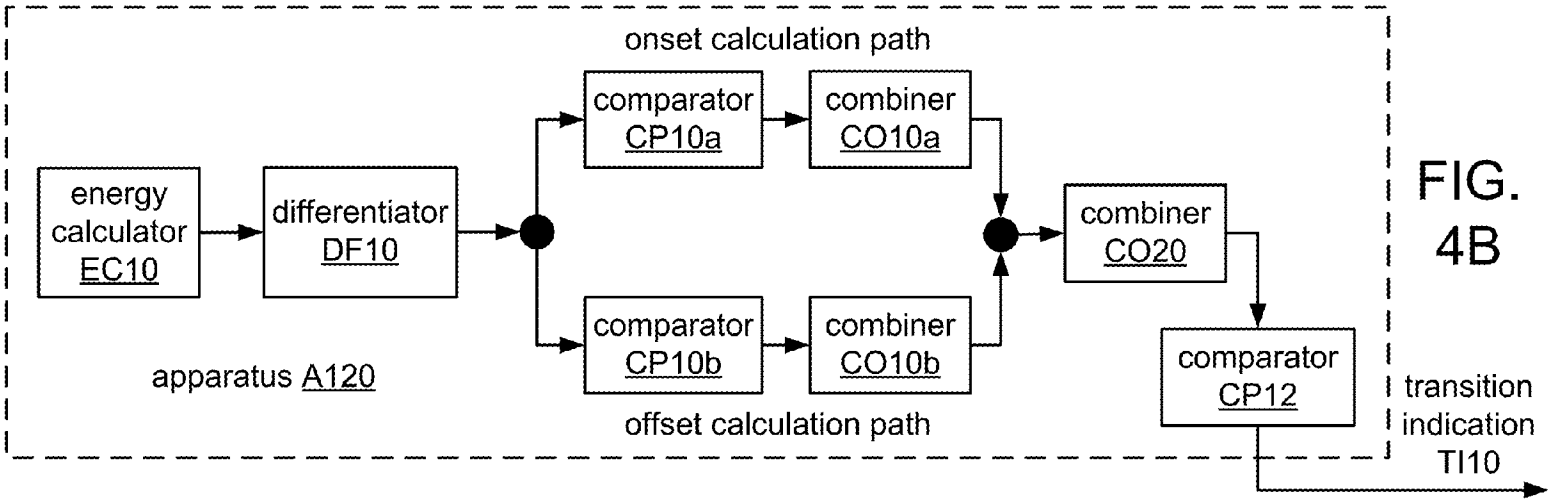
FIG. 4B shows a block diagram for an implementation A120 of apparatus A100.

A combined onset/offset score $S_{on-off}(n)$ may be calculated using values of segment activity indication S(n) as calculated for each segment by respective onset and offset instances of task T500 as described above. FIG. 4A shows a flowchart of such an implementation M120 of method M100 that includes onset and offset instances T400*a*, T500*a* and T400*b*, T500*b*, respectively, of frequency-component activation indication task T400 and combining task T500. Method M120 also includes a task T550 that calculates a combined onset-offset score $S_{on-off}(n)$ based on the values of S(n) as produced by tasks T500*a* ($S_{on}(n)$) and T500*b* ($S_{off}(n)$). For example, task T550 may be configured to calculate $S_{on-off}(n)$ according to an expression such as $S_{on-off}(n)=abs(S_{on}(n)+S_{off}(n))$. In this example, method M120 also includes a task T610 that compares the value of $S_{on-off}(n)$ to a threshold value to produce a corresponding binary VAD indication for each segment n. FIG. 4B shows a block diagram of a corresponding implementation A120 of apparatus A100.

Figures 5A, 5B:
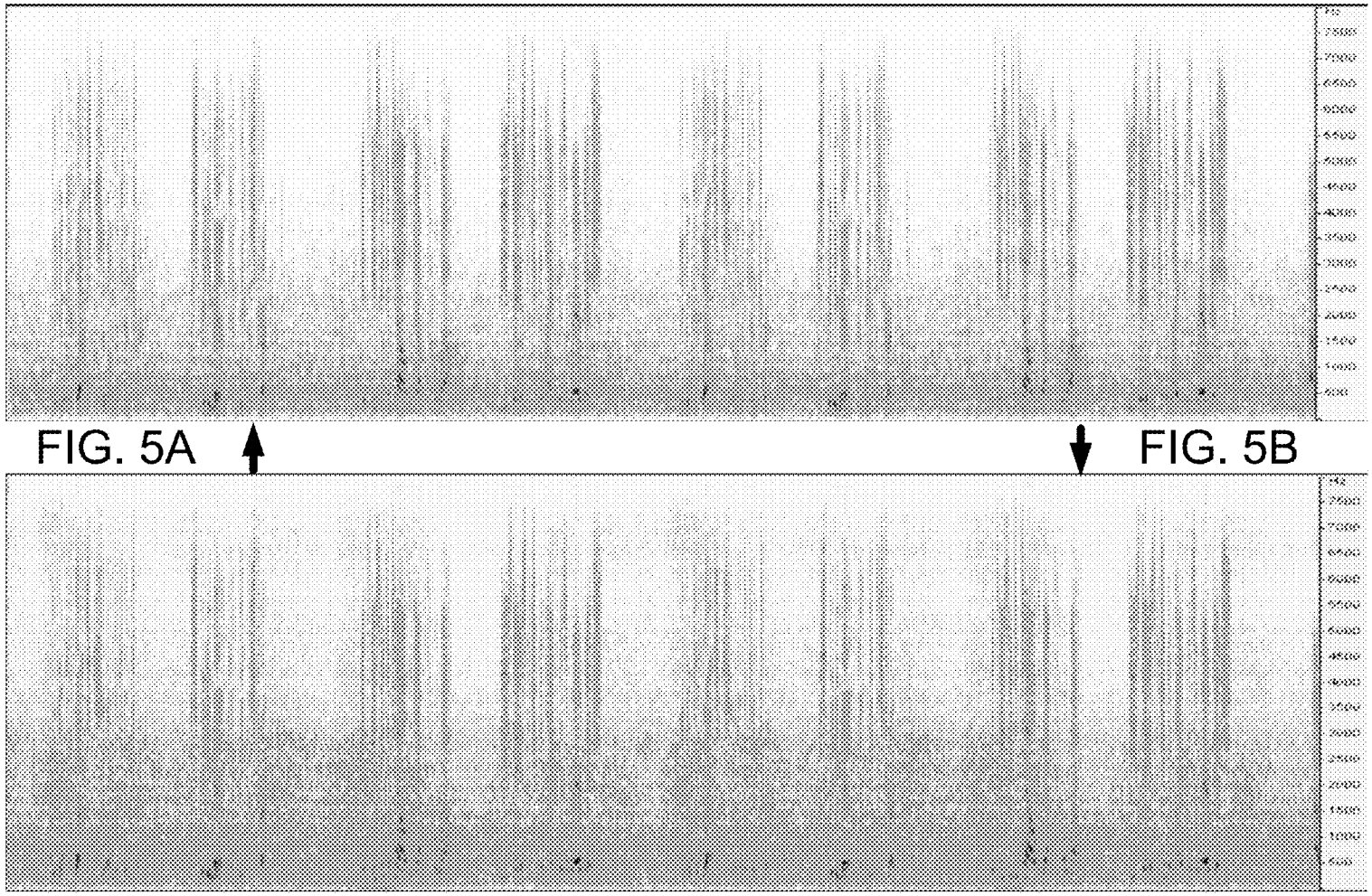
FIGS. 5A and 5B show spectrograms of the same near-end voice signal in different noise environments and under different sound pressure levels.
Figure 6:
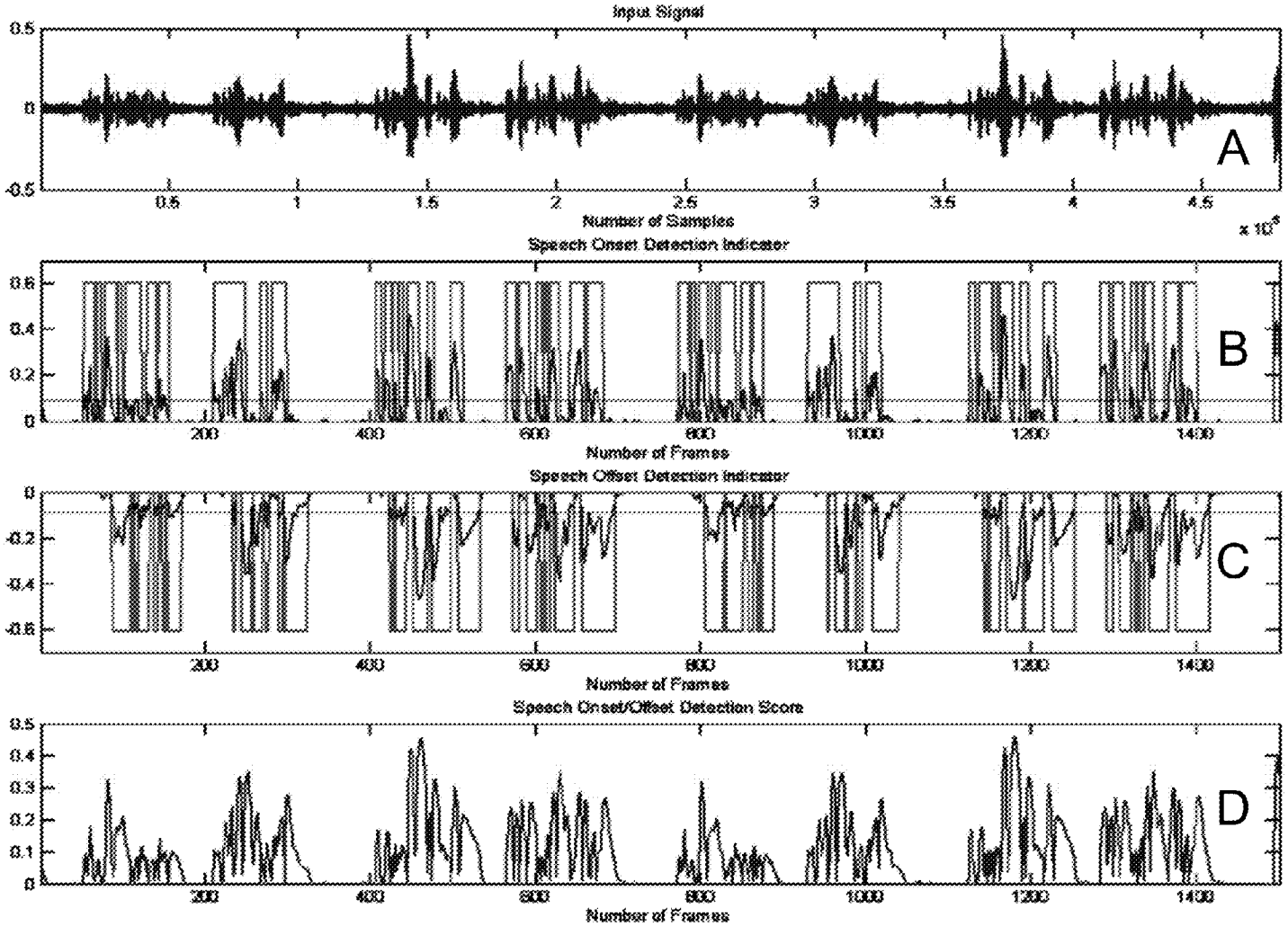
FIG. 6 shows several plots relating to the spectrogram of FIG. 5A.
Figure 7:
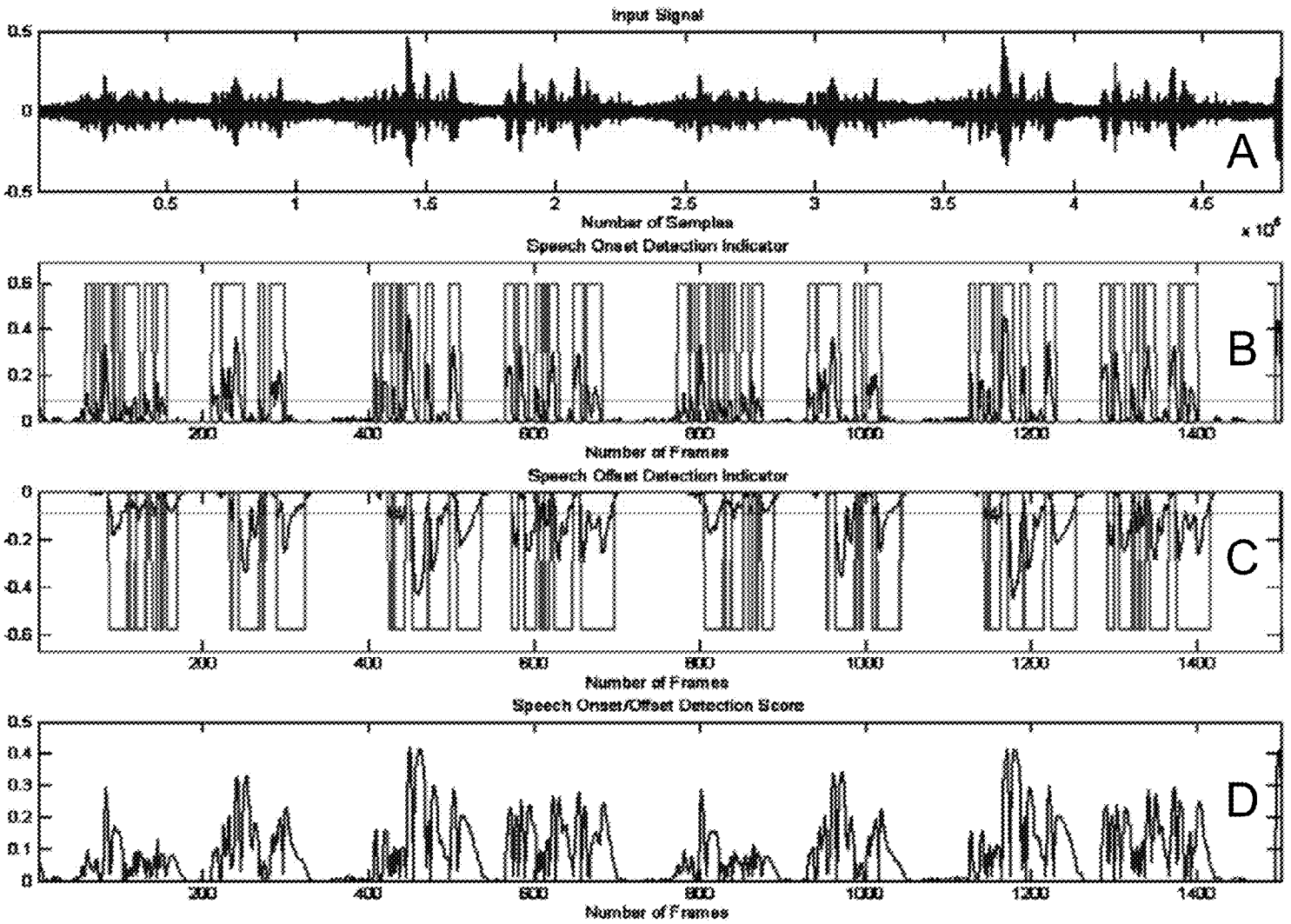
FIG. 7 shows several plots relating to the spectrogram of FIG. 5B.

FIGS. 5A, 5B, 6, and 7 show an example of how such a combined onset/offset activity metric may be used to help track near-end speech energy changes in time. FIGS. 5A and 5B show spectrograms of signals that include the same near-end voice in different noise environments and under different sound pressure levels. Plots A of FIGS. 6 and 7 show the signals of FIGS. 5A and 5B, respectively, in the time domain (as amplitude vs. time in samples). Plots B of FIGS. 6 and 7 show the results (as value vs. time in frames) of performing an implementation of method M100 on the signal of plot A to obtain an onset indication signal. Plots C of FIGS. 6 and 7 show the results (as value vs. time in frames) of performing an implementation of method M100 on the signal of plot A to obtain an offset indication signal. In plots B and C, the corresponding frame activity indication signal is shown as the multivalued signal, the corresponding activation threshold is shown as a horizontal line (at about +0.1 in plots 6B and 7B and at about −0.1 in plots 6C and 7C), and the corresponding transition indication signal is shown as the binary-valued signal (with values of zero and about +0.6 in plots 6B and 7B and values of zero and about −0.6 in plots 6C and 7C). Plots D of FIGS. 6 and 7 show the results (as value vs. time in frames) of performing an implementation of method M120 on the signal of plot A to obtain a combined onset/offset indication signal. Comparison of plots D of FIGS. 6 and 7 demonstrates the consistent performance of such a detector in different noise environments and under different sound pressure levels.

Figure 8:
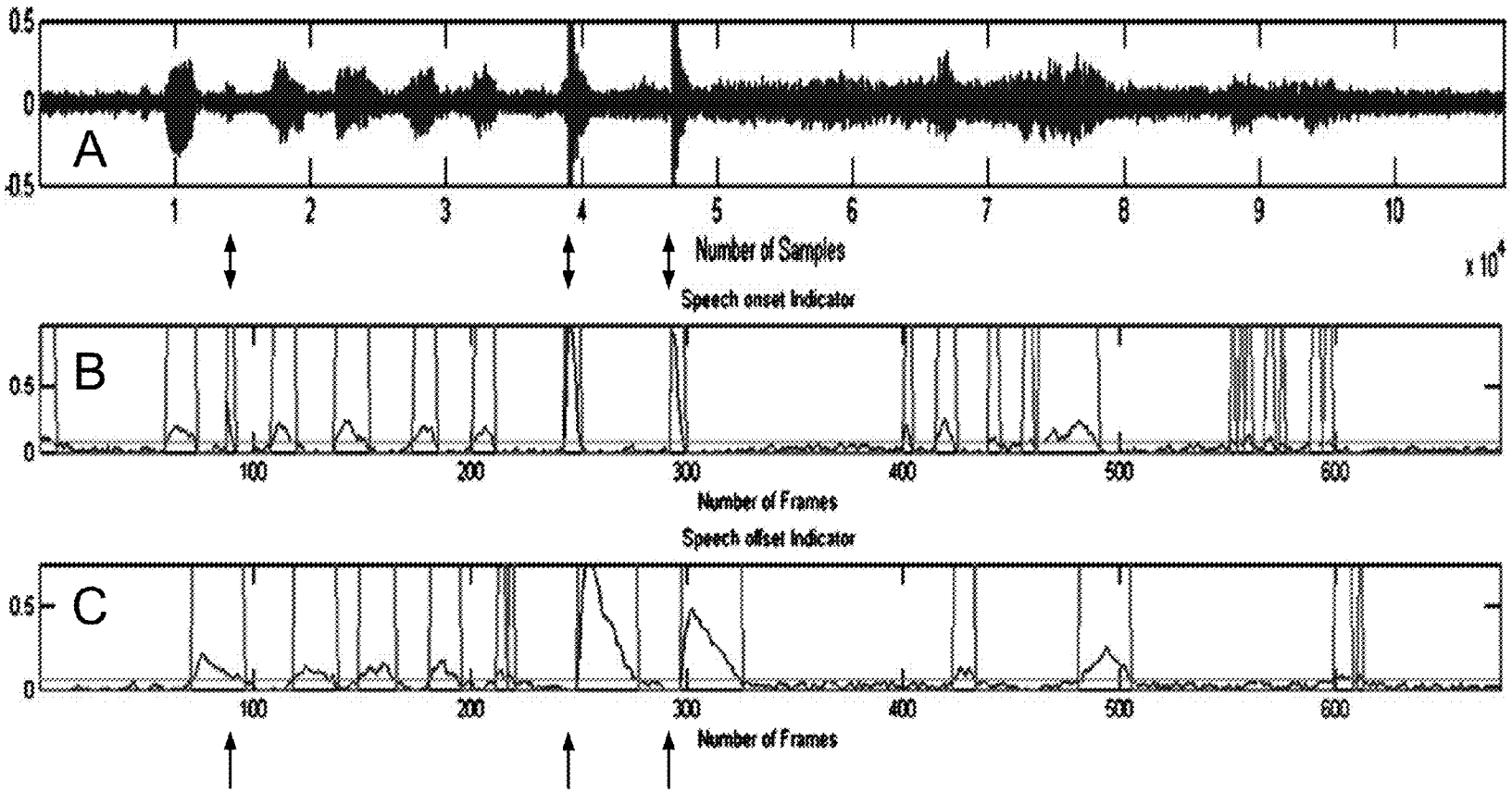
FIG. 8 shows responses to non-speech impulses.

A non-speech sound impulse, such as a slammed door, a dropped plate, or a hand clap, may also create responses that show consistent power changes over a range of frequencies. FIG. 8 shows results of performing onset and offset detections (e.g., using corresponding implementations of method M100, or an instance of method M110) on a signal that includes several non-speech impulsive events. In this figure, plot A shows the signal in the time domain (as amplitude vs. time in samples), plot B shows the results (as value vs. time in frames) of performing an implementation of method M100 on the signal of plot A to obtain an onset indication signal, and plot C shows the results (as value vs. time in frames) of performing an implementation of method M100 on the signal of plot A to obtain an offset indication signal. (In plots B and C, the corresponding frame activity indication signal, activation threshold, and transition indication signal are shown as described with reference to plots B and C of FIGS. 6 and 7.) The left-most arrows in FIG. 8 indicate detection of a discontinuous onset (i.e., an onset that is detected while an offset is being detected) that is caused by a door slam. The center and right-most arrows in FIG. 8 indicate onset and offset detections that are caused by hand clapping. It may be desirable to distinguish such impulsive events from voice activity state transitions (e.g., speech onset and offsets).

Non-speech impulsive activations are likely to be consistent over a wider range of frequencies than a speech onset or offset, which typically exhibits a change in energy with respect to time that is continuous only over a range of about four to eight kHz. Consequently, an non-speech impulsive event is likely to cause a combined activity indication (e.g., S(n)) to have a value that is too high to be due to speech. Method M100 may be implemented to exploit this property to distinguish non-speech impulsive events from voice activity state transitions.

Figure 9A:
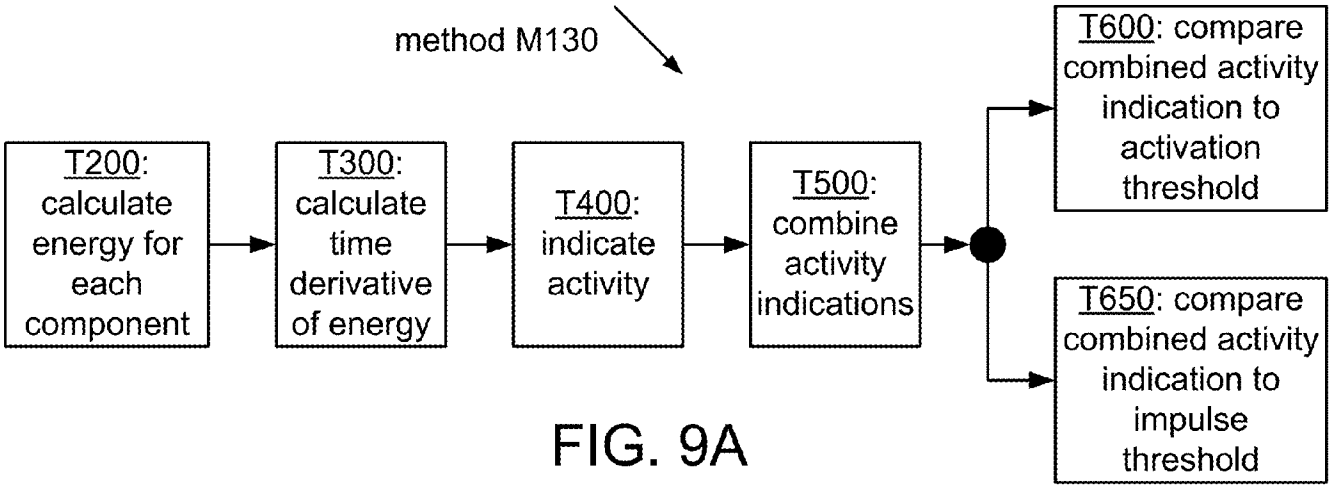
FIG. 9A shows a flowchart for an implementation M130 of method M100.
Figure 9B:
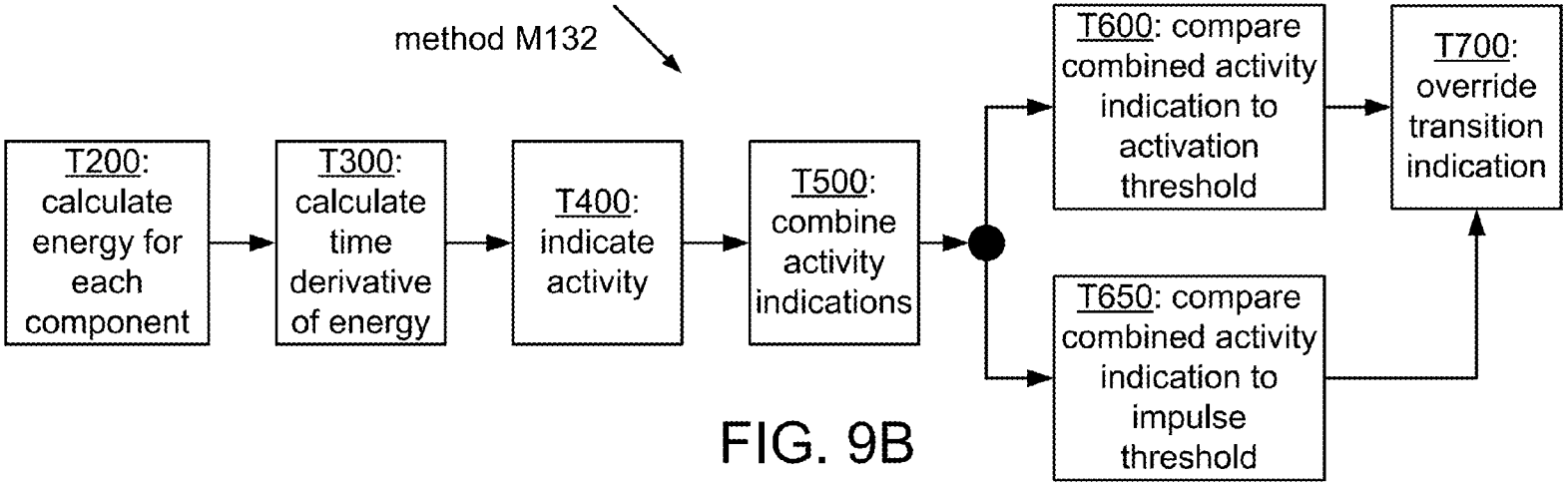
FIG. 9B shows a flowchart for an implementation M132 of method M130.

FIG. 9A shows a flowchart of such an implementation M130 of method M100 that includes a task T650, which compares the value of S(n) to an impulse threshold value $T_{imp}$. FIG. 9B shows a flowchart of an implementation M132 of method M130 that includes a task T700, which overrides the output of task T600 to cancel a voice activity transition indication if S(n) is greater than (alternatively, not less than) $T_{imp}$. For such a case in which the values of A(k,n) [e.g., of $A_{off}$(k,n)] may be negative (e.g., as in the offset example above), task T700 may be configured to indicate a voice activity transition indication only if S(n) is less than (alternatively, not greater than) the corresponding override threshold value. Additionally or in the alternative to such detection of over-activation, such impulse rejection may include a modification of method M110 to identify a discontinuous onset (e.g., indication of onset and offset in the same segment) as impulsive noise.

Non-speech impulsive noise may also be distinguished from speech by the speed of the onset. For example, the energy of a speech onset or offset in a frequency component tends to change more slowly over time than energy due to a non-speech impulsive event, and method M100 may be implemented to exploit this property (e.g., additionally or in the alternative to over-activation as described above) to distinguish non-speech impulsive events from voice activity state transitions.

Figure 10A:
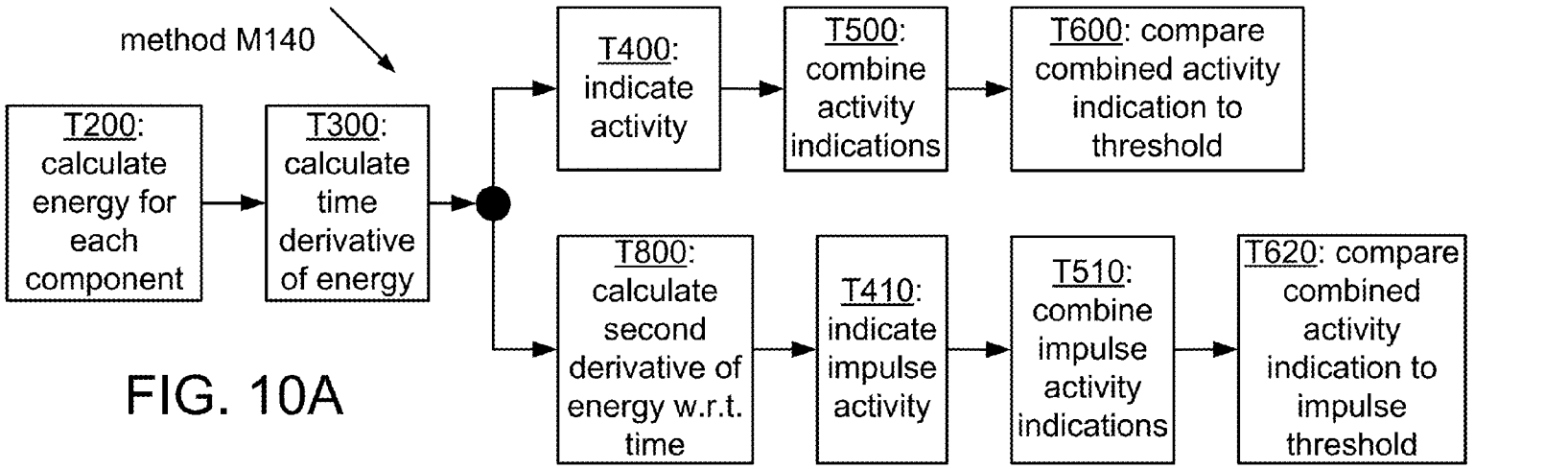
FIG. 10A shows a flowchart for an implementation M140 of method M100.

FIG. 10A shows a flowchart for an implementation M140 of method M100 that includes onset speed calculation task T800 and instances T410, T510, and T620 of tasks T400, T500, and T600, respectively. Task T800 calculates an onset speed Δ2E(k,n) (i.e., the second derivative of energy with respect to time) for each frequency component k of segment n. For example, task T800 may be configured to calculate the onset speed according to an expression such as Δ2E(k,n)=[ΔE(k,n)−ΔE(k,n−1)].

Instance T410 of task T400 is arranged to calculate an impulsive activation value $A_{imp-d2}$(k,n) for each frequency component of segment n. Task T410 may be configured to calculate $A_{imp-d2}$(k,n) as a binary value, for example, by comparing Δ2E(k,n) to an impulsive activation threshold. In one such example, task T410 is configured to calculate an impulsive activation parameter $A_{imp-d2}$(k,n) according to an expression such as $$A_{imp-d2}(k,n) = \begin{cases} 1, & \Delta 2E(k,n) > T_{act-imp} \\ 0, & \text{otherwise} \end{cases}$$

or $$A_{imp-d2}(k,n) = \begin{cases} 1, & \Delta 2E(k,n) \geq T_{act-imp} \\ 0, & \text{otherwise.} \end{cases}$$

Instance T510 of task T500 combines the impulsive activity indications for segment n to produce a segment impulsive activity indication $S_{imp-d2}$(n). In one example, task T510 is configured to calculate $S_{imp-d2}$(n) as the sum of the values $A_{imp-d2}$(k,n) for the segment. In another example, task T510 is configured to calculate $S_{imp-d2}$(n) as the normalized sum (e.g., the mean) of the values $A_{imp-d2}$(k,n) for the segment.

Figure 10B:
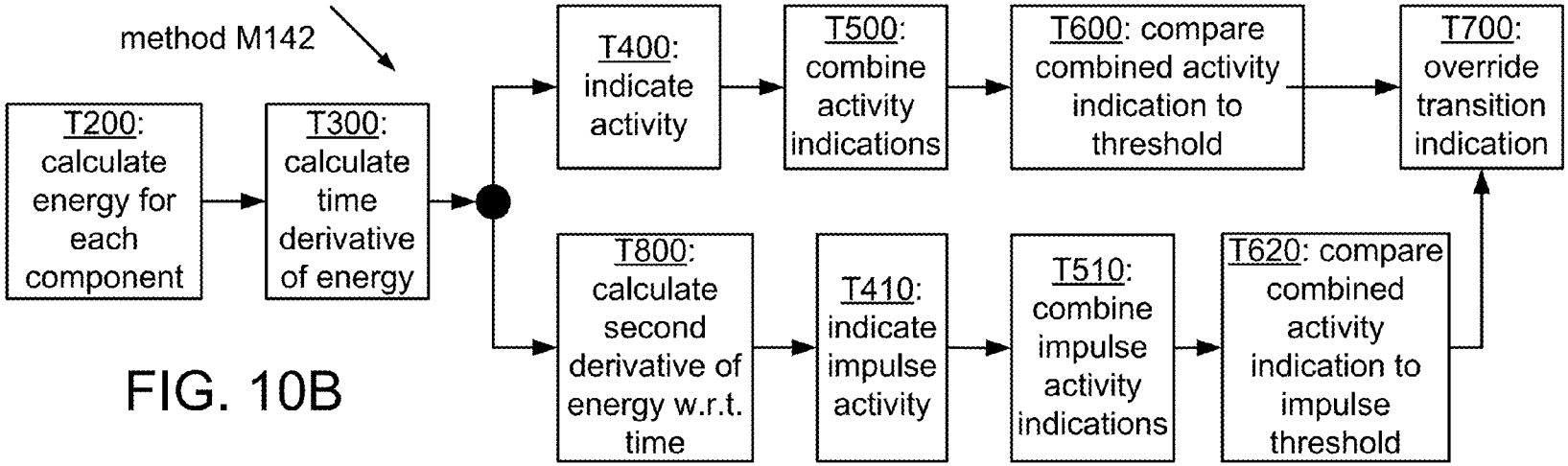
FIG. 10B shows a flowchart for an implementation M142 of method M140.

Instance T620 of task T600 compares the value of the segment impulsive activity indication $S_{imp-d2}$(n) to an impulse detection threshold value $T_{imp-d2}$ and indicates detection of an impulsive event if $S_{imp-d2}$(n) is greater than (alternatively, not less than) $T_{imp-d2}$. FIG. 10B shows a flowchart of an implementation M142 of method M140 that includes an instance of task T700 that is arranged to override the output of task T600 to cancel a voice activity transition indication if task T620 indicates that S(n) is greater than (alternatively, not less than) $T_{imp-d2}$.

Figure 11:
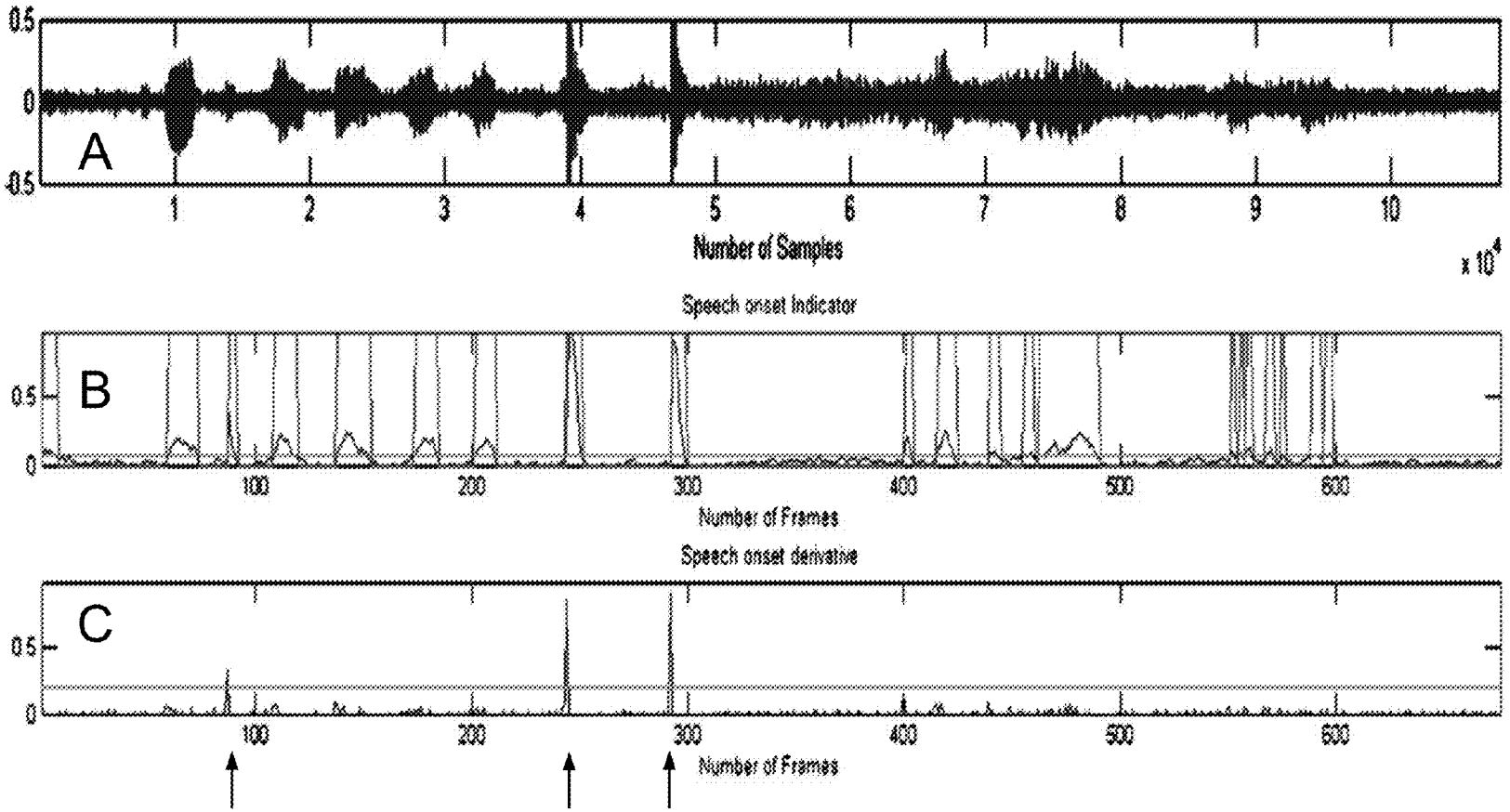
FIG. 11 shows responses to non-speech impulses.

FIG. 11 shows an example in which a speech onset derivative technique (e.g., method M140) correctly detects the impulses indicated by the three arrows in FIG. 8. In this figure, plot A shows the signal in the time domain (as amplitude vs. time in samples), plot B shows the results (as value vs. time in frames) of performing an implementation of method M100 on the signal of plot A to obtain an onset indication signal, and plot C shows the results (as value vs. time in frames) of performing an implementation of method M140 on the signal of plot A to obtain indication of an impulsive event. (In plots B and C, the corresponding frame activity indication signal, activation threshold, and transition indication signal are shown as described with reference to plots B and C of FIGS. 6 and 7.) In this example, impulse detection threshold value $T_{imp-d2}$ has a value of about 0.2.

Indication of speech onsets and/or offsets (or a combined onset/offset score) as produced by an implementation of method M100 as described herein may be used to improve the accuracy of a VAD stage and/or to quickly track energy changes in time. For example, a VAD stage may be configured to combine an indication of presence or absence of a transition in voice activity state, as produced by an implementation of method M100, with an indication as produced by one or more other VAD techniques (e.g., using AND or OR logic) to produce a voice activity detection signal.

Examples of other VAD techniques whose results may be combined with those of an implementation of method M100 include techniques that are configured to classify a segment as active (e.g., speech) or inactive (e.g., noise) based on one or more factors such as frame energy, signal-to-noise ratio, periodicity, autocorrelation of speech and/or residual (e.g., linear prediction coding residual), zero crossing rate, and/or first reflection coefficient. Such classification may include comparing a value or magnitude of such a factor to a threshold value and/or comparing the magnitude of a change in such a factor to a threshold value. Alternatively or additionally, such classification may include comparing a value or magnitude of such a factor, such as energy, or the magnitude of a change in such a factor, in one frequency band to a like value in another frequency band. It may be desirable to implement such a VAD technique to perform voice activity detection based on multiple criteria (e.g., energy, zero-crossing rate, etc.) and/or a memory of recent VAD decisions. One example of a voice activity detection operation whose results may be combined with those of an implementation of method M100 includes comparing highband and lowband energies of the segment to respective thresholds as described, for example, in section 4.7 (pp. 4-48 to 4-55) of the 3GPP2 document C.S0014-D, v3.0, entitled "Enhanced Variable Rate Codec, Speech Service Options 3, 68, 70, and 73 for Wideband Spread Spectrum Digital Systems," October 2010 (available online at www-dot-3gpp-dot-org). Other examples include comparing a ratio of frame energy to average energy and/or a ratio of lowband energy to highband energy.

A multichannel signal (e.g., a dual-channel or stereophonic signal), in which each channel is based on a signal produced by a corresponding one of an array of microphones, typically contains information regarding source direction and/or proximity that may be used for voice activity detection. Such a multichannel VAD operation may be based on direction of arrival (DOA), for example, by distinguishing segments that contain directional sound arriving from a particular directional range (e.g., the direction of a desired sound source, such as the user's mouth) from segments that contain diffuse sound or directional sound arriving from other directions.

One class of DOA-based VAD operations is based on the phase difference, for each frequency component of the segment in a desired frequency range, between the frequency component in each of two channels of the multichannel signal. Such a VAD operation may be configured to indicate voice detection when the relation between phase difference and frequency is consistent (i.e., when the correlation of phase difference and frequency is linear) over a wide frequency range, such as 500-2000 Hz. Such a phase-based VAD operation, which is described in more detail below, is similar to method M100 in that presence of a point source is indicated by consistency of an indicator over multiple frequencies. Another class of DOA-based VAD operations is based on a time delay between an instance of a signal in each channel (e.g., as determined by cross-correlating the channels in the time domain).

Another example of a multichannel VAD operation is based on a difference between levels (also called gains) of channels of the multichannel signal. A gain-based VAD operation may be configured to indicate voice detection, for example, when the ratio of the energies of two channels exceeds a threshold value (indicating that the signal is arriving from a near-field source and from a desired one of the axis directions of the microphone array). Such a detector may be configured to operate on the signal in the frequency domain (e.g., over one or more particular frequency ranges) or in the time domain.

It may be desirable to combine onset/offset detection results (e.g., as produced by an implementation of method M100 or apparatus A100 or MF100) with results from one or more VAD operations that are based on differences between channels of a multichannel signal. For example, detection of speech onsets and/or offsets as described herein may be used to identify speech segments that are left undetected by gain-based and/or phase-based VADs. The incorporation of onset and/or offset statistics into a VAD decision may also support the use of a reduced hangover period for single- and/or multichannel (e.g., gain-based or phase-based) VADs.

Multichannel voice activity detectors that are based on inter-channel gain differences and single-channel (e.g., energy-based) voice activity detectors typically rely on information from a wide frequency range (e.g., a 0-4 kHz, 500-4000 Hz, 0-8 kHz, or 500-8000 Hz range). Multichannel voice activity detectors that are based on direction of arrival (DOA) typically rely on information from a low-frequency range (e.g., a 500-2000 Hz or 500-2500 Hz range). Given that voiced speech usually has significant energy content in these ranges, such detectors may generally be configured to reliably indicate segments of voiced speech.

Segments of unvoiced speech, however, typically have low energy, especially as compared to the energy of a vowel in the low-frequency range. These segments, which may include unvoiced consonants and unvoiced portions of voiced consonants, also tend to lack important information in the 500-2000 Hz range. Consequently, a voice activity detector may fail to indicate these segments as speech, which may lead to coding inefficiencies and/or loss of speech information (e.g., through inappropriate coding and/or overly aggressive noise reduction).

It may be desirable to obtain an integrated VAD stage by combining a speech detection scheme that is based on detection of speech onsets and/or offsets as indicated by spectrogram cross-frequency continuity (e.g., an implementation of method M100) with detection schemes that are based on other features, such as inter-channel gain differences and/or coherence of inter-channel phase differences. For example, it may be desirable to complement a gain-based and/or phase-based VAD framework with an implementation of method M100 that is configured to track speech onset and/or offset events, which primarily occur in the high frequencies. The individual features of such a combined classifier may complement each other, as onset/offset detection tends to be sensitive to different speech characteristics in different frequency ranges as compared to gain-based and phase-based VADs. The combination of a 500-2000 Hz phase-sensitive VAD and a 4000-8000 Hz high-frequency speech onset/offset detector, for example, allows preservation of low-energy speech features (e.g., at consonant-rich beginnings of words) as well as high-energy speech features. It may be desirable to design a combined detector to provide a continuous detection indication from an onset to the corresponding offset.

Figure 12:
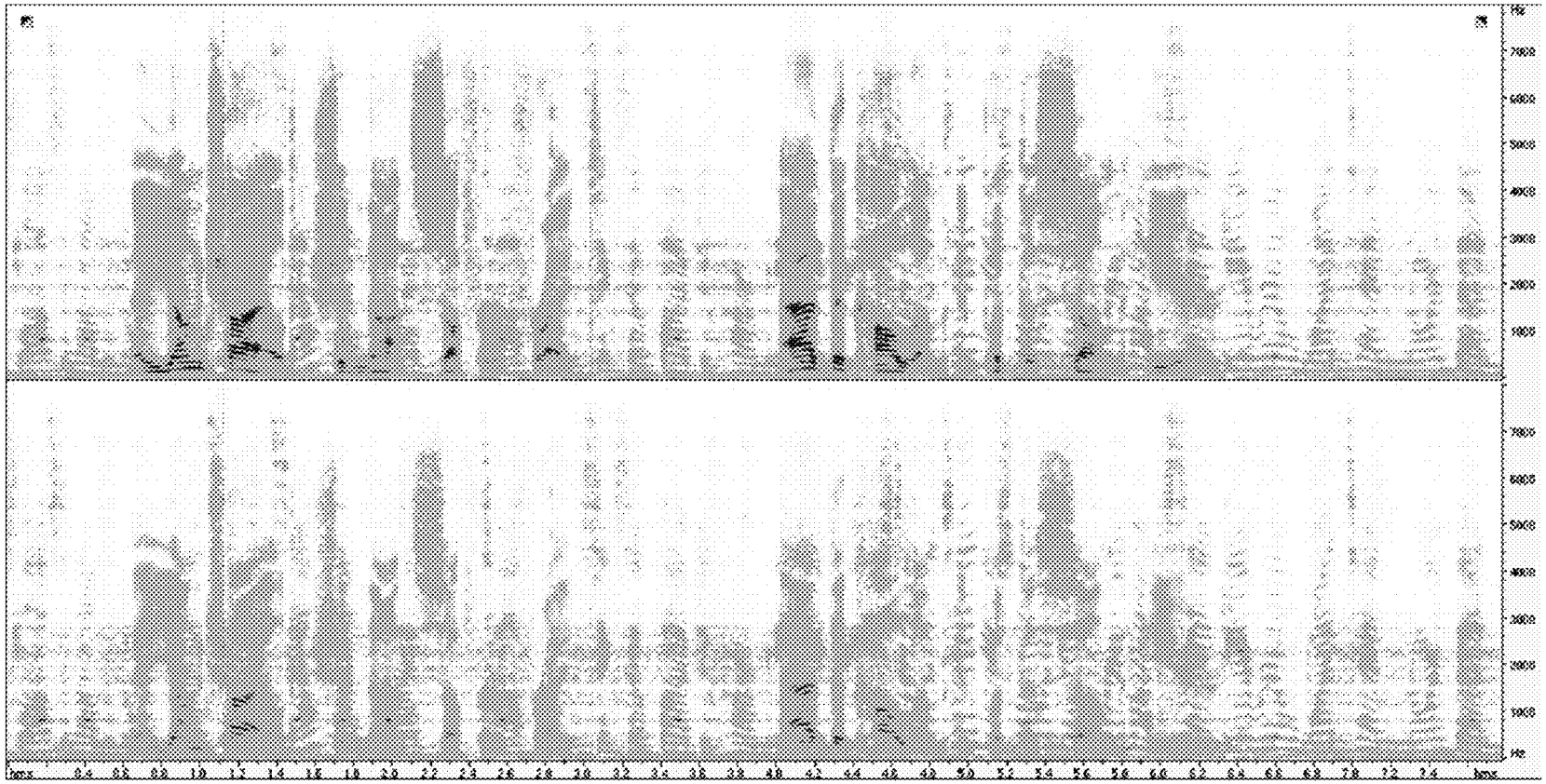
FIG. 12 shows a spectrogram of a first stereo speech recording.

FIG. 12 shows a spectrogram of a multichannel recording of a near-field speaker that also includes far-field interfering speech. In this figure, the recording on top is from a microphone that is close to the user's mouth and the recording on the bottom is from a microphone that is farther from the user's mouth. High-frequency energy from speech consonants and sibilants is clearly discernible in the top spectrogram.

In order to effectively preserve low-energy speech components that occur at the ends of voiced segments, it may be desirable for a voice activity detector, such as a gain-based or phase-based multichannel voice activity detector or an energy-based single-channel voice activity detector, to include an inertial mechanism. One example of such a mechanism is logic that is configured to inhibit the detector from switching its output from active to inactive until the detector continues to detect inactivity over a hangover period of several consecutive frames (e.g., two, three, four, five, ten, or twenty frames). For example, such hangover logic may be configured to cause the VAD to continue to identify segments as speech for some period after the most recent detection.

It may be desirable for the hangover period to be long enough to capture any undetected speech segments. For example, it may be desirable for a gain-based or phase-based voice activity detector to include a hangover period of about two hundred milliseconds (e.g., about twenty frames) to cover speech segments that were missed due to low energy or to lack of information in the relevant frequency range. If the undetected speech ends before the hangover period, however, or if no low-energy speech component is actually present, the hangover logic may cause the VAD to pass noise during the hangover period.

Speech offset detection may be used to reduce the length of VAD hangover periods at the ends of words. As noted above, it may be desirable to provide a voice activity detector with hangover logic. In such case, it may be desirable to combine such a detector with a speech offset detector in an arrangement to effectively terminate the hangover period in response to an offset detection (e.g., by resetting the hangover logic or otherwise controlling the combined detection result). Such an arrangement may be configured to support a continuous detection result until the corresponding offset may be detected. In a particular example, a combined VAD includes a gain and/or phase VAD with hangover logic (e.g., having a nominal 200-msec period) and an offset VAD that is arranged to cause the combined detector to stop indicating speech as soon as the end of the offset is detected. In such manner, an adaptive hangover may be obtained.

Figure 13A:
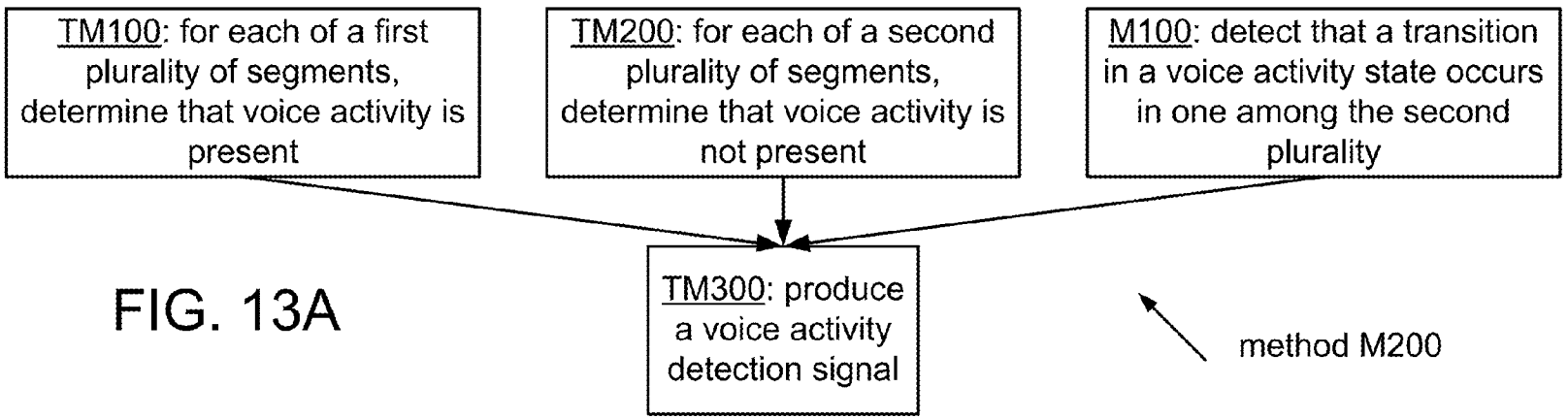
FIG. 13A shows a flowchart of a method M200 according to a general configuration.

FIG. 13A shows a flowchart of a method M200 according to a general configuration that may be used to implement an adaptive hangover. Method M200 includes a task TM100 which determines that voice activity is present in each of a first plurality of consecutive segments of an audio signal, and a task TM200 which determines that voice activity is not present in each of a second plurality of consecutive segments of the audio signal that immediately follows the first plurality in the signal. Tasks TM100 and TM200 may be performed, for example, by a single- or multichannel voice activity detector as described herein. Method M200 also includes an instance of method M100 that detects a transition in a voice activity state in one among the second plurality of segments. Based on the results of tasks TM100, TM200, and M100, task TM300 produces a voice activity detection signal.

Figure 13B:
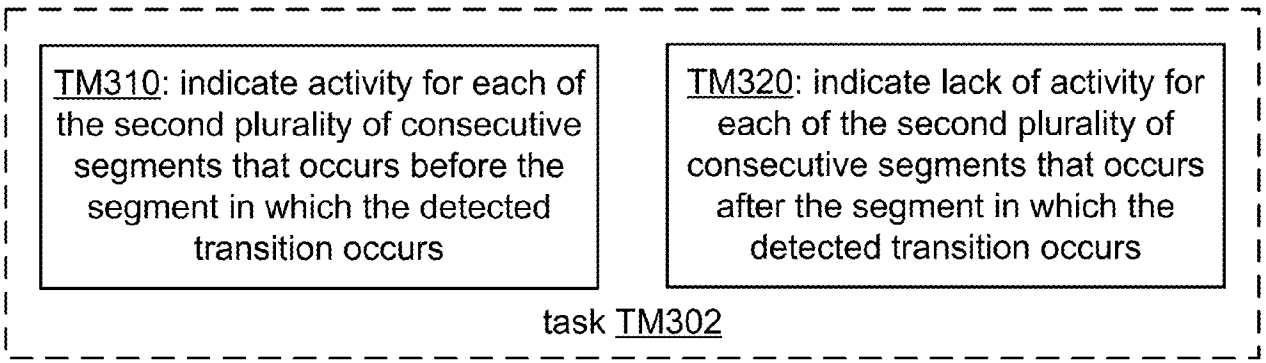
FIG. 13B shows a block diagram of an implementation TM302 of task TM300.

FIG. 13B shows a block diagram of an implementation TM302 of task TM300 that includes subtasks TM310 and TM320. For each of the first plurality of segments, and for each of the second plurality of segments that occurs before the segment in which the transition is detected, task TM310 produces the corresponding value of the VAD signal to indicate activity (e.g., based on the results of task TM100). For each of the second plurality of segments that occurs after the segment in which the transition is detected, task TM320 produces the corresponding value of the VAD signal to indicate a lack of activity (e.g., based on the results of task TM200).

Task TM302 may be configured such that the detected transition is the start of an offset or, alternatively, the end of an offset. FIG. 14A illustrates an example of an operation of an implementation of method M200, in which the value of the VAD signal for a transitional segment (indicated as X) may be selected by design to be 0 or 1. In one example, the VAD signal value for the segment in which the end of the offset is detected is the first one to indicate lack of activity. In another example, the VAD signal value for the segment immediately following the segment in which the end of the offset is detected is the first one to indicate lack of activity.

FIG. 14B shows a block diagram of an apparatus A200 according to a general configuration that may be used to implement a combined VAD stage with adaptive hangover. Apparatus A200 includes a first voice activity detector VAD10 (e.g., a single- or multichannel detector as described herein), which may be configured to perform implementations of tasks TM100 and TM200 as described herein. Apparatus A200 also includes a second voice activity detector VAD20, which may be configured to perform speech offset detection as described herein. Apparatus A200 also includes a signal generator SG10, which may be configured to perform an implementation of task TM300 as described herein. FIG. 14C shows a block diagram of an implementation A205 of apparatus A200 in which second voice activity detector VAD20 is implemented as an instance of apparatus A100 (e.g., apparatus A100, A110, or A120).

Figure 15A:
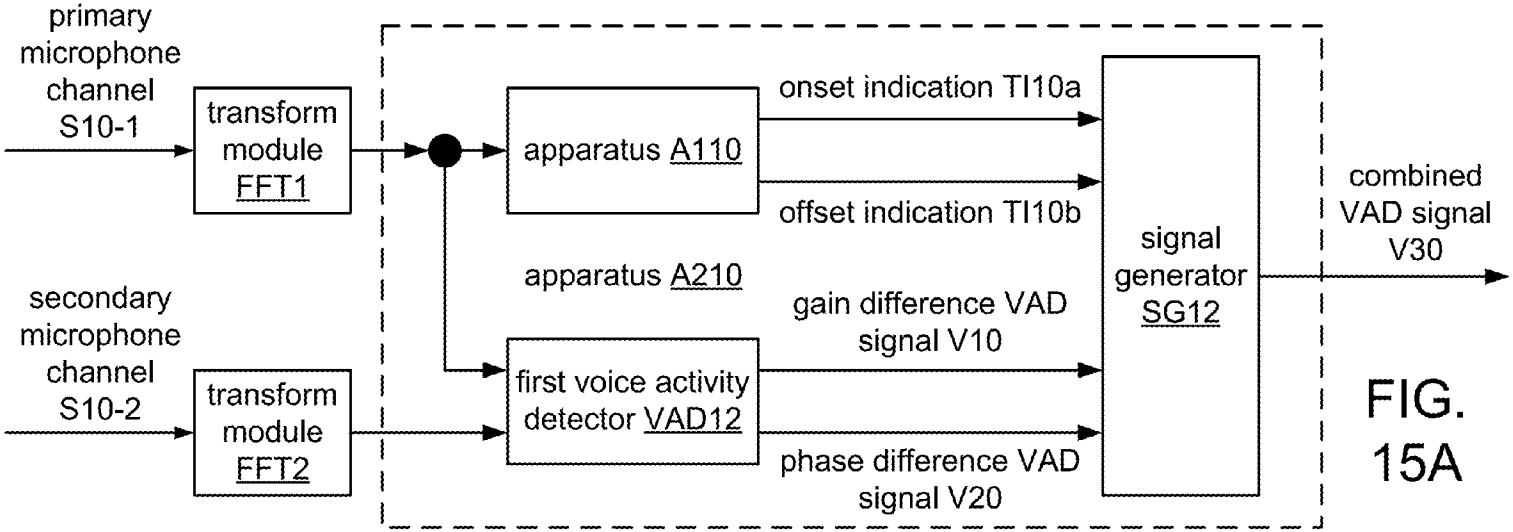
FIG. 15A shows a block diagram of an implementation A210 of apparatus A205.

FIG. 15A shows a block diagram of an implementation A210 of apparatus A205 that includes an implementation VAD12 of first detector VAD10 that is configured to receive a multichannel audio signal (in this example, in the frequency domain) and produce a corresponding VAD signal V10 that is based on inter-channel gain differences and a corresponding VAD signal V20 that is based on inter-channel phase differences. In one particular example, gain difference VAD signal V10 is based on differences over the frequency range of from 0 to 8 kHz, and phase difference VAD signal V20 is based on differences in the frequency range of from 500 to 2500 Hz.

Apparatus A210 also includes an implementation A110 of apparatus A100 as described herein that is configured to receive one channel (e.g., the primary channel) of the multichannel signal and to produce a corresponding onset indication TI10*a* and a corresponding offset indication TI10*b*. In one particular example, indications TI10*a* and TI10*b* are based on differences in the frequency range of 510 Hz to eight kHz. (It is expressly noted that in general, a speech onset and/or offset detector arranged to adapt a hangover period of a multichannel detector may operate on a channel that is different from the channels received by the multichannel detector.) In a particular example, onset indication TI10*a* and offset indication TI10*b* are based on energy differences in the frequency range of from 500 to 8000 Hz. Apparatus A210 also includes an implementation SG12 of signal generator SG10 that is configured to receive the VAD signals V10 and V20 and the transition indications TI10*a* and TI10*b* and to produce a corresponding combined VAD signal V30.

Figure 15B:
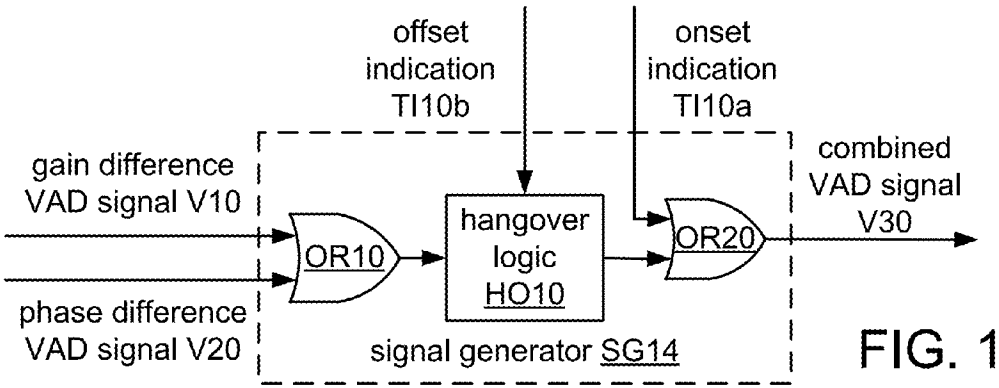
FIG. 15B shows a block diagram of an implementation SG14 of signal generator SG12.

FIG. 15B shows a block diagram of an implementation SG14 of signal generator SG12. This implementation includes OR logic OR10 for combining gain difference VAD signal V10 and phase difference VAD signal V20 to obtain a combined multichannel VAD signal; hangover logic HO10 configured to impose an adaptive hangover period on the combined multichannel signal, based on offset indication TI10*b*, to produce an extended VAD signal; and OR logic OR20 for combining the extended VAD signal with onset indication TI10*a* to produce a combined VAD signal V30. In one example, hangover logic HO10 is configured to terminate the hangover period when offset indication TI10*b* indicates the end of an offset. Particular examples of maximum hangover values include zero, one, ten, and twenty segments for phase-based VAD and eight, ten, twelve, and twenty segments for gain-based VAD. It is noted that signal generator SG10 may also be implemented to apply a hangover to onset indication TI10*a* and/or offset indication TI10*b*.

Figure 16A:
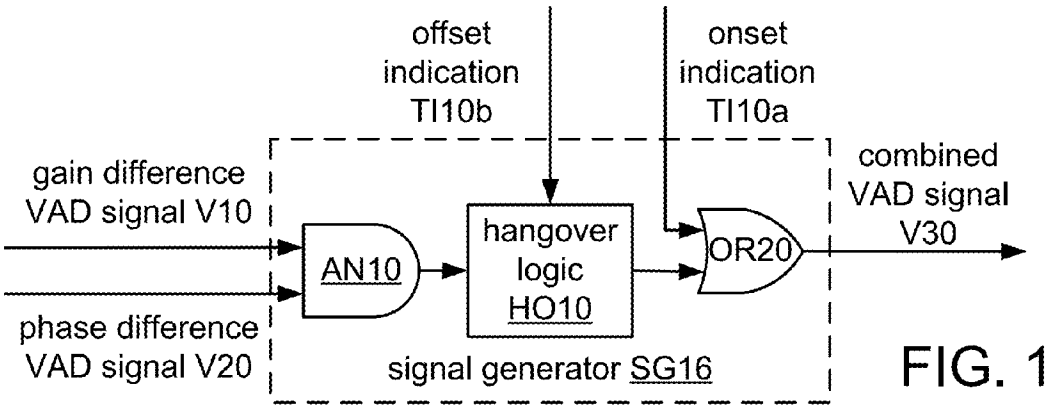
FIG. 16A shows a block diagram of an implementation SG16 of signal generator SG12.

FIG. 16A shows a block diagram of another implementation SG16 of signal generator SG12 in which the combined multichannel VAD signal is produced by combining gain difference VAD signal V10 and phase difference VAD signal V20 using AND logic AN10 instead. Further implementations of signal generator SG14 or SG16 may also include hangover logic configured to extend onset indication TI10*a*, logic to override an indication of voice activity for a segment in which onset indication TI10*a* and offset indication TI10*b* are both active, and/or inputs for one or more other VAD signals at AND logic AN10, OR logic OR10, and/or OR logic OR20.

Additionally or in the alternative to adaptive hangover control, onset and/or offset detection may be used to vary a gain of another VAD signal, such as gain difference VAD signal V10 and/or phase difference VAD signal V20. For example, the VAD statistic may be multiplied (before thresholding) by a factor greater than one, in response to onset and/or offset indication. In one such example, a phase-based VAD statistic (e.g., a coherency measure) is multiplied by a factor ph_mult>1, and a gain-based VAD statistic (e.g., a difference between channel levels) is multiplied by a factor pd_mult>1, if onset detection or offset detection is indicated for the segment. Examples of values for ph_mult include 2, 3, 3.5, 3.8, 4, and 4.5. Examples of values for pd_mult include 1.2, 1.5, 1.7, and 2.0. Alternatively, one or more such statistics may be attenuated (e.g., multiplied by a factor less than one), in response to a lack of onset and/or offset detection in the segment. In general, any method of biasing the statistic in response to onset and/or offset detection state may be used (e.g., adding a positive bias value in response to detection or a negative bias value in response to lack of detection, raising or lowering a threshold value for the test statistic according to the onset and/or offset detection, and/or otherwise modifying a relation between the test statistic and the corresponding threshold).

It may be desirable to perform such multiplication on VAD statistics that have been normalized (e.g., as described with reference to expressions (N1)-(N4) below) and/or to adjust the threshold value for the VAD statistic when such biasing is selected. It is also noted that a different instance of method M100 may be used to generate onset and/or offset indications for such purpose than the instance used to generate onset and/or offset indications for combination into combined VAD signal V30. For example, a gain control instance of method M100 may use a different threshold value in task T600 (e.g., 0.01 or 0.02 for onset; 0.05, 0.07, 0.09, or 1.0 for offset) than a VAD instance of method M100.

Another VAD strategy that may be combined (e.g., by signal generator SG10) with those described herein is a single-channel VAD signal, which may be based on a ratio of frame energy to average energy and/or on lowband and highband energies. It may be desirable to bias such a single-channel VAD detector toward a high false alarm rate. Another VAD strategy that may be combined with those described herein is a multichannel VAD signal based on inter-channel gain difference in a low-frequency range (e.g., below 900 Hz or below 500 Hz). Such a detector may be expected to accurately detect voiced segments with a low rate of false alarms. FIG. 47B lists several examples of combinations of VAD strategies that may be used to produce a combined VAD signal. In this figure, P denotes phase-based VAD, G denotes gain-based VAD, ON denotes onset VAD, OFF denotes offset VAD, LF denotes low-frequency gain-based VAD, PB denotes boosted phase-based VAD, GB denotes boosted gain-based VAD, and SC denotes single-channel VAD.

Figure 16B:
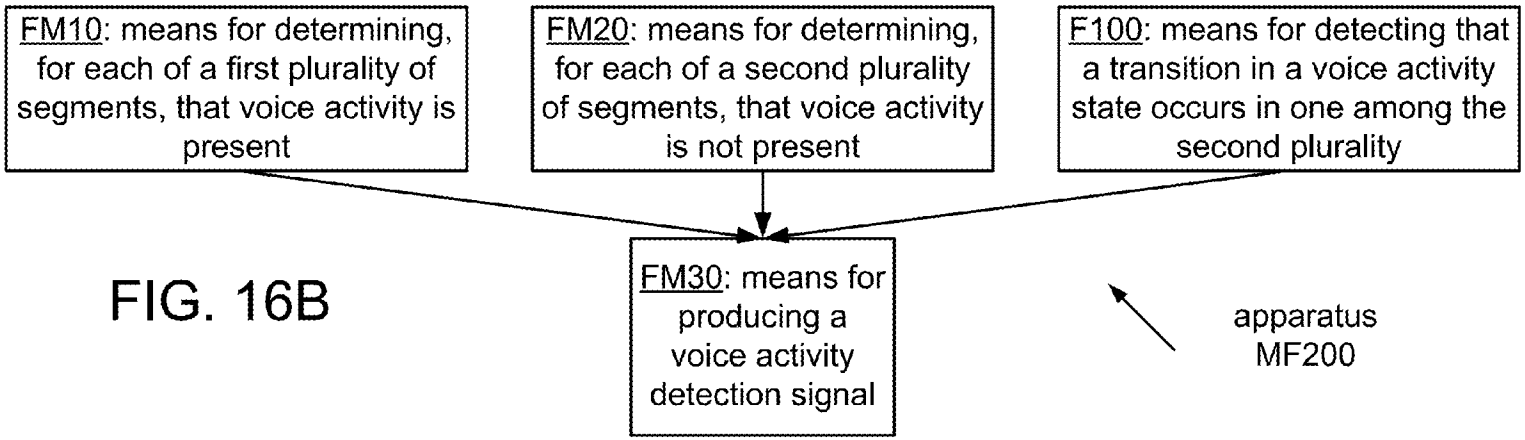
FIG. 16B shows a block diagram of an apparatus MF200 according to a general configuration.

FIG. 16B shows a block diagram of an apparatus MF200 according to a general configuration that may be used to implement a combined VAD stage with adaptive hangover. Apparatus MF200 includes means FM10 for determining that voice activity is present in each of a first plurality of consecutive segments of an audio signal, which may be configured to perform an implementation of task TM100 as described herein. Apparatus MF200 includes means FM20 for determining that voice activity is not present in each of a second plurality of consecutive segments of an audio signal that immediately follows the first plurality in the signal, which may be configured to perform an implementation of task TM200 as described herein. Means FM10 and FM20 may be implemented, for example, as a single- or multichannel voice activity detector as described herein. Apparatus A200 also includes an instance of means FM100 for detecting a transition in a voice activity state in one among the second plurality of segments (e.g., for performing speech offset detection as described herein). Apparatus A200 also includes means FM30 for producing a voice activity detection signal (e.g., as described herein with reference to task TM300 and/or signal generator SG10).

Combining results from different VAD techniques may also be used to decrease sensitivity of the VAD system to microphone placement. When a phone is held down (e.g., away from the user's mouth), for example, both phase-based and gain-based voice activity detectors may fail. In such case, it may be desirable for the combined detector to rely more heavily on onset and/or offset detection. An integrated VAD system may also be combined with pitch tracking.

Although gain-based and phase-based voice activity detectors may suffer when SNR is very low, noise is not usually a problem in high frequencies, such that an onset/offset detector may be configured to include a hangover interval (and/or a temporal smoothing operation) that may be increased when SNR is low (e.g., to compensate for the disabling of other detectors). A detector based on speech onset/offset statistics may also be used to allow more precise speech/noise segmentation by filling in the gaps between decaying and increasing gain/phase-based VAD statistics, thus enabling hangover periods for those detectors to be reduced.

An inertial approach such as hangover logic is not effective on its own for preserving the beginnings of utterances with words rich in consonants, such as "the". A speech onset statistic may be used to detect speech onsets at word beginnings that are missed by one or more other detectors. Such an arrangement may include temporal smoothing and/or a hangover period to extend the onset transition indication until another detector may be triggered.

For most cases in which onset and/or offset detection is used in a multichannel context, it may be sufficient to perform such detection on the channel that corresponds to the microphone that is positioned closest to the user's mouth or is otherwise positioned to receive the user's voice most directly (also called the "close-talking" or "primary" microphone). In some cases, however, it may be desirable to perform onset and/or offset detection on more than one microphone, such as on both microphones in a dual-channel implementation (e.g., for a use scenario in which the phone is rotated to point away from the user's mouth).

Figure 17:
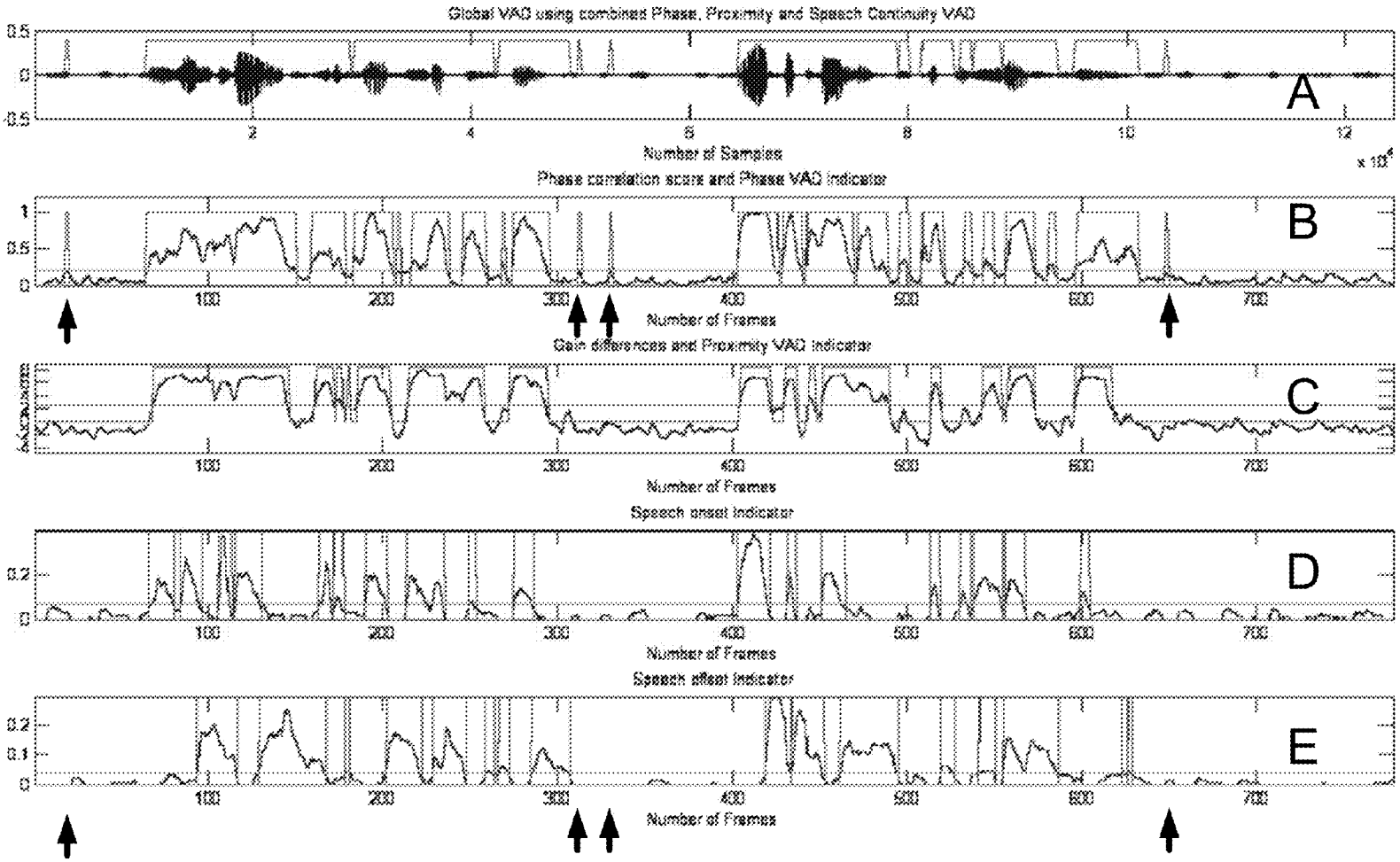
FIGS. 17-19 show examples of different voice detection strategies as applied to the recording of FIG. 12.
Figure 18:
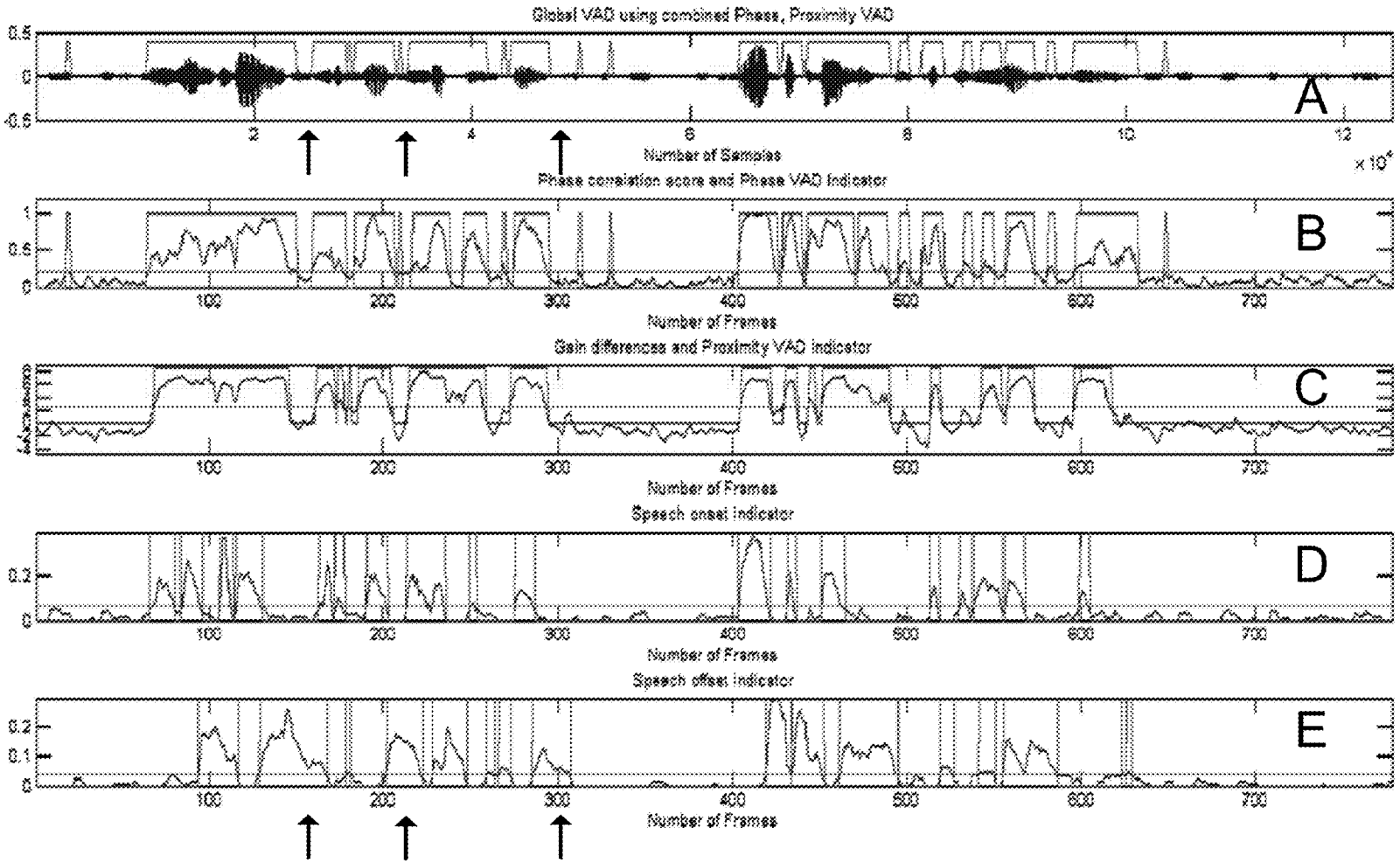
Figure 19:
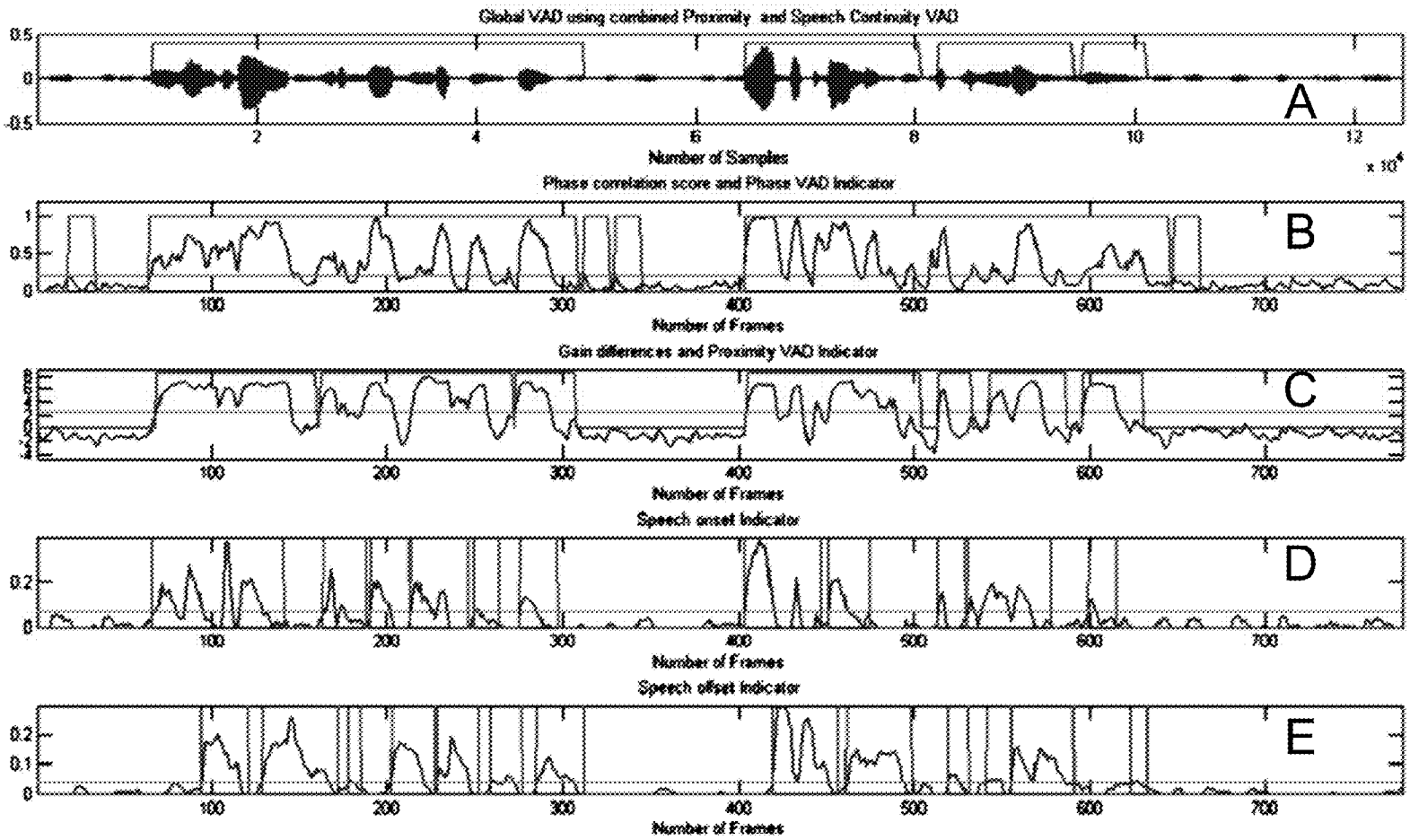

FIGS. 17-19 show examples of different voice detection strategies as applied to the recording of FIG. 12. The top plots of these figures indicate the input signal in the time domain and a binary detection result that is produced by combining two or more of the individual VAD results. Each of the other plots of these figures indicates the time-domain waveforms of the VAD statistics, a threshold value for the corresponding detector (as indicated by the horizontal line in each plot), and the resulting binary detection decisions.

From top to bottom, the plots in FIG. 17 show (A) a global VAD strategy using a combination of all of the detection results from the other plots; (B) a VAD strategy (without hangover) based on correlation of inter-microphone phase differences with frequency over the 500-2500 Hz frequency band; (C) a VAD strategy (without hangover) based on proximity detection as indicated by inter-microphone gain differences over the 0-8000 Hz band; (D) a VAD strategy based on detection of speech onsets as indicated by spectrogram cross-frequency continuity (e.g., an implementation of method M100) over the 500-8000 Hz band; and (E) a VAD strategy based on detection of speech offsets as indicated by spectrogram cross-frequency continuity (e.g., another implementation of method M100) over the 500-8000 Hz band. The arrows at the bottom of FIG. 17 indicate the locations in time of several false positives as indicated by the phase-based VAD.

FIG. 18 differs from FIG. 17 in that the binary detection result shown in the top plot of FIG. 18 is obtained by combining only the phase-based and gain-based detection results as shown in plots B and C, respectively (in this case, using OR logic). The arrows at the bottom of FIG. 18 indicate the locations in time of speech offsets that are not detected by either one of the phase-based VAD and the gain-based VAD.

FIG. 19 differs from FIG. 17 in that the binary detection result shown in the top plot of FIG. 19 is obtained by combining only the gain-based detection result as shown in plot B and the onset/offset detection results as shown in plots D and E, respectively (in this case, using OR logic), and in that both of the phase-based VAD and the gain-based VAD are configured to include a hangover. In this case, results from the phase-based VAD were discarded because of the multiple false positives indicated in FIG. 16. By combining the speech onset/offset VAD results with the gain-based VAD results, the hangover for the gain-based VAD was reduced and the phase-based VAD was not needed. Although this recording also includes far-field interfering speech, the near-field speech onset/offset detector properly failed to detect it, since far-field speech tends to lack salient high-frequency information.

High-frequency information may be important for speech intelligibility. Because air acts like a lowpass filter to the sounds that travel through it, the amount of high-frequency information that is picked up by a microphone will typically decrease as the distance between the sound source and the microphone increases. Similarly, low-energy speech tends to become buried in background noise as the distance between the desired speaker and the microphone increases. However, an indicator of energy activations that are coherent over a high-frequency range, as described herein with reference to method M100, may be used to track near-field speech even in the presence of noise that may obscure low-frequency speech characteristics, as this high-frequency feature may still be detectable in the recorded spectrum.

Figure 20:
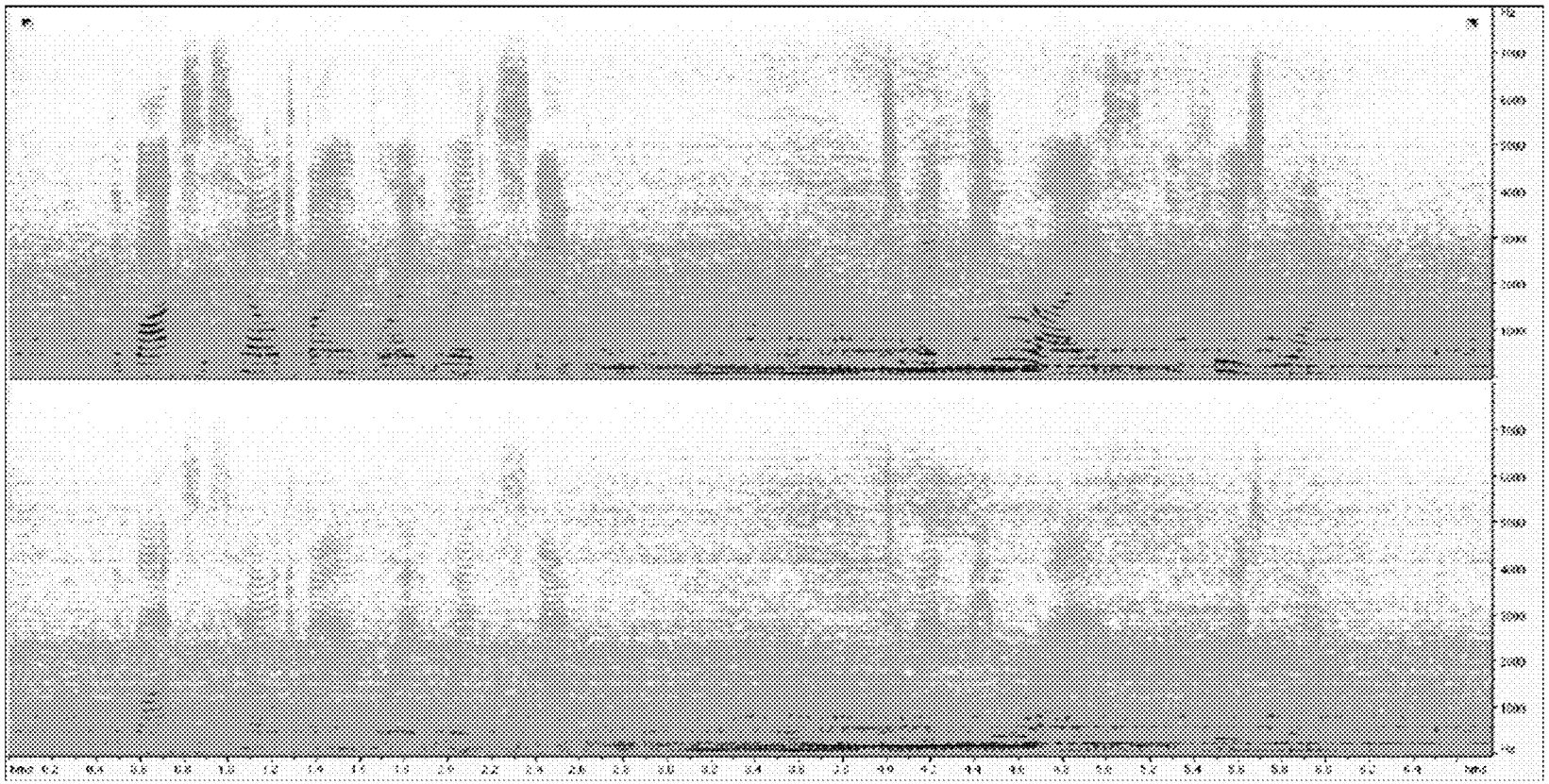
FIG. 20 shows a spectrogram of a second stereo speech recording.
Figure 21:
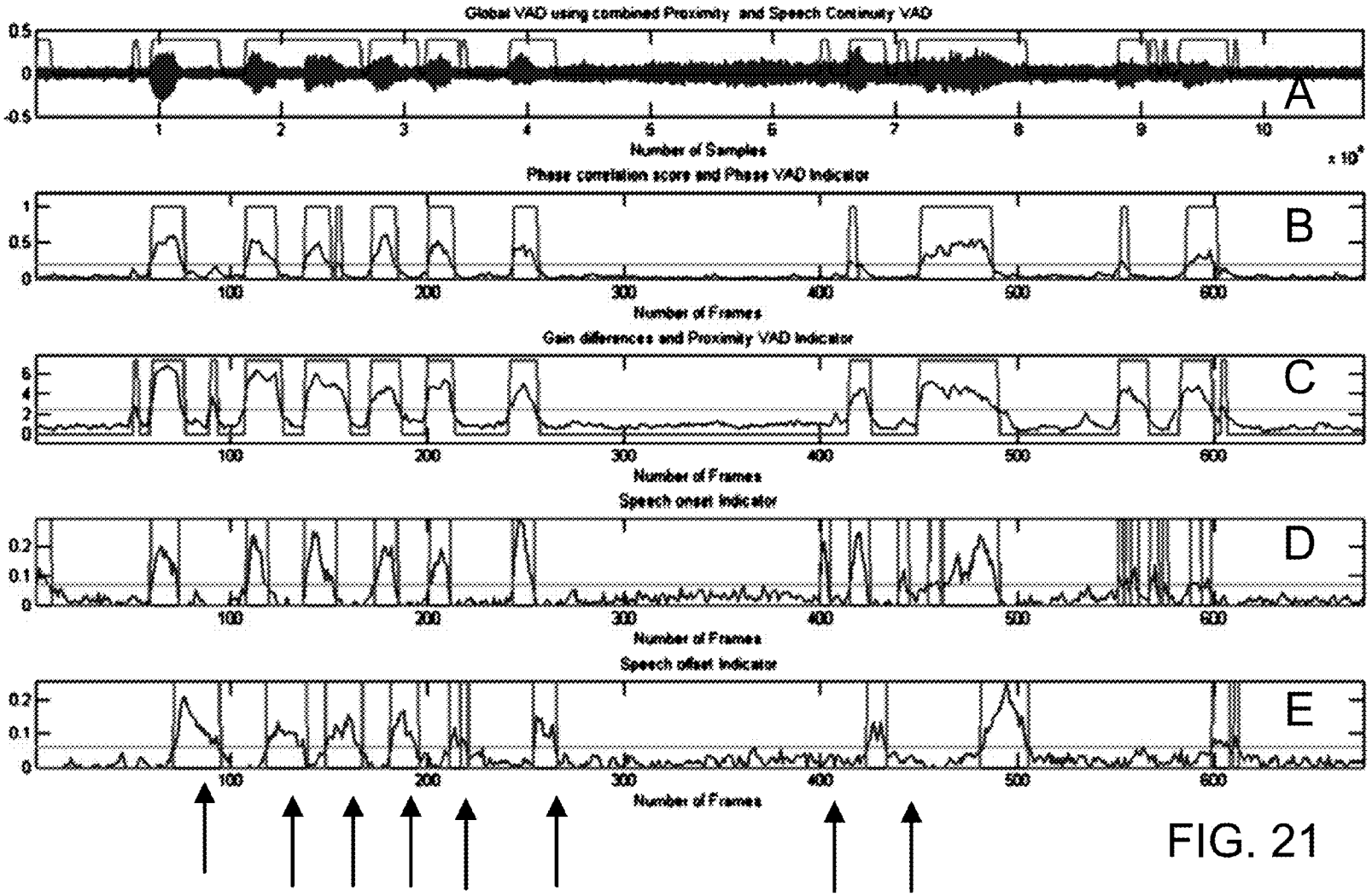
FIGS. 21-23 show analysis results for the recording of FIG. 20.
Figure 22:
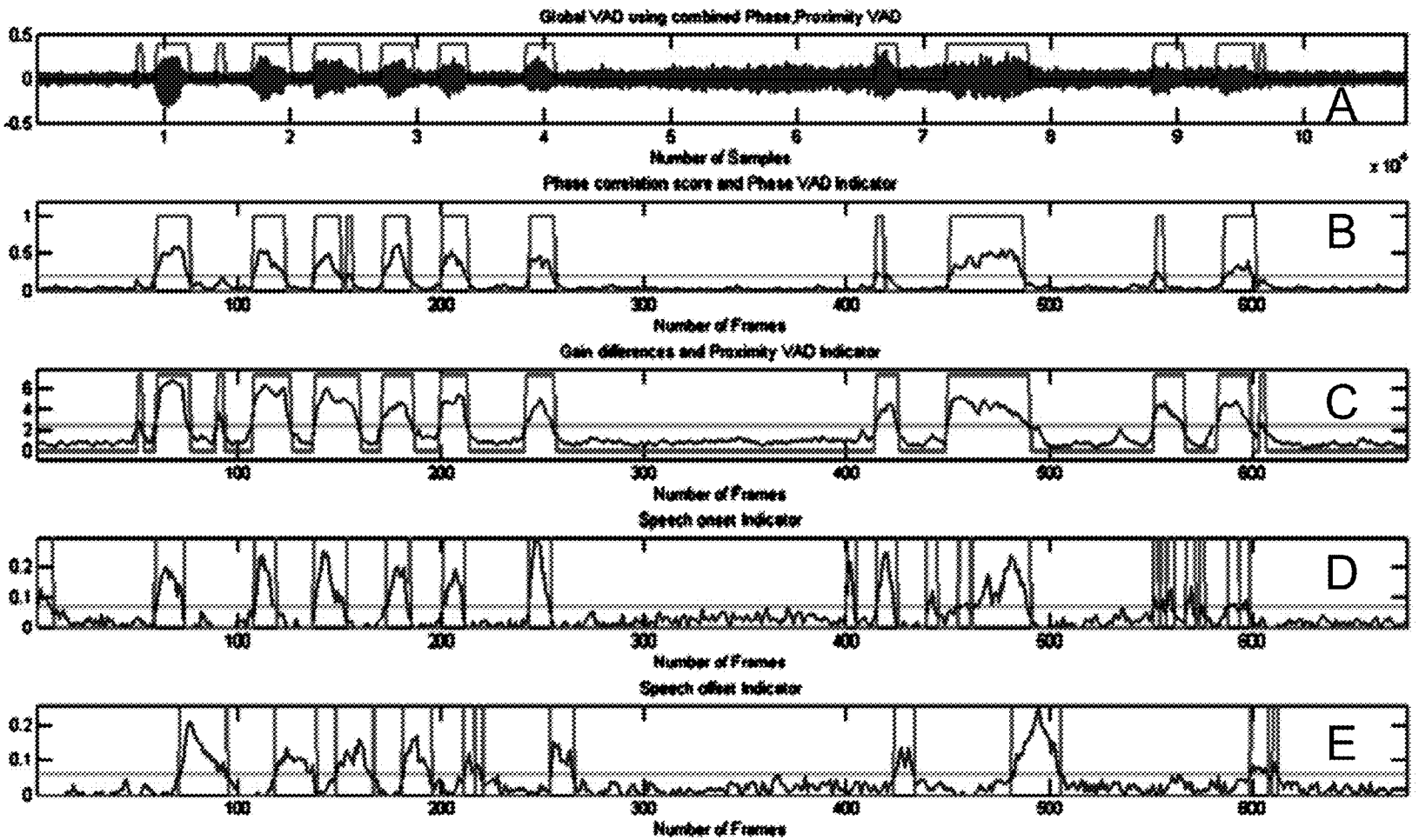
Figure 23:
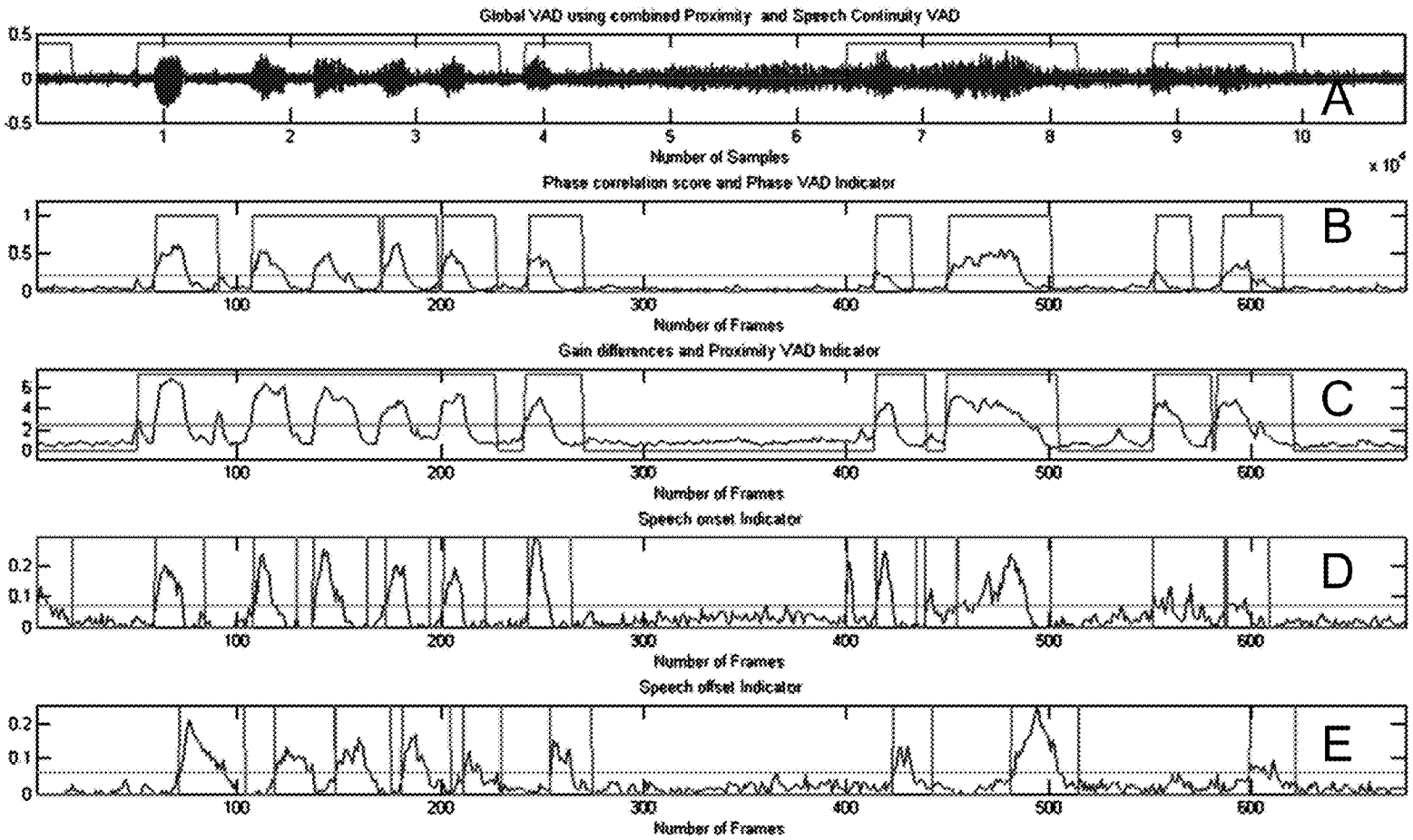

FIG. 20 shows a spectrogram of a multichannel recording of near-field speech that is buried in street noise, and FIGS. 21-23 show examples of different voice detection strategies as applied to the recording of FIG. 20. The top plots of these figures indicate the input signal in the time domain and a binary detection result that is produced by combining two or more of the individual VAD results. Each of the other plots of these figures indicates the time-domain waveforms of the VAD statistics, a threshold value for the corresponding detector (as indicated by the horizontal line in each plot), and the resulting binary detection decisions.

FIG. 21 shows an example of how speech onset and/or offset detection may be used to complement gain-based and phase-based VADs. The group of arrows to the left indicate speech offsets that were detected only by the speech offset VAD, and the group of arrows to the right indicate speech onsets (onset of utterance "to" and "pure" in low SNR) that were detected only by the speech onset VAD.

FIG. 22 illustrates that a combination (plot A) of only phase-based and gain-based VADs with no hangover (plots B and C) frequently misses low-energy speech features that may be detected using onset/offset statistics (plots D and E). Plot A of FIG. 23 illustrates that combining the results from all four of the individual detectors (plots B-E of FIG. 23, with hangovers on all detectors) supports accurate offset detection, allowing the use of a smaller hangover on the gain-based and phase-based VADs, while correctly detecting word onsets as well.

It may be desirable to use the results of a voice activity detection (VAD) operation for noise reduction and/or suppression. In one such example, a VAD signal is applied as a gain control on one or more of the channels (e.g., to attenuate noise frequency components and/or segments). In another such example, a VAD signal is applied to calculate (e.g., update) a noise estimate for a noise reduction operation (e.g., using frequency components or segments that have been classified by the VAD operation as noise) on at least one channel of the multichannel signal that is based on the updated noise estimate. Examples of such a noise reduction operation include a spectral subtraction operation and a Wiener filtering operation. Further examples of post-processing operations (e.g., residual noise suppression, noise estimate combination) that may be used with the VAD strategies disclosed herein are described in U.S. Pat. Appl. No. 61/406,382 (Shin et al., filed Oct. 25, 2010).

The acoustic noise in a typical environment may include babble noise, airport noise, street noise, voices of competing talkers, and/or sounds from interfering sources (e.g., a TV set or radio). Consequently, such noise is typically nonstationary and may have an average spectrum is close to that of the user's own voice. A noise power reference signal as computed from a single microphone signal is usually only an approximate stationary noise estimate. Moreover, such computation generally entails a noise power estimation delay, such that corresponding adjustments of subband gains can only be performed after a significant delay. It may be desirable to obtain a reliable and contemporaneous estimate of the environmental noise.

Examples of noise estimates include a single-channel long-term estimate, based on a single-channel VAD, and a noise reference as produced by a multichannel BSS filter. A single-channel noise reference may be calculated by using (dual-channel) information from the proximity detection operation to classify components and/or segments of a primary microphone channel. Such a noise estimate may be available much more quickly than other approaches, as it does not require a long-term estimate. This single-channel noise reference can also capture nonstationary noise, unlike the long-term-estimate-based approach, which is typically unable to support removal of nonstationary noise. Such a method may provide a fast, accurate, and nonstationary noise reference. The noise reference may be smoothed (e.g., using a first-degree smoother, possibly on each frequency component). The use of proximity detection may enable a device using such a method to reject nearby transients such as the sound of noise of a car passing into the forward lobe of the directional masking function.

A VAD indication as described herein may be used to support calculation of a noise reference signal. When the VAD indication indicates that a frame is noise, for example, the frame may be used to update the noise reference signal (e.g., a spectral profile of the noise component of the primary microphone channel). Such updating may be performed in a frequency domain, for example, by temporally smoothing the frequency component values (e.g., by updating the previous value of each component with the value of the corresponding component of the current noise estimate). In one example, a Wiener filter uses the noise reference signal to perform a noise reduction operation on the primary microphone channel. In another example, a spectral subtraction operation uses the noise reference signal to perform a noise reduction operation on the primary microphone channel (e.g., by subtracting the noise spectrum from the primary microphone channel). When the VAD indication indicates that a frame is not noise, the frame may be used to update a spectral profile of the signal component of the primary microphone channel, which profile may also be used by the Wiener filter to perform the noise reduction operation. The resulting operation may be considered to be a quasi-single-channel noise reduction algorithm that makes use of a dual-channel VAD operation.

An adaptive hangover as described above may be useful in a vocoder context to provide more accurate distinction between speech segments and noise while maintaining a continuous detection result during an interval of speech. In another context, however, it may be desirable to allow a more rapid transition of the VAD result (e.g., to eliminate hangovers) even if such action causes the VAD result to change state within the same interval of speech. In a noise reduction context, for example, it may be desirable to calculate a noise estimate, based on segments that the voice activity detector identifies as noise, and to use the calculated noise estimate to perform a noise reduction operation (e.g., a Wiener filtering or other spectral subtraction operation) on the speech signal. In such case, it may be desirable to configure the detector to obtain a more accurate segmentation (e.g., on a frame-by-frame basis), even if such tuning causes the VAD signal to change state while the user is talking.

An implementation of method M100 may be configured, whether alone or in combination with one or more other VAD techniques, to produce a binary detection result for each segment of the signal (e.g., high or "1" for voice, and low or "0" otherwise). Alternatively, an implementation of method M100 may be configured, whether alone or in combination with one or more other VAD techniques, to produce more than one detection result for each segment. For example, detection of speech onsets and/or offsets may be used to obtain a time-frequency VAD technique that individually characterizes different frequency subbands of the segment, based on the onset and/or offset continuity across that band. In such case, any of the subband division schemes mentioned above (e.g., uniform, Bark scale, Mel scale) may be used, and instances of tasks T500 and T600 may be performed for each subband. For a nonuniform subband division scheme, it may be desirable for each subband instance of task T500 to normalize (e.g., average) the number of activations for the corresponding subband such that, for example, each subband instance of task T600 may use the same threshold (e.g., 0.7 for onset, −0.15 for offset).

Such a subband VAD technique may indicate, for example, that a given segment carries speech in the 500-1000 Hz band, noise in the 1000-1200 Hz band, and speech in the 1200-2000 Hz band. Such results may be applied to increase coding efficiency and/or noise reduction performance. It may also be desirable for such a subband VAD technique to use independent hangover logic (and possibly different hangover intervals) in each of the various subbands. In a subband VAD technique, adaptation of a hangover period as described herein may be performed independently in each of the various subbands. A subband implementation of a combined VAD technique may include combining subband results for each individual detector or, alternatively, may include combining subband results from fewer than all detectors (possibly only one) with segment-level results from the other detectors.

In one example of a phase-based VAD, a directional masking function is applied at each frequency component to determine whether the phase difference at that frequency corresponds to a direction that is within a desired range, and a coherency measure is calculated according to the results of such masking over the frequency range under test and compared to a threshold to obtain a binary VAD indication. Such an approach may include converting the phase difference at each frequency to a frequency-independent indicator of direction, such as direction of arrival or time difference of arrival (e.g., such that a single directional masking function may be used at all frequencies). Alternatively, such an approach may include applying a different respective masking function to the phase difference observed at each frequency.

In another example of a phase-based VAD, a coherency measure is calculated based on the shape of distribution of the directions of arrival of the individual frequency components in the frequency range under test (e.g., how tightly the individual DOAs are grouped together). In either case, it may be desirable to calculate the coherency measure in a phase VAD based only on frequencies that are multiples of a current pitch estimate.

For each frequency component to be examined, for example, the phase-based detector may be configured to estimate the phase as the inverse tangent (also called the arctangent) of the ratio of the imaginary term of the corresponding FFT coefficient to the real term of the FFT coefficient.

It may be desirable to configure a phase-based voice activity detector to determine directional coherence between channels of each pair over a wideband range of frequencies. Such a wideband range may extend, for example, from a low frequency bound of zero, fifty, one hundred, or two hundred Hz to a high frequency bound of three, 3.5, or four kHz (or even higher, such as up to seven or eight kHz or more). However, it may be unnecessary for the detector to calculate phase differences across the entire bandwidth of the signal. For many bands in such a wideband range, for example, phase estimation may be impractical or unnecessary. The practical valuation of phase relationships of a received waveform at very low frequencies typically requires correspondingly large spacings between the transducers. Consequently, the maximum available spacing between microphones may establish a low frequency bound. On the other end, the distance between microphones should not exceed half of the minimum wavelength in order to avoid spatial aliasing. An eight-kilohertz sampling rate, for example, gives a bandwidth from zero to four kilohertz. The wavelength of a four-kHz signal is about 8.5 centimeters, so in this case, the spacing between adjacent microphones should not exceed about four centimeters. The microphone channels may be lowpass filtered in order to remove frequencies that might give rise to spatial aliasing.

It may be desirable to target specific frequency components, or a specific frequency range, across which a speech signal (or other desired signal) may be expected to be directionally coherent. It may be expected that background noise, such as directional noise (e.g., from sources such as automobiles) and/or diffuse noise, will not be directionally coherent over the same range. Speech tends to have low power in the range from four to eight kilohertz, so it may be desirable to forego phase estimation over at least this range. For example, it may be desirable to perform phase estimation and determine directional coherency over a range of from about seven hundred hertz to about two kilohertz.

Accordingly, it may be desirable to configure the detector to calculate phase estimates for fewer than all of the frequency components (e.g., for fewer than all of the frequency samples of an FFT). In one example, the detector calculates phase estimates for the frequency range of 700 Hz to 2000 Hz. For a 128-point FFT of a four-kilohertz-bandwidth signal, the range of 700 to 2000 Hz corresponds roughly to the twenty-three frequency samples from the tenth sample through the thirty-second sample. It may also be desirable to configure the detector to consider only phase differences for frequency components which correspond to multiples of a current pitch estimate for the signal.

A phase-based detector may be configured to evaluate a directional coherence of the channel pair, based on information from the calculated phase differences. The "directional coherence" of a multichannel signal is defined as the degree to which the various frequency components of the signal arrive from the same direction. For an ideally directionally coherent channel pair, the value of $\Delta\phi/f$ is equal to a constant k for all frequencies, where the value of k is related to the direction of arrival $\theta$ and the time delay of arrival $\tau$. The directional coherence of a multichannel signal may be quantified, for example, by rating the estimated direction of arrival for each frequency component (which may also be indicated by a ratio of phase difference and frequency or by a time delay of arrival) according to how well it agrees with a particular direction (e.g., as indicated by a directional masking function), and then combining the rating results for the various frequency components to obtain a coherency measure for the signal.

It may be desirable to produce the coherency measure as a temporally smoothed value (e.g., to calculate the coherency measure using a temporal smoothing function). The contrast of a coherency measure may be expressed as the value of a relation (e.g., the difference or the ratio) between the current value of the coherency measure and an average value of the coherency measure over time (e.g., the mean, mode, or median over the most recent ten, twenty, fifty, or one hundred frames). The average value of a coherency measure may be calculated using a temporal smoothing function. Phase-based VAD techniques, including calculation and application of a measure of directional coherence, are also described in, e.g., U.S. Publ. Pat. Appls. Nos. 2010/0323652 A1 and 2011/038489 A1 (Visser et al.).

A gain-based VAD technique may be configured to indicate presence or absence voice activity in a segment based on differences between corresponding values of a gain measure for each channel. Examples of such a gain measure (which may be calculated in the time domain or in the frequency domain) include total magnitude, average magnitude, RMS amplitude, median magnitude, peak magnitude, total energy, and average energy. It may be desirable to configure the detector to perform a temporal smoothing operation on the gain measures and/or on the calculated differences. As noted above, a gain-based VAD technique may be configured to produce a segment-level result (e.g., over a desired frequency range) or, alternatively, results for each of a plurality of subbands of each segment.

Gain differences between channels may be used for proximity detection, which may support more aggressive near-field/far-field discrimination, such as better frontal noise suppression (e.g., suppression of an interfering speaker in front of the user). Depending on the distance between microphones, a gain difference between balanced microphone channels will typically occur only if the source is within fifty centimeters or one meter.

A gain-based VAD technique may be configured to detect that a segment is from a desired source (e.g., to indicate detection of voice activity) when a difference between the gains of the channels is greater than a threshold value. The threshold value may be determined heuristically, and it may be desirable to use different threshold values depending on one or more factors such as signal-to-noise ratio (SNR), noise floor, etc. (e.g., to use a higher threshold value when the SNR is low). Gain-based VAD techniques are also described in, e.g., U.S. Publ. Pat. Appl. No. 2010/0323652 A1 (Visser et al.).

It is also noted that one or more of the individual detectors in a combined detector may be configured to produce results on a different time scale than another of the individual detectors. For example, a gain-based, phase-based, or onset-offset detector may be configured to produce a VAD indication for each segment of length n, to be combined with results from a gain-based, phase-based, or onset-offset detector that is configured to produce a VAD indication for each segment of length m, when n is less than m.

Voice activity detection (VAD), which discriminates speech-active frames from speech-inactive frames, is an important part of speech enhancement and speech coding. As noted above, examples of single-channel VADs include SNR-based ones, likelihood ratio-based ones, and speech onset/offset-based ones, and examples of dual-channel VAD techniques include phase-difference-based ones and gain-difference-based (also called proximity-based) ones. Although dual-channel VADs are in general more accurate than single-channel techniques, they are typically highly dependent on the microphone gain mismatch and/or the angle at which the user is holding the phone.

Figure 24:
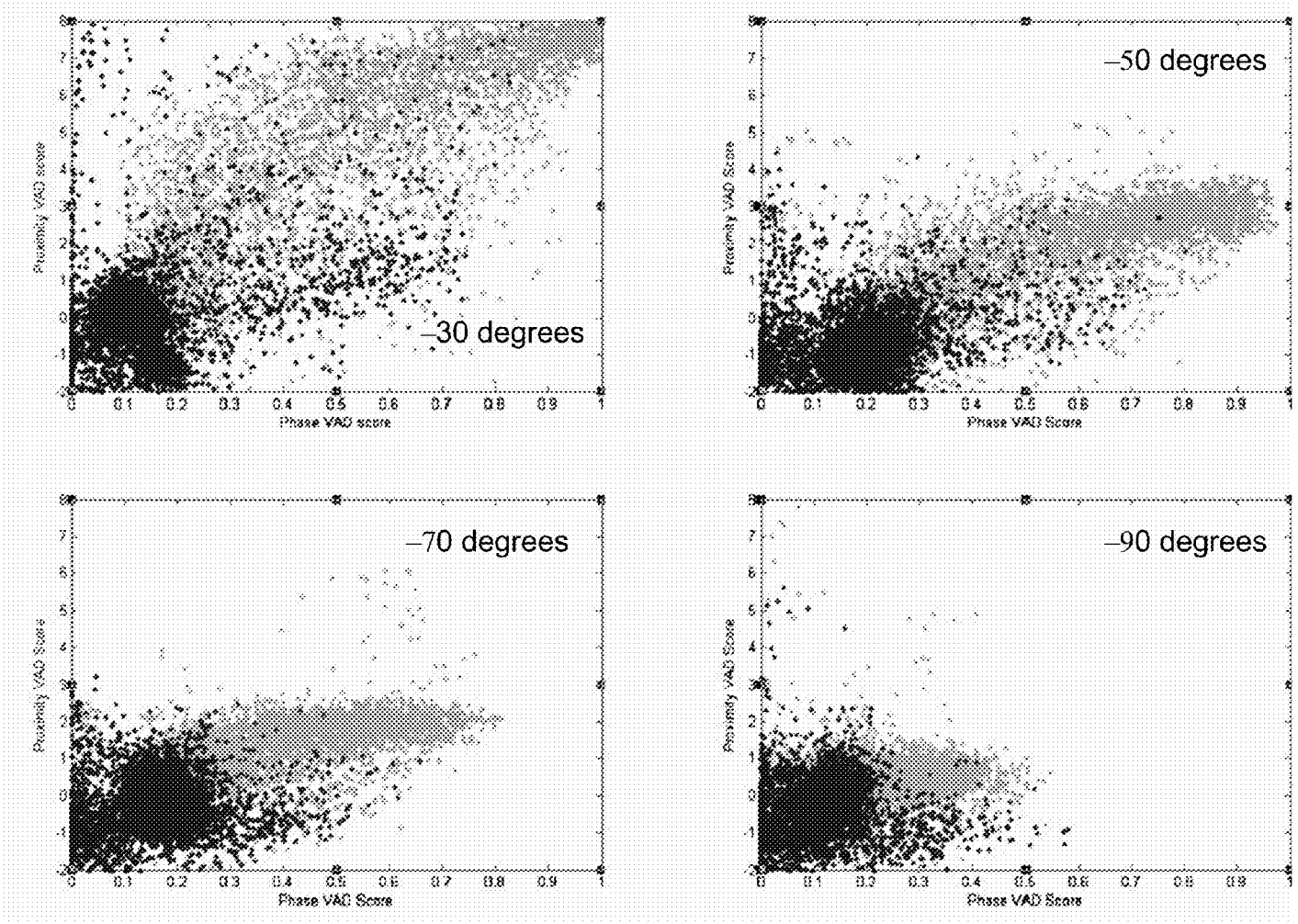
FIG. 24 shows scatter plots for unnormalized phase and proximity VAD test statistics.

FIG. 24 shows scatter plots of proximity-based VAD test statistics vs. phase difference-based VAD test statistics for 6 dB SNR with holding angles of −30, −50, −70, and −90 degrees from the horizontal. In FIGS. 24 and 27-29, the gray dots correspond to speech-active frames, while the black dots correspond to speech-inactive frames. For the phase difference-based VAD, the test statistic used in this example is the average number of frequency bins with the estimated DoA in the range of look direction (also called a phase coherency measure), and for magnitude-difference-based VAD, the test statistic used in this example is the log RMS level difference between the primary and the secondary microphones. FIG. 24 demonstrates why a fixed threshold may not be suitable for different holding angles.

It is not uncommon for a user of a portable audio sensing device (e.g., a headset or handset) to use the device in an orientation with respect to the user's mouth (also called a holding position or holding angle) that is not optimal and/or to vary the holding angle during use of the device. Such variation in holding angle may adversely affect the performance of a VAD stage.

One approach to dealing with a variable holding angle is to detect the holding angle (for example, using direction of arrival (DoA) estimation, which may be based on phase difference or time-difference-of-arrival (TDOA), and/or gain difference between microphones). Another approach to dealing with a variable holding angle that may be used alternatively or additionally is to normalize the VAD test statistics. Such an approach may be implemented to have the effect of making the VAD threshold a function of statistics that are related to the holding angle, without explicitly estimating the holding angle.

For online processing, a minimum statistics-based approach may be utilized. Normalization of the VAD test statistics based on maximum and minimum statistics tracking is proposed to maximize discrimination power even for situations in which the holding angle varies and the gain responses of the microphones are not well-matched.

The minimum-statistics algorithm, previously used for noise power spectrum estimation algorithm, is applied here for minimum and maximum smoothed test-statistic tracking. For maximum test-statistic tracking, the same algorithm is used with the input of (20-test statistic). For example, the maximum test statistic tracking may be derived from the minimum statistic tracking method using the same algorithm, such that it may be desirable to subtract the maximum test statistic from a reference point (e.g., 20 dB). Then the test statistics may be warped to make a minimum smoothed statistic value of zero and a maximum smoothed statistic value of one as follows:

$$\left[s_t = \frac{s_t - s_{min}}{s_{MAX} - S_{min}}\right] \gtrless \xi \tag{N1}$$

where $s_t$ denotes the input test statistic, $s_t$ denotes the normalized test statistic, $s_{min}$ denotes the tracked minimum smoothed test statistic, $s_{MAX}$ denotes the tracked maximum smoothed test statistic, and $\xi$ denotes the original (fixed) threshold. It is noted that the normalized test statistic $s_t'$ may have a value outside of the [0, 1] range due to the smoothing.

It is expressly contemplated and hereby disclosed that the decision rule shown in expression (N1) may be implemented equivalently using the unnormalized test statistic $s_t$ with an adaptive threshold as follows:

$$s_t \gtrless [\xi\square=(s_{MAX}-s_{min})\xi+s_{min}] \tag{N2}$$

where $(s_{MAX}-s_{min})\xi+s_{min}$ denotes an adaptive threshold $\xi\square$ that is equivalent to using a fixed threshold $\xi$ with the normalized test statistic $s_t'$.

Although a phase-difference-based VAD is typically immune to differences in the gain responses of the microphones, a gain-difference-based VAD is typically highly sensitive to such a mismatch. A potential additional benefit of this scheme is that the normalized test statistic $s_t'$ is independent of microphone gain calibration. For example, if the gain response of the secondary microphone is 1 dB higher than normal, then the current test statistic $s_t$, as well as the maximum statistic $s_{MAX}$ and the minimum statistic $s_{min}$, will be 1 dB lower. Therefore, the normalized test statistic $s_t'$ will be the same.

Figure 25:
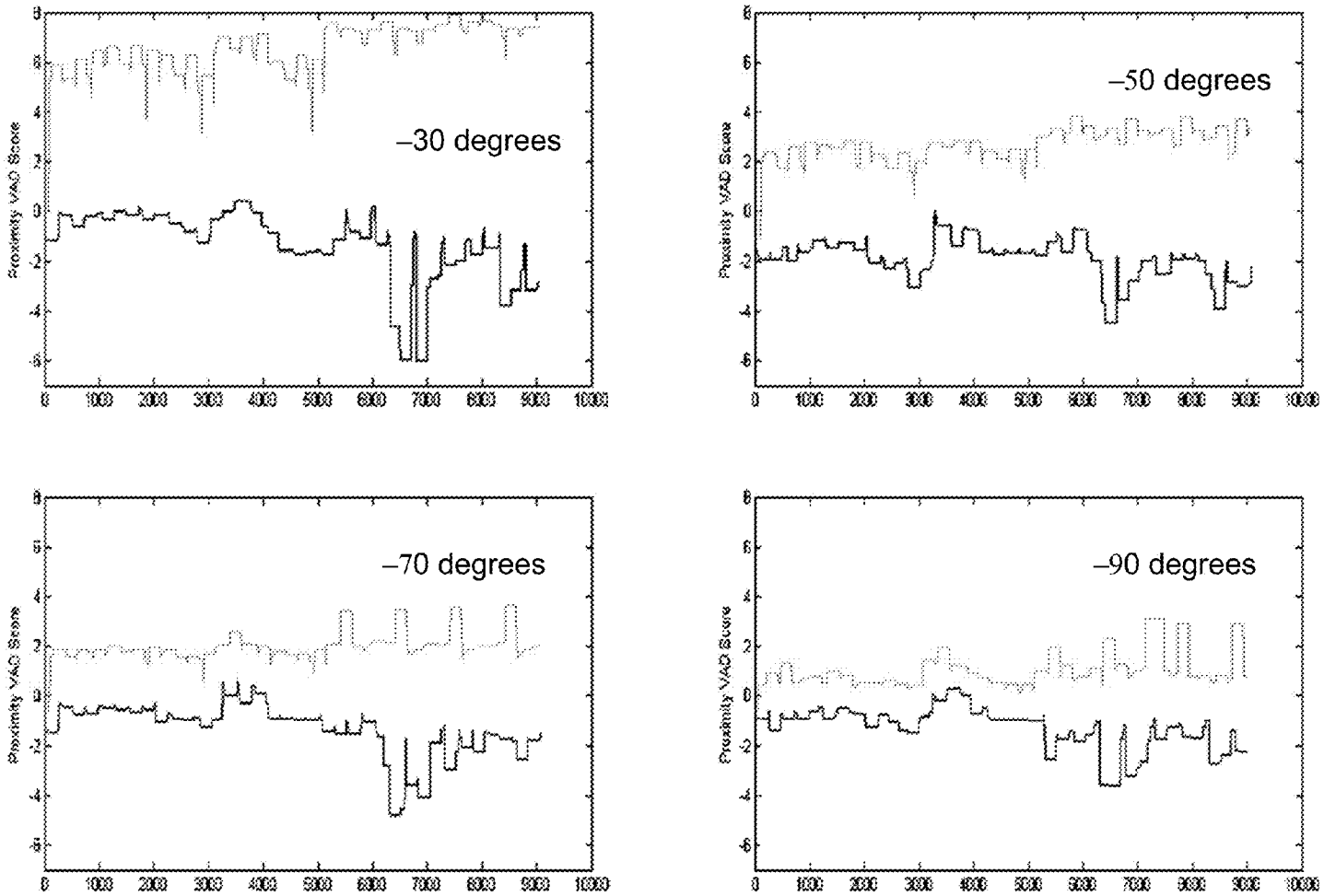
FIG. 25 shows tracked minimum and maximum test statistics for proximity-based VAD test statistics.
Figure 26:
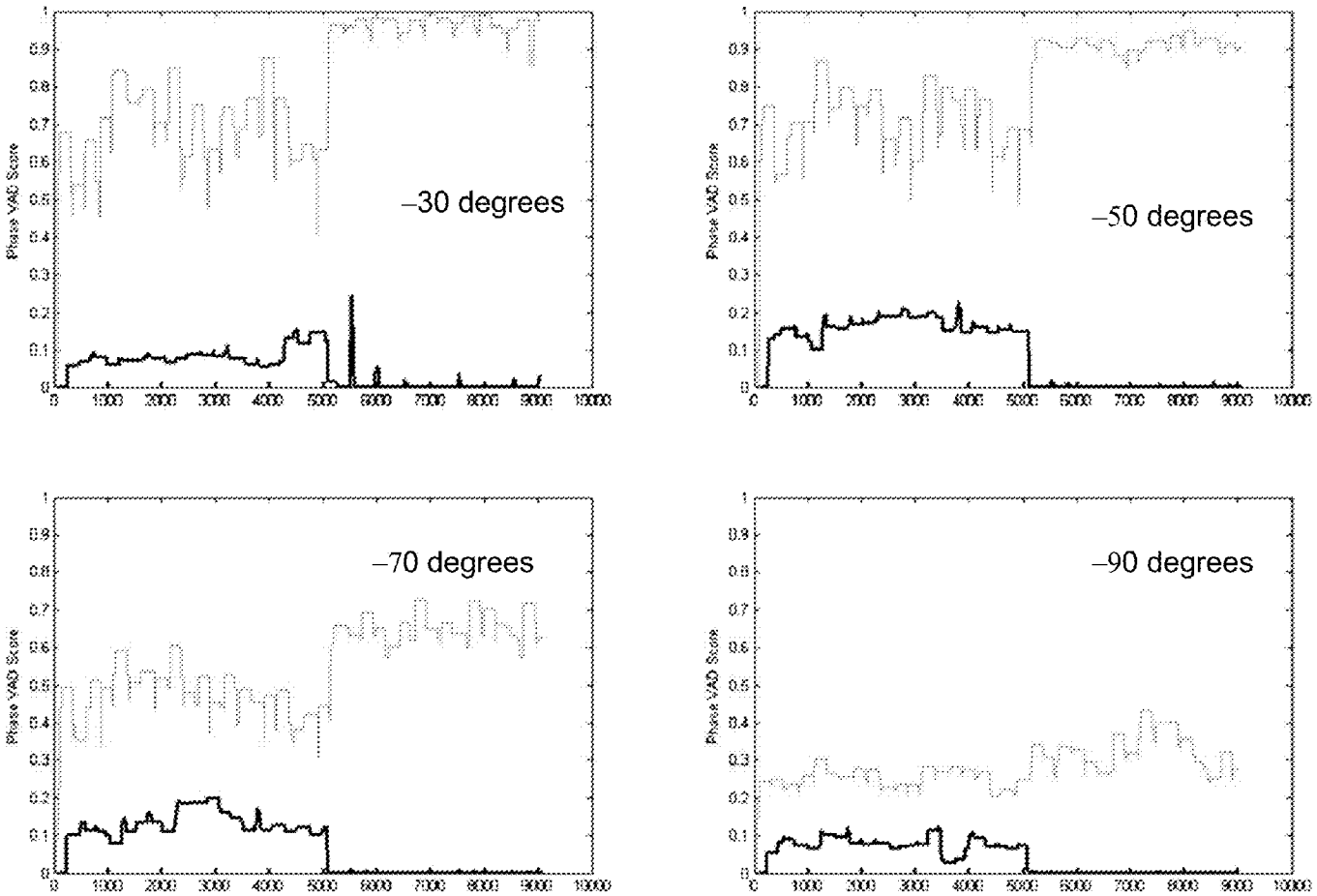
FIG. 26 shows tracked minimum and maximum test statistics for phase-based VAD test statistics.
Figure 27:
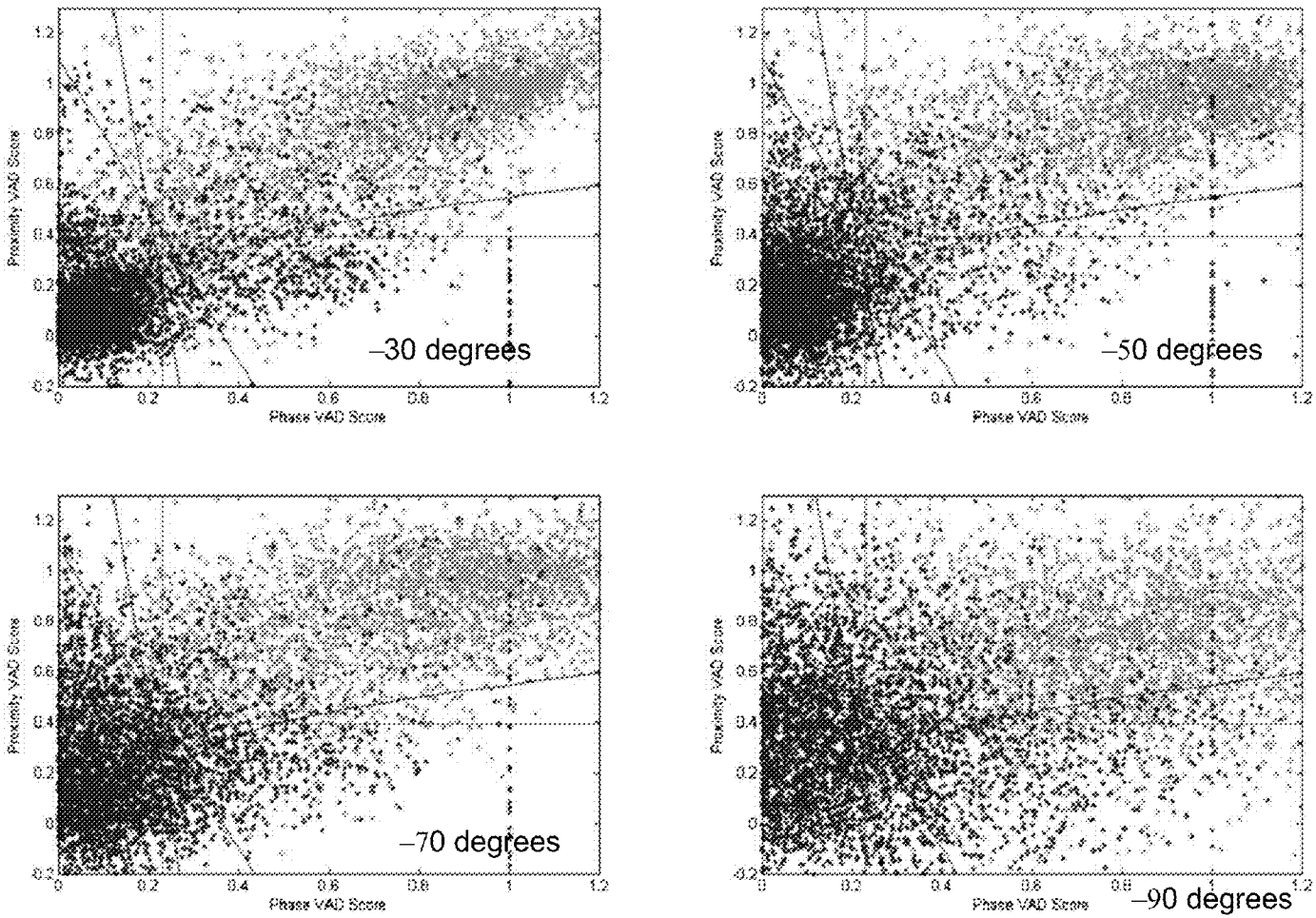
FIG. 27 shows scatter plots for normalized phase and proximity VAD test statistics.

FIG. 25 shows the tracked minimum (black, lower trace) and maximum (gray, upper trace) test statistics for proximity-based VAD test statistics for 6 dB SNR with holding angles of −30, −50, −70, and −90 degrees from the horizontal. FIG. 26 shows the tracked minimum (black, lower trace) and maximum (gray, upper trace) test statistics for phase-based VAD test statistics for 6 dB SNR with holding angles of −30, −50, −70, and −90 degrees from the horizontal. FIG. 27 shows scatter plots for these test statistics normalized according to equation (N1). The two gray lines and the three black lines in each plot indicate possible suggestions for two different VAD thresholds (the right upper side of all the lines with one color is considered to be speech-active frames), which are set to be the same for all four holding angles.

One issue with the normalization in equation (N1) is that although the whole distribution is well-normalized, the normalized score variance for noise-only intervals (black dots) increases relatively for the cases with narrow unnormalized test statistic range. For example, FIG. 27 shows that the cluster of black dots spreads as the holding angle changes from −30 degrees to −90 degrees. This spread may be controlled using a modification such as the following:

$$\left[s_t = \frac{s_t - s_{min}}{(s_{MAX} - S_{min})^{1-\alpha}}\right] \gtrless \xi \tag{N3}$$

or, equivalently, $$s_t \gtrless [\xi\square=(s_{MAX}-s_{min})^{1-\alpha}\xi+s_{min}] \tag{N4}$$

where $0 \le \alpha \le 1$ is a parameter controlling a trade-off between normalizing the score and inhibiting an increase in the variance of the noise statistics. It is noted that the normalized statistic in expression (N3) is also independent of microphone gain variation, since $s_{MAX}-s_{min}$ will be independent of microphone gains.

Figure 28:
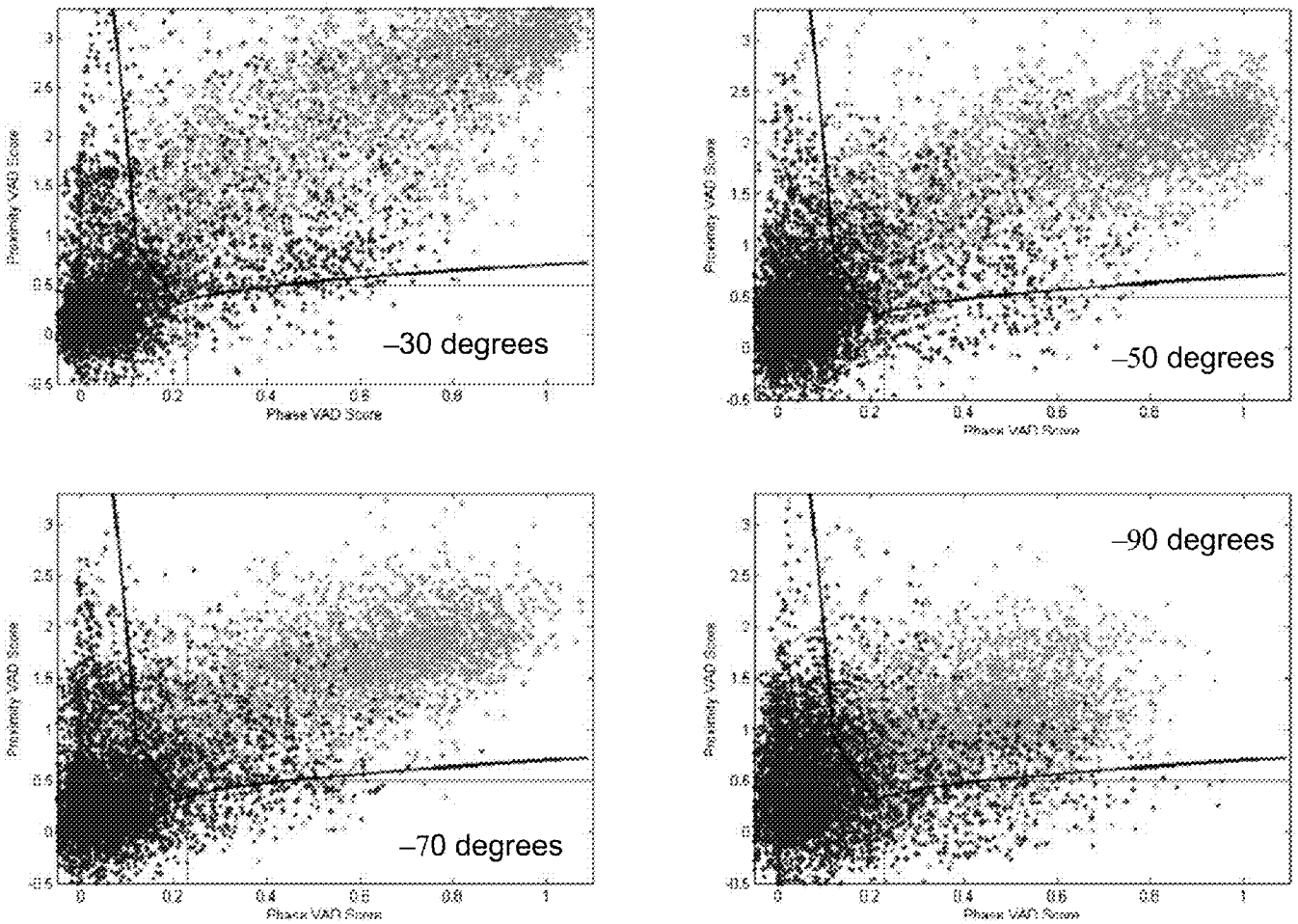
FIG. 28 shows scatter plots for normalized phase and proximity VAD test statistics with alpha=0.5.
Figure 29:
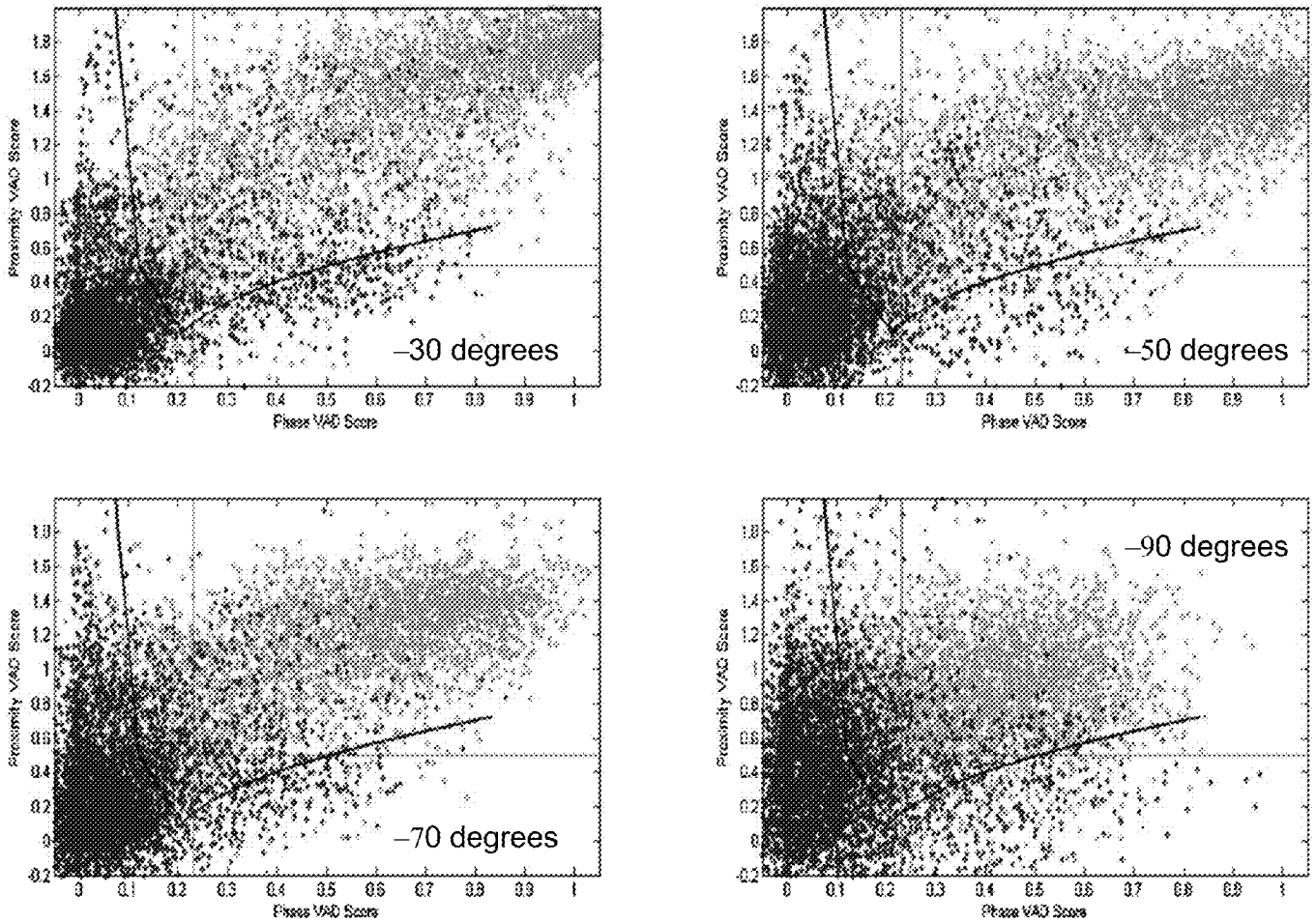
FIG. 29 shows scatter plots for normalized phase and proximity VAD test statistics with alpha=0.5 for phase VAD statistic and alpha=0.25 for proximity VAD statistic.

A value of alpha=0 will lead to FIG. 27. FIG. 28 shows a set of scatter plots resulting from applying a value of alpha=0.5 for both VAD statistics. FIG. 29 shows a set of scatter plots resulting from applying a value of alpha=0.5 for the phase VAD statistic and a value of alpha=0.25 for the proximity VAD statistic. These figures show that using a fixed threshold with such a scheme can result in reasonably robust performance for various holding angles.

Such a test statistic may be normalized (e.g., as in expression (N1) or (N3) above). Alternatively, a threshold value corresponding to the number of frequency bands that are activated (i.e., that show a sharp increase or decrease in energy) may be adapted (e.g., as in expression (N2) or (N4) above).

Additionally or alternatively, the normalization techniques described with reference to expressions (N1)-(N4) may also be used with one or more other VAD statistics (e.g., a low-frequency proximity VAD, onset and/or offset detection). It may be desirable, for example, to configure task T300 to normalize $\Delta E(k,n)$ using such techniques. Normalization may increase robustness of onset/offset detection to signal level and noise nonstationarity.

For onset/offset detection, it may be desirable to track the maximum and minimum of the square of $\Delta E(k,n)$ (e.g., to track only positive values). It may also be desirable to track the maximum as the square of a clipped value of $\Delta E(k,n)$ (e.g., as the square of $\max[0, \Delta E(k,n)]$ for onset and the square of $\min[0, \Delta E(k,n)]$ for offset). While negative values of $\Delta E(k,n)$ for onset and positive values of $\Delta E(k,n)$ for offset may be useful for tracking noise fluctuation in minimum statistic tracking, they may be less useful in maximum statistic tracking. It may be expected that the maximum of onset/offset statistics will decrease slowly and rise rapidly.

In general, the onset and/or offset and combined VAD strategies described herein (e.g., as in the various implementations of methods M100 and M200) may be implemented using one or more portable audio sensing devices that each has an array R100 of two or more microphones configured to receive acoustic signals. Examples of a portable audio sensing device that may be constructed to include such an array and to be used with such a VAD strategy for audio recording and/or voice communications applications include a telephone handset (e.g., a cellular telephone handset); a wired or wireless headset (e.g., a Bluetooth headset); a handheld audio and/or video recorder; a personal media player configured to record audio and/or video content; a personal digital assistant (PDA) or other handheld computing device; and a notebook computer, laptop computer, netbook computer, tablet computer, or other portable computing device. Other examples of audio sensing devices that may be constructed to include instances of array R100 and to be used with such a VAD strategy include set-top boxes and audio- and/or video-conferencing devices.

Figure 38:
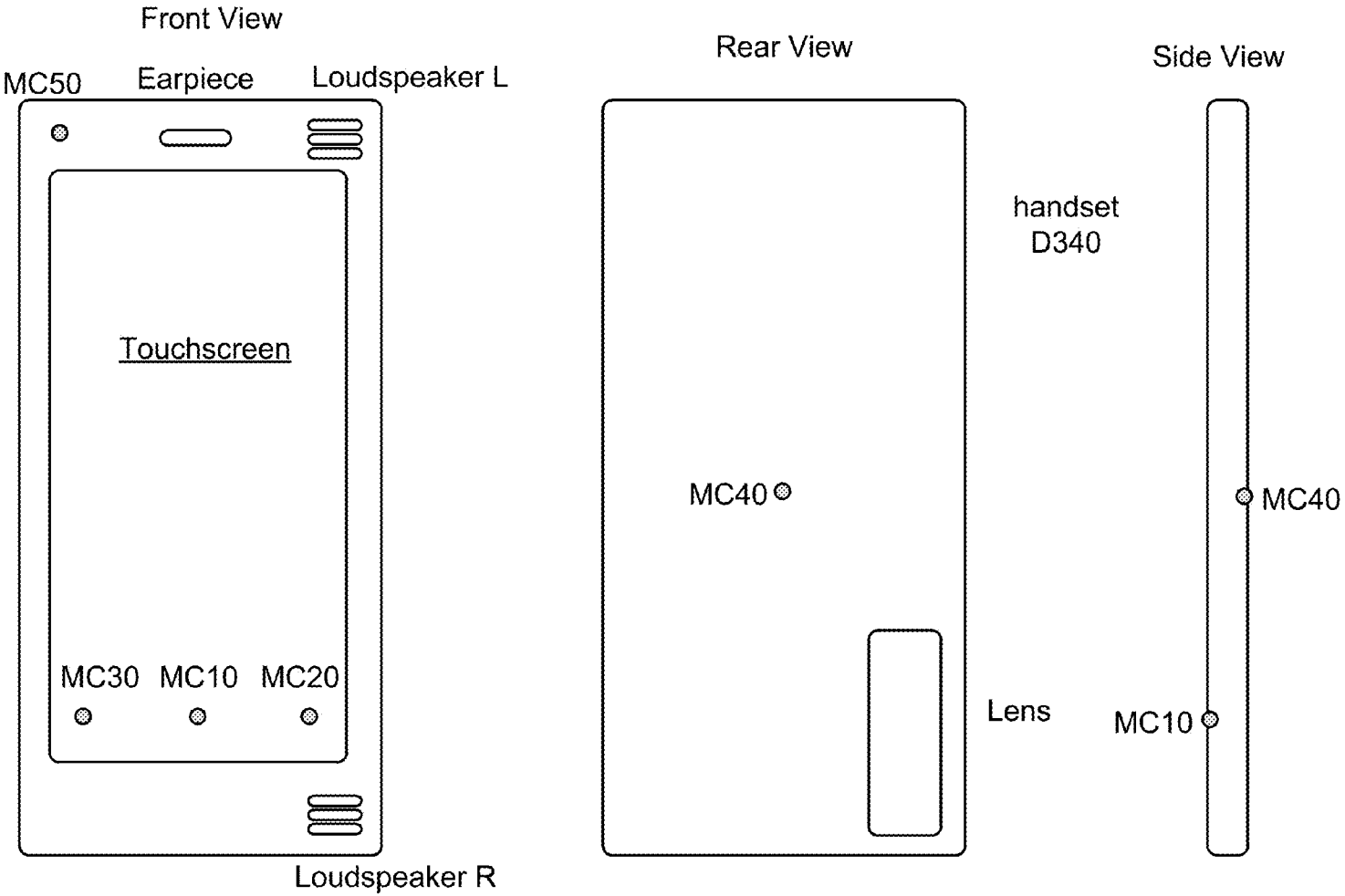
FIG. 38 shows various views of handset D340.
Figure 39:
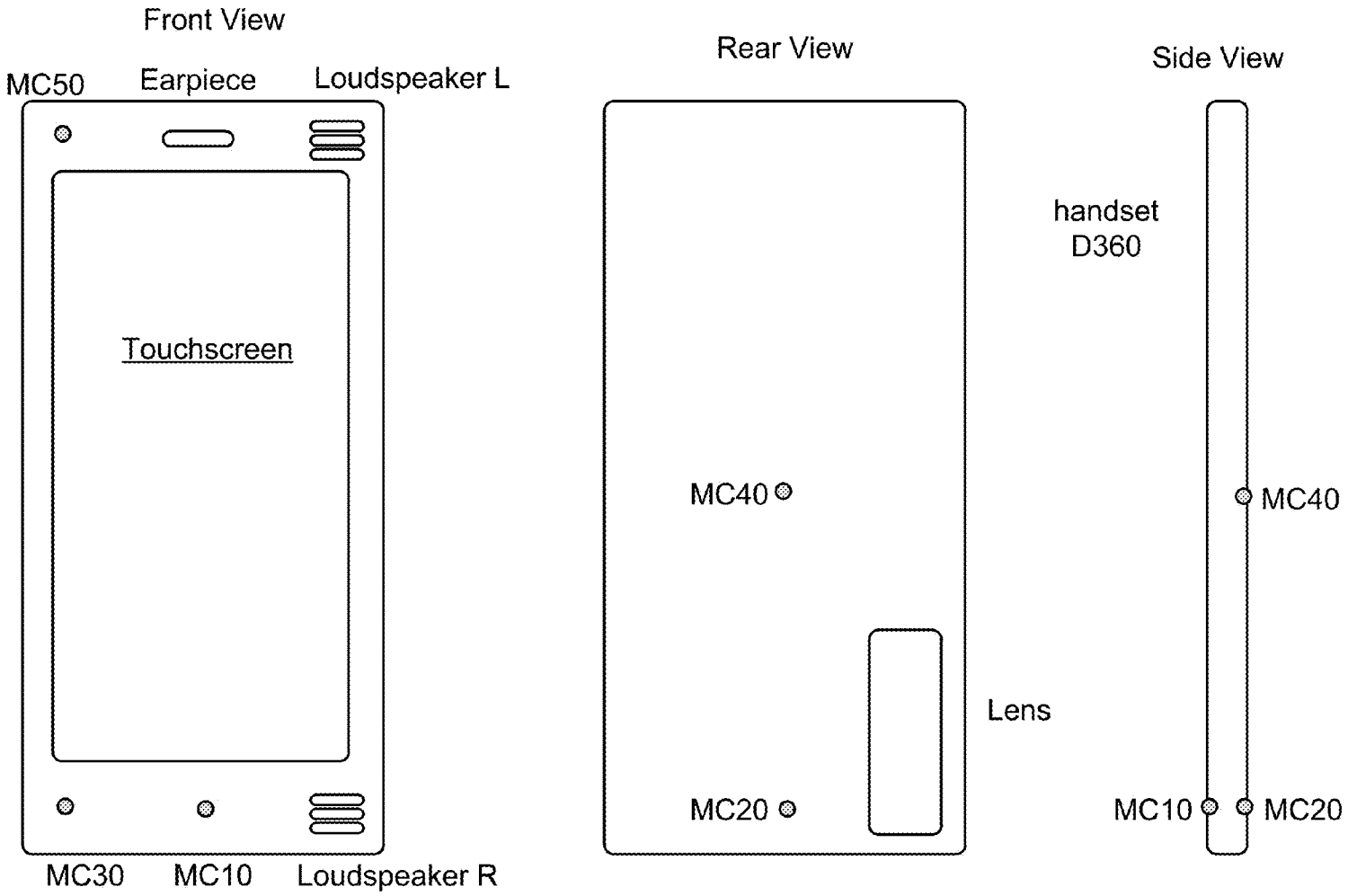
FIG. 39 shows various views of handset D360.

Each microphone of array R100 may have a response that is omnidirectional, bidirectional, or unidirectional (e.g., cardioid). The various types of microphones that may be used in array R100 include (without limitation) piezoelectric microphones, dynamic microphones, and electret microphones. In a device for portable voice communications, such as a handset or headset, the center-to-center spacing between adjacent microphones of array R100 is typically in the range of from about 1.5 cm to about 4.5 cm, although a larger spacing (e.g., up to 10 or 15 cm) is also possible in a device such as a handset or smartphone, and even larger spacings (e.g., up to 20, 25 or 30 cm or more) are possible in a device such as a tablet computer. In a hearing aid, the center-to-center spacing between adjacent microphones of array R100 may be as little as about 4 or 5 mm. The microphones of array R100 may be arranged along a line or, alternatively, such that their centers lie at the vertices of a two-dimensional (e.g., triangular) or three-dimensional shape. In general, however, the microphones of array R100 may be disposed in any configuration deemed suitable for the particular application. FIGS. 38 and 39, for example, each show an example of a five-microphone implementation of array R100 that does not conform to a regular polygon.

During the operation of a multi-microphone audio sensing device as described herein, array R100 produces a multichannel signal in which each channel is based on the response of a corresponding one of the microphones to the acoustic environment. One microphone may receive a particular sound more directly than another microphone, such that the corresponding channels differ from one another to provide collectively a more complete representation of the acoustic environment than can be captured using a single microphone.

Figure 30A:
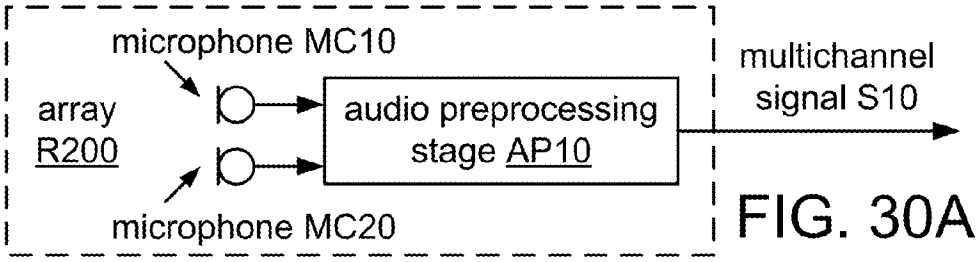
FIG. 30A shows a block diagram of an implementation R200 of array R100.

It may be desirable for array R100 to perform one or more processing operations on the signals produced by the microphones to produce multichannel signal S10. FIG. 30A shows a block diagram of an implementation R200 of array R100 that includes an audio preprocessing stage AP10 configured to perform one or more such operations, which may include (without limitation) impedance matching, analog-to-digital conversion, gain control, and/or filtering in the analog and/or digital domains.

Figure 30B:
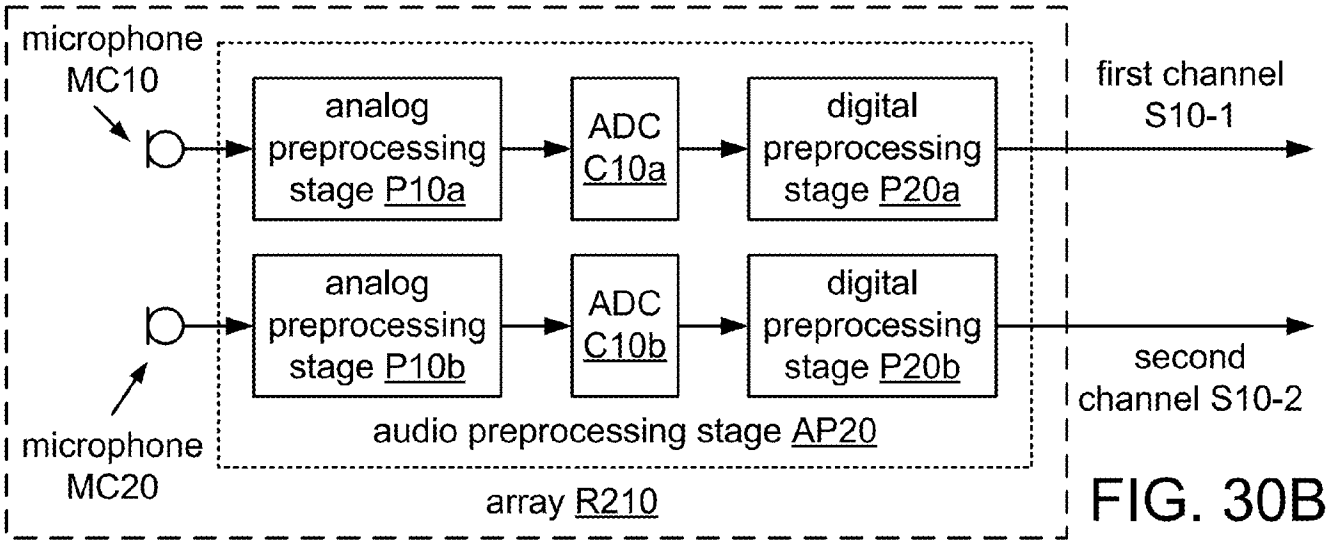
FIG. 30B shows a block diagram of an implementation R210 of array R200.

FIG. 30B shows a block diagram of an implementation R210 of array 8200. Array 8210 includes an implementation AP20 of audio preprocessing stage AP10 that includes analog preprocessing stages P10*a* and P10*b*. In one example, stages P10*a* and P10*b* are each configured to perform a highpass filtering operation (e.g., with a cutoff frequency of 50, 100, or 200 Hz) on the corresponding microphone signal.

It may be desirable for array R100 to produce the multichannel signal as a digital signal, that is to say, as a sequence of samples. Array 8210, for example, includes analog-to-digital converters (ADCs) C10*a* and C10*b* that are each arranged to sample the corresponding analog channel. Typical sampling rates for acoustic applications include 8 kHz, 12 kHz, 16 kHz, and other frequencies in the range of from about 8 to about 16 kHz, although sampling rates as high as about 44 or 192 kHz may also be used. In this particular example, array R210 also includes digital preprocessing stages P20*a* and P20*b* that are each configured to perform one or more preprocessing operations (e.g., echo cancellation, noise reduction, and/or spectral shaping) on the corresponding digitized channel.

It is expressly noted that the microphones of array R100 may be implemented more generally as transducers sensitive to radiations or emissions other than sound. In one such example, the microphones of array R100 are implemented as ultrasonic transducers (e.g., transducers sensitive to acoustic frequencies greater than fifteen, twenty, twenty-five, thirty, forty, or fifty kilohertz or more).

Figure 31A:
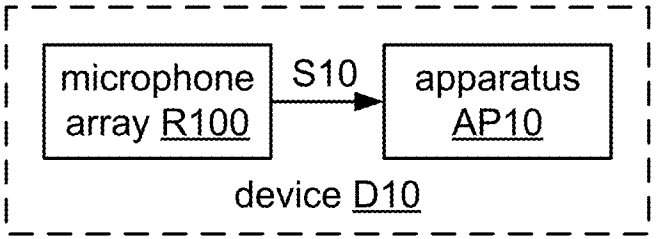
FIG. 31A shows a block diagram of a device D10 according to a general configuration.

FIG. 31A shows a block diagram of a device D10 according to a general configuration. Device D10 includes an instance of any of the implementations of microphone array R100 disclosed herein, and any of the audio sensing devices disclosed herein may be implemented as an instance of device D10. Device D10 also includes an instance of an implementation of an apparatus AP10 (e.g., an instance of apparatus A100, MF100, A200, MF200, or any other apparatus that is configured to perform an instance of any of the implementations of method M100 or M200 disclosed herein) that is configured to process a multichannel signal S10 as produced by array R100. Apparatus AP10 may be implemented in hardware and/or in a combination of hardware with software and/or firmware. For example, apparatus AP10 may be implemented on a processor of device D10, which may also be configured to perform one or more other operations (e.g., vocoding) on one or more channels of signal S10.

Figure 31B:
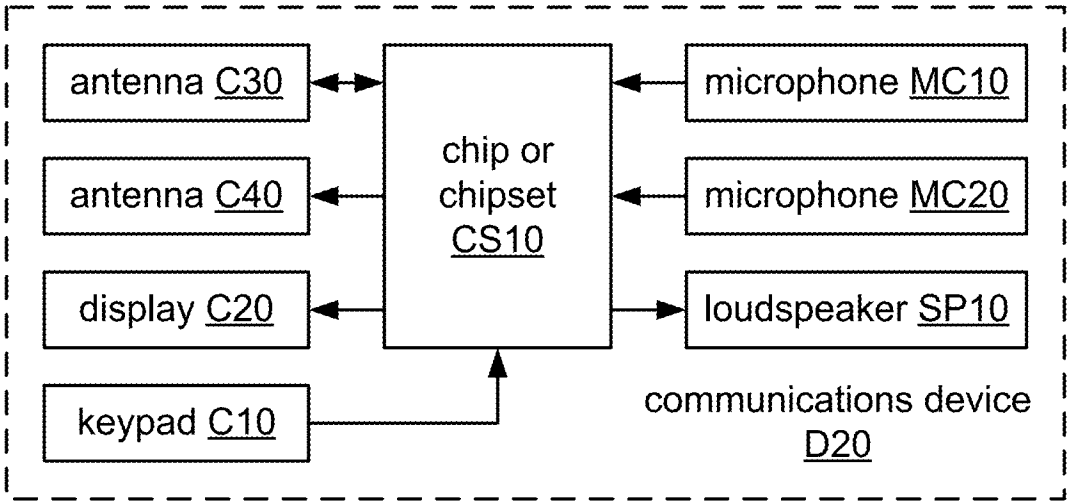
FIG. 31B shows a block diagram of a communications device D20 that is an implementation of device D10.

FIG. 31B shows a block diagram of a communications device D20 that is an implementation of device D10. Any of the portable audio sensing devices described herein may be implemented as an instance of device D20, which includes a chip or chipset CS10 (e.g., a mobile station modem (MSM) chipset) that includes apparatus AP10. Chip/chipset CS10 may include one or more processors, which may be configured to execute a software and/or firmware part of apparatus AP10 (e.g., as instructions). Chip/chipset CS10 may also include processing elements of array R100 (e.g., elements of audio preprocessing stage AP10). Chip/chipset CS10 includes a receiver, which is configured to receive a radio-frequency (RF) communications signal and to decode and reproduce an audio signal encoded within the RF signal, and a transmitter, which is configured to encode an audio signal that is based on a processed signal produced by apparatus AP10 and to transmit an RF communications signal that describes the encoded audio signal. For example, one or more processors of chip/chipset CS10 may be configured to perform a noise reduction operation as described above on one or more channels of the multichannel signal such that the encoded audio signal is based on the noise-reduced signal.

Device D20 is configured to receive and transmit the RF communications signals via an antenna C30. Device D20 may also include a diplexer and one or more power amplifiers in the path to antenna C30. Chip/chipset CS10 is also configured to receive user input via keypad C10 and to display information via display C20. In this example, device D20 also includes one or more antennas C40 to support Global Positioning System (GPS) location services and/or short-range communications with an external device such as a wireless (e.g., Bluetooth™) headset. In another example, such a communications device is itself a Bluetooth headset and lacks keypad C10, display C20, and antenna C30.

Figure 32B:
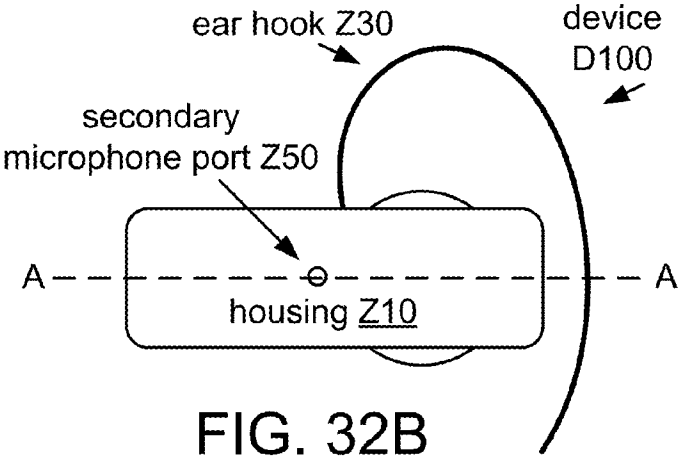
FIGS. 32A to 32D show various views of a headset D100.
Figure 32A:
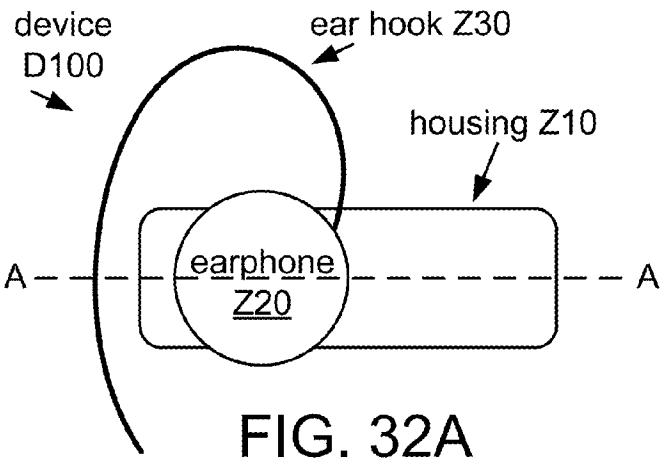
Figure 32D:
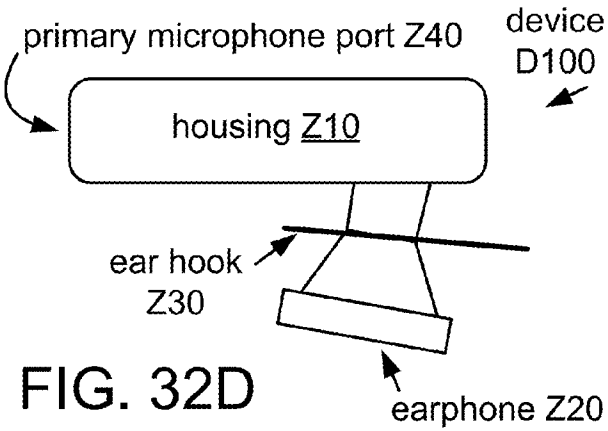

FIGS. 32A to 32D show various views of a portable multi-microphone implementation D100 of audio sensing device D10. Device D100 is a wireless headset that includes a housing Z10 which carries a two-microphone implementation of array R100 and an earphone Z20 that extends from the housing. Such a device may be configured to support half- or full-duplex telephony via communication with a telephone device such as a cellular telephone handset (e.g., using a version of the Bluetooth™ protocol as promulgated by the Bluetooth Special Interest Group, Inc., Bellevue, Wash.). In general, the housing of a headset may be rectangular or otherwise elongated as shown in FIGS. 32A, 32B, and 32D (e.g., shaped like a miniboom) or may be more rounded or even circular. The housing may also enclose a battery and a processor and/or other processing circuitry (e.g., a printed circuit board and components mounted thereon) and may include an electrical port (e.g., a mini-Universal Serial Bus (USB) or other port for battery charging) and user interface features such as one or more button switches and/or LEDs. Typically the length of the housing along its major axis is in the range of from one to three inches.

Figure 32C:
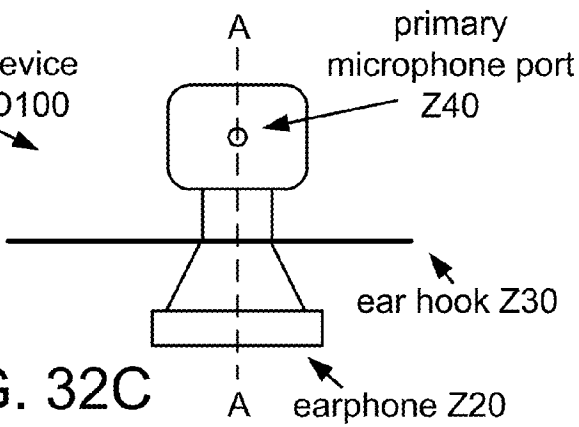

Typically each microphone of array R100 is mounted within the device behind one or more small holes in the housing that serve as an acoustic port. FIGS. 32B to 32D show the locations of the acoustic port Z40 for the primary microphone of the array of device D100 and the acoustic port Z50 for the secondary microphone of the array of device D100.

A headset may also include a securing device, such as ear hook Z30, which is typically detachable from the headset. An external ear hook may be reversible, for example, to allow the user to configure the headset for use on either ear. Alternatively, the earphone of a headset may be designed as an internal securing device (e.g., an earplug) which may include a removable earpiece to allow different users to use an earpiece of different size (e.g., diameter) for better fit to the outer portion of the particular user's ear canal.

Figure 33:
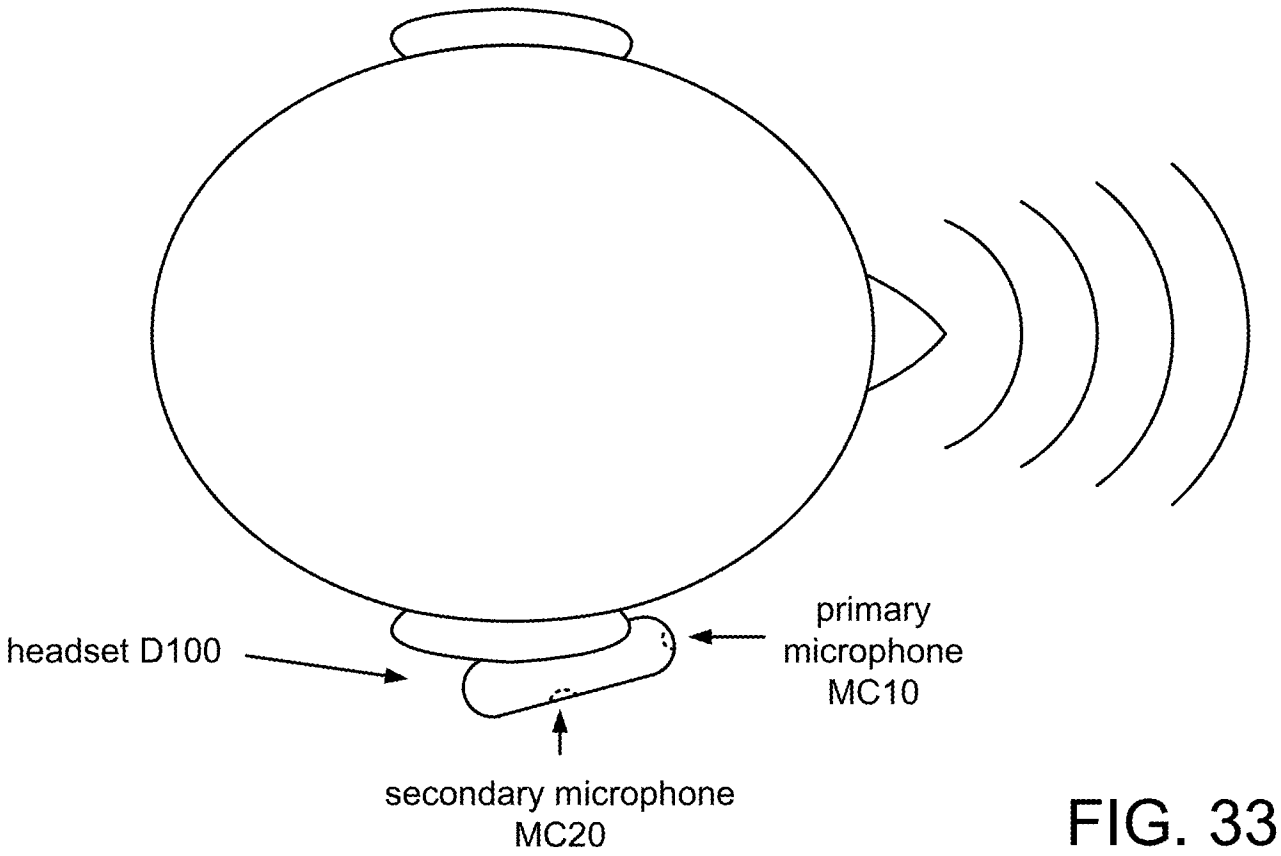
FIG. 33 shows a top view of an example of headset D100 in use.
Figure 34:
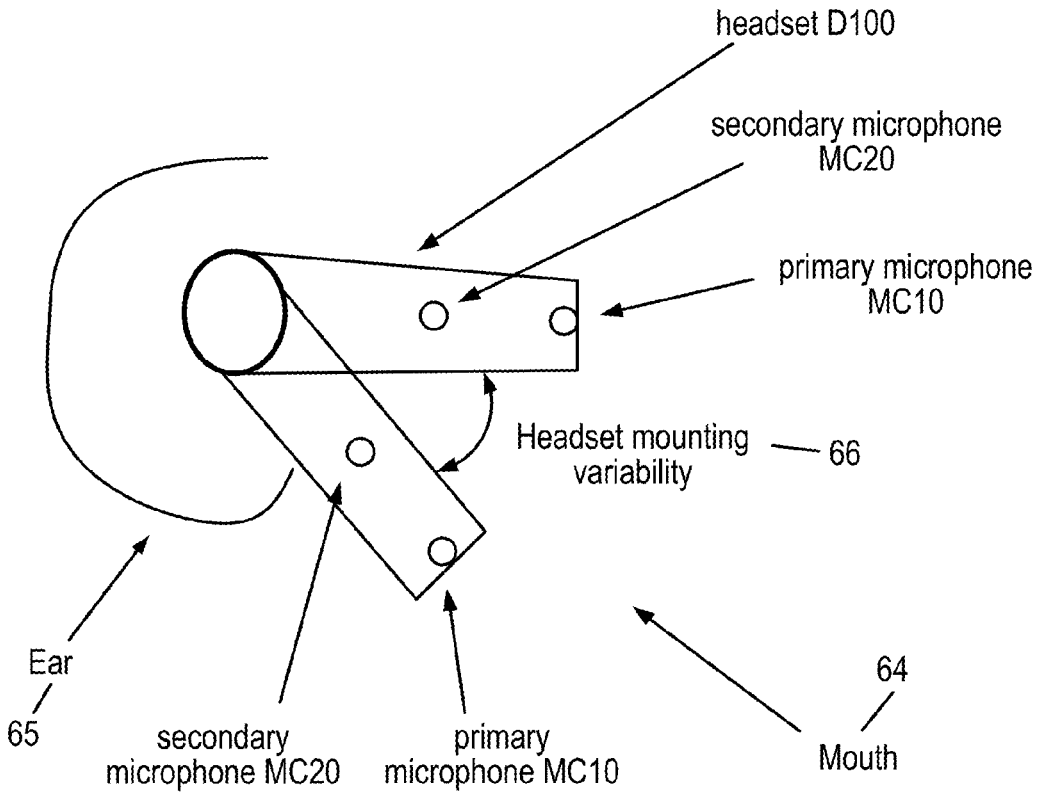
FIG. 34 shows a side view of various standard orientations of device D100 in use.
Figure 35A:
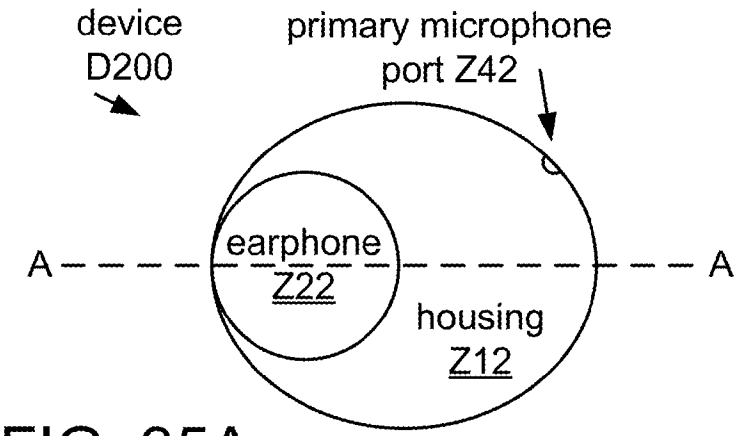
FIGS. 35A to 35D show various views of a headset D200.
Figure 35B:
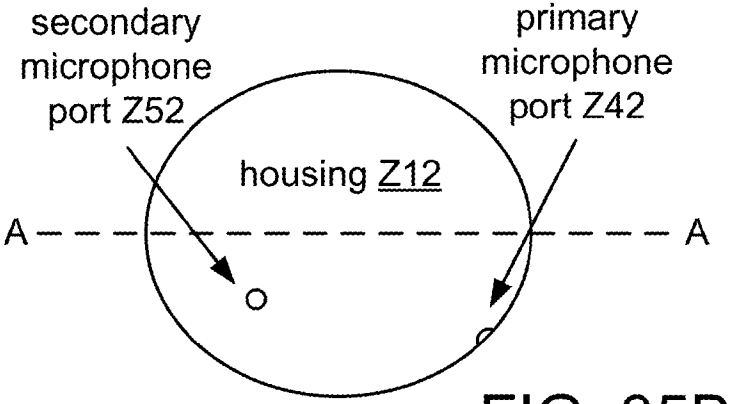
Figure 35C:
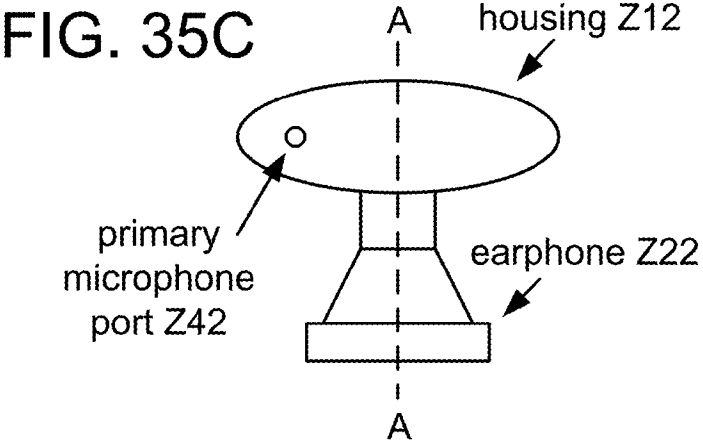
Figure 35D:
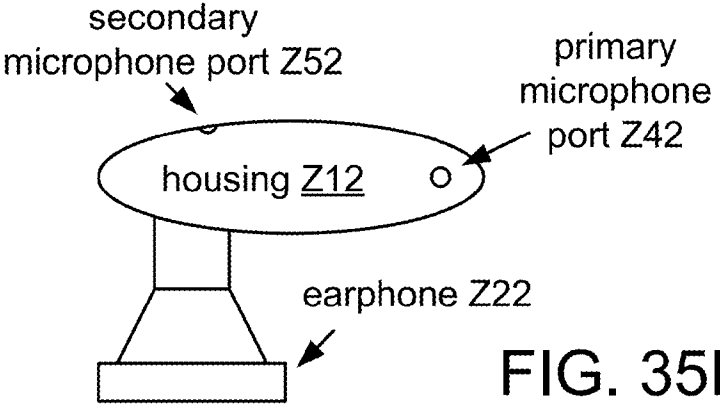

FIG. 33 shows a top view of an example of such a device (a wireless headset D100) in use. FIG. 34 shows a side view of various standard orientations of device D100 in use.

FIGS. 35A to 35D show various views of an implementation D200 of multi-microphone portable audio sensing device D10 that is another example of a wireless headset. Device D200 includes a rounded, elliptical housing Z12 and an earphone Z22 that may be configured as an earplug. FIGS. 35A to 35D also show the locations of the acoustic port Z42 for the primary microphone and the acoustic port Z52 for the secondary microphone of the array of device D200. It is possible that secondary microphone port Z52 may be at least partially occluded (e.g., by a user interface button).

Figure 36A:
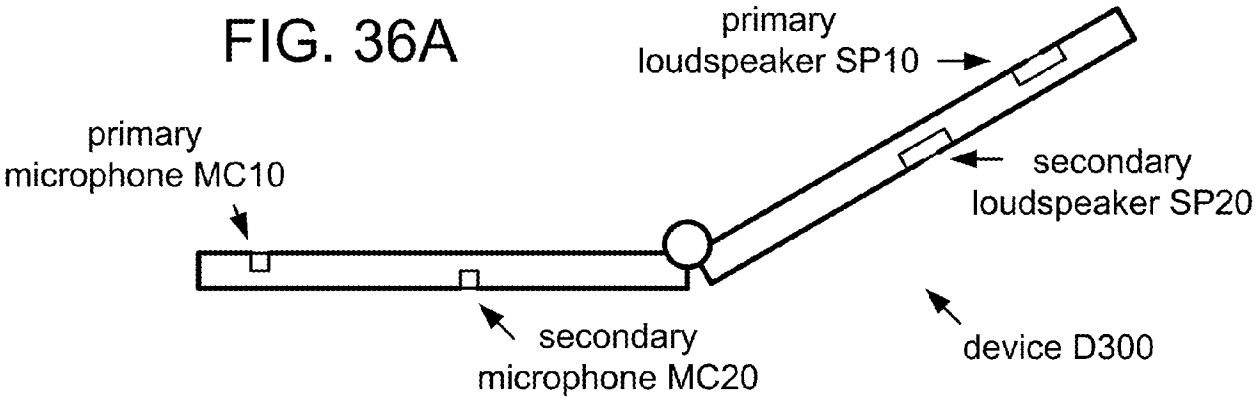
FIG. 36A shows a cross-sectional view of handset D300.

FIG. 36A shows a cross-sectional view (along a central axis) of a portable multi-microphone implementation D300 of device D10 that is a communications handset. Device D300 includes an implementation of array R100 having a primary microphone MC10 and a secondary microphone MC20. In this example, device D300 also includes a primary loudspeaker SP10 and a secondary loudspeaker SP20. Such a device may be configured to transmit and receive voice communications data wirelessly via one or more encoding and decoding schemes (also called "codecs"). Examples of such codecs include the Enhanced Variable Rate Codec, as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems," January 2004 (available online at www-dot-3gpp-dot-org); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004). In the example of FIG. 36A, handset D300 is a clamshell-type cellular telephone handset (also called a "flip" handset). Other configurations of such a multi-microphone communications handset include bar-type and slider-type telephone handsets.

Figure 36B:
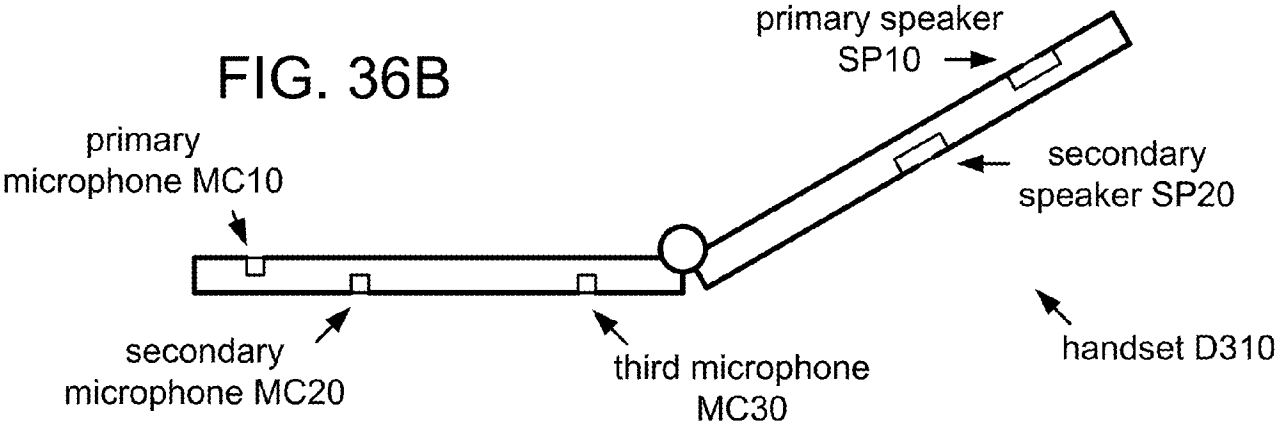
FIG. 36B shows a cross-sectional view of an implementation D310 of handset D300.
Figure 37:
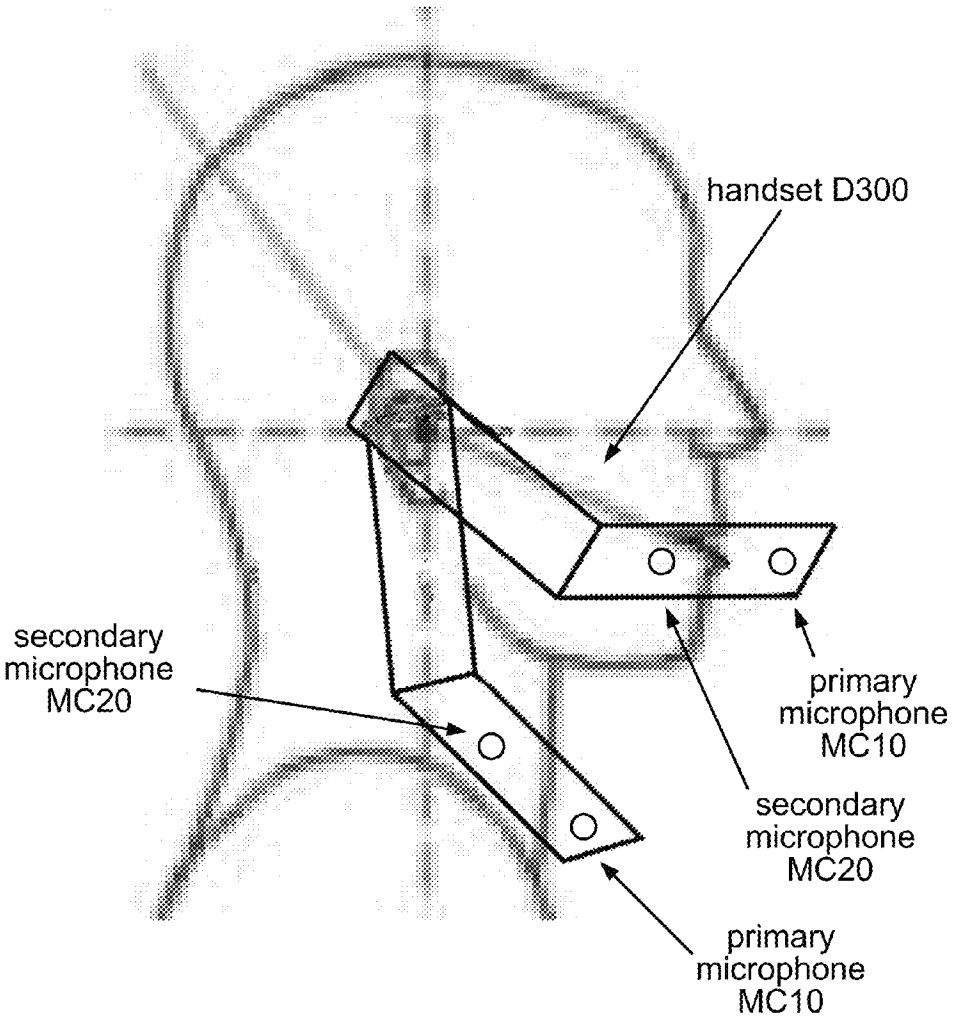
FIG. 37 shows a side view of various standard orientations of handset D300 in use.

FIG. 37 shows a side view of various standard orientations of device D300 in use. FIG. 36B shows a cross-sectional view of an implementation D310 of device D300 that includes a three-microphone implementation of array R100 that includes a third microphone MC30. FIGS. 38 and 39 show various views of other handset implementations D340 and D360, respectively, of device D10.

Figure 40A:
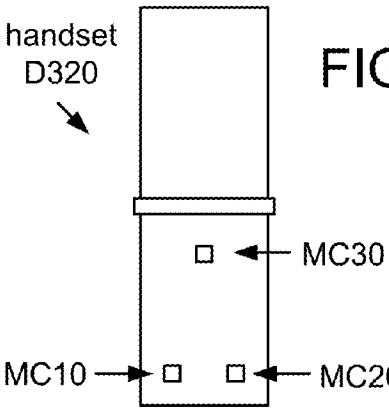
FIGS. 40A-B show views of handset D320.
Figure 40B:
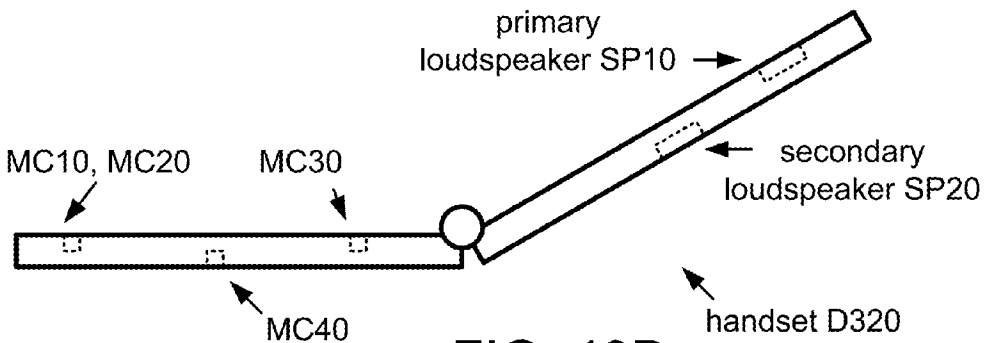

In an example of a four-microphone instance of array R100, the microphones are arranged in a roughly tetrahedral configuration such that one microphone is positioned behind (e.g., about one centimeter behind) a triangle whose vertices are defined by the positions of the other three microphones, which are spaced about three centimeters apart. Potential applications for such an array include a handset operating in a speakerphone mode, for which the expected distance between the speaker's mouth and the array is about twenty to thirty centimeters. FIG. 40A shows a front view of a handset implementation D320 of device D10 that includes such an implementation of array R100 in which four microphones MC10, MC20, MC30, MC40 are arranged in a roughly tetrahedral configuration. FIG. 40B shows a side view of handset D320 that shows the positions of microphones MC10, MC20, MC30, and MC40 within the handset.

Figure 40C:
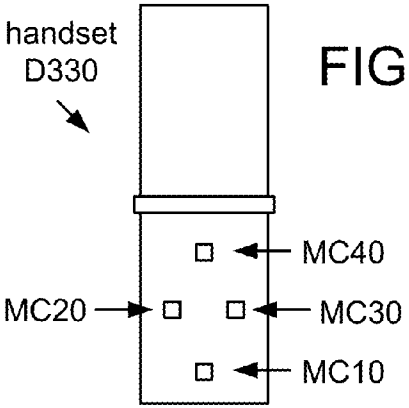
FIGS. 40C-D show views of handset D330.
Figure 40D:
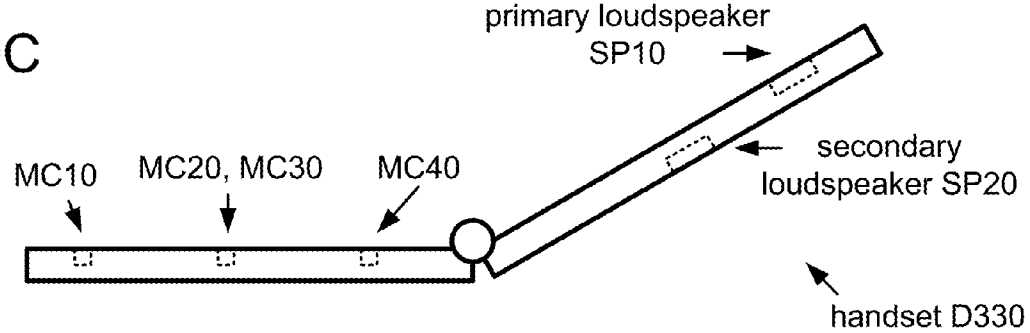

Another example of a four-microphone instance of array R100 for a handset application includes three microphones at the front face of the handset (e.g., near the 1, 7, and 9 positions of the keypad) and one microphone at the back face (e.g., behind the 7 or 9 position of the keypad). FIG. 40C shows a front view of a handset implementation D330 of device D10 that includes such an implementation of array R100 in which four microphones MC10, MC20, MC30, MC40 are arranged in a "star" configuration. FIG. 40D shows a side view of handset D330 that shows the positions of microphones MC10, MC20, MC30, and MC40 within the handset. Other examples of portable audio sensing devices that may be used to perform a onset/offset and/or combined VAD strategy as described herein include touchscreen implementations of handset D320 and D330 (e.g., as flat, non-folding slabs, such as the iPhone (Apple Inc., Cupertino, Calif.), HD2 (HTC, Taiwan, ROC) or CLIQ (Motorola, Inc., Schaumberg, Ill.)) in which the microphones are arranged in similar fashion at the periphery of the touchscreen.

FIGS. 41A-C show additional examples of portable audio sensing devices that may be implemented to include an instance of array R100 and used with a VAD strategy as disclosed herein. In each of these examples, the microphones of array R100 are indicated by open circles. FIG. 41A shows eyeglasses (e.g., prescription glasses, sunglasses, or safety glasses) having at least one front-oriented microphone pair, with one microphone of the pair on a temple and the other on the temple or the corresponding end piece. FIG. 41B shows a helmet in which array R100 includes one or more microphone pairs (in this example, a pair at the mouth and a pair at each side of the user's head). FIG. 41C shows goggles (e.g., ski goggles) including at least one microphone pair (in this example, front and side pairs).

Additional placement examples for a portable audio sensing device having one or more microphones to be used with a switching strategy as disclosed herein include but are not limited to the following: visor or brim of a cap or hat; lapel, breast pocket, shoulder, upper arm (i.e., between shoulder and elbow), lower arm (i.e., between elbow and wrist), wristband or wristwatch. One or more microphones used in the strategy may reside on a handheld device such as a camera or camcorder.

Figure 42C:
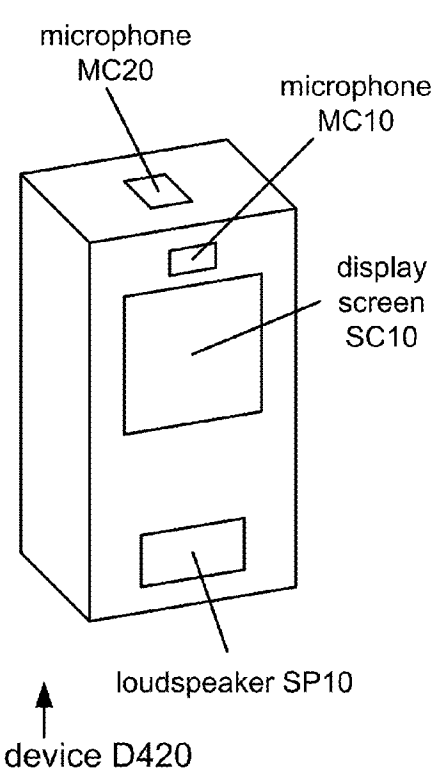
FIG. 42C shows a diagram of an implementation D420 of player D400.
Figure 42B:
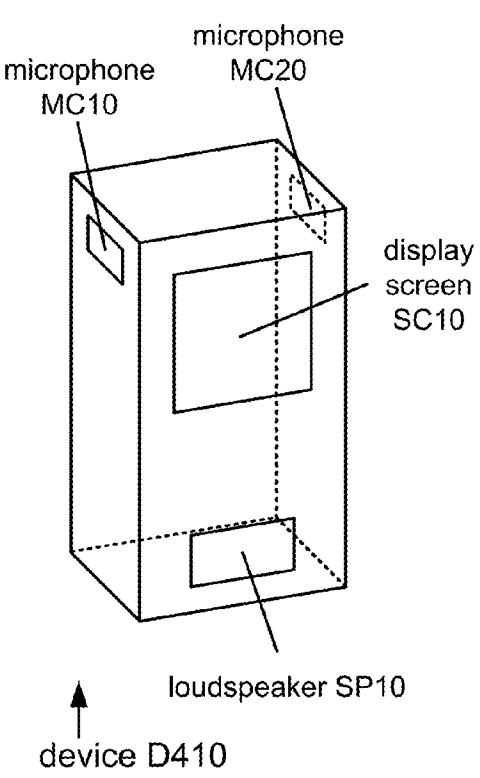
FIG. 42B shows a diagram of an implementation D410 of player D400.
Figure 42A:
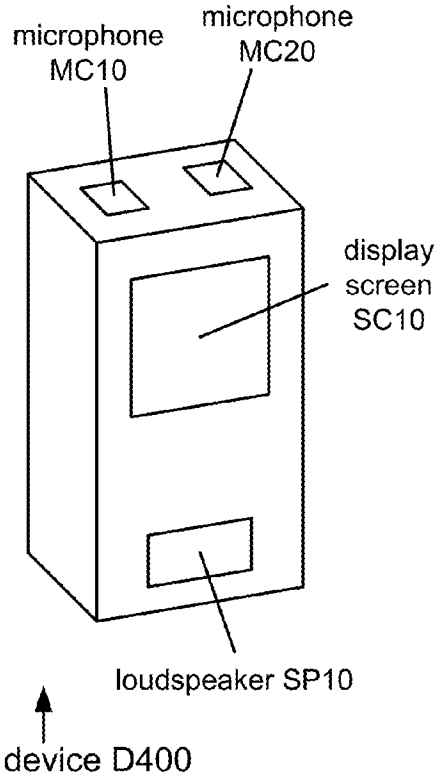
FIG. 42A shows a diagram of media player D400.

FIG. 42A shows a diagram of a portable multi-microphone implementation D400 of audio sensing device D10 that is a media player. Such a device may be configured for playback of compressed audio or audiovisual information, such as a file or stream encoded according to a standard compression format (e.g., Moving Pictures Experts Group (MPEG)-1 Audio Layer 3 (MP3), MPEG-4 Part 14 (MP4), a version of Windows Media Audio/Video (WMA/WMV) (Microsoft Corp., Redmond, Wash.), Advanced Audio Coding (AAC), International Telecommunication Union (ITU)-T H.264, or the like). Device D400 includes a display screen SC10 and a loudspeaker SP10 disposed at the front face of the device, and microphones MC10 and MC20 of array R100 are disposed at the same face of the device (e.g., on opposite sides of the top face as in this example, or on opposite sides of the front face). FIG. 42B shows another implementation D410 of device D400 in which microphones MC10 and MC20 are disposed at opposite faces of the device, and FIG. 42C shows a further implementation D420 of device D400 in which microphones MC10 and MC20 are disposed at adjacent faces of the device. A media player may also be designed such that the longer axis is horizontal during an intended use.

Figure 43B:
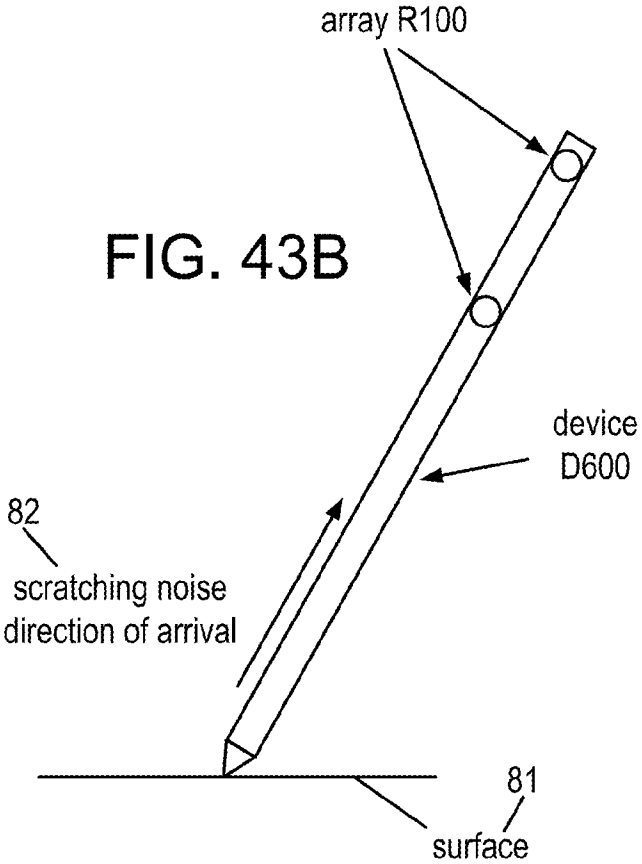
FIG. 43B shows a diagram of writing device D600.
Figure 43A:
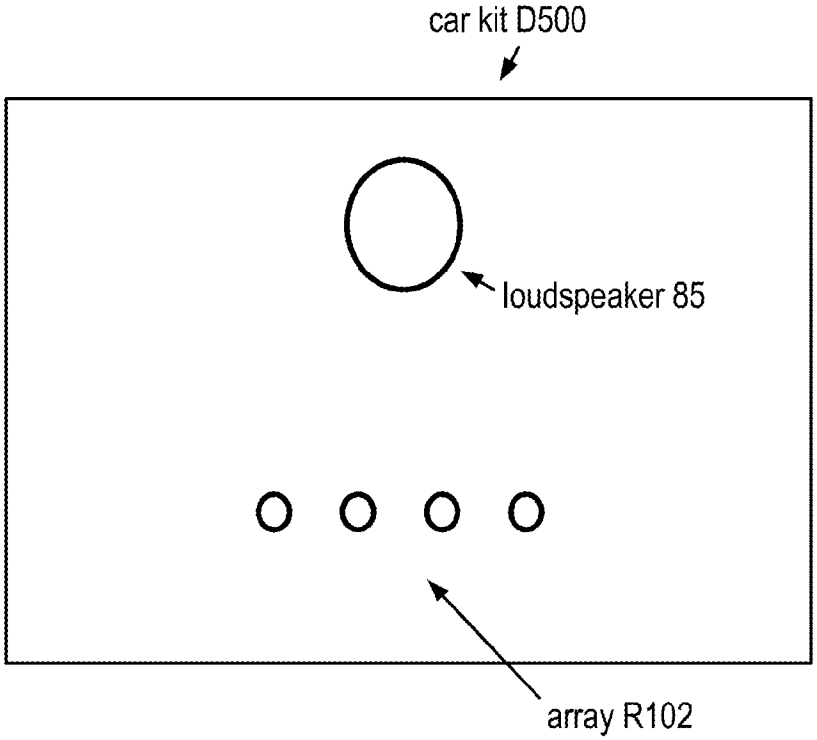
FIG. 43A shows a diagram of car kit D500.

FIG. 43A shows a diagram of an implementation D500 of multi-microphone audio sensing device D10 that is a hands-free car kit. Such a device may be configured to be installed in or on or removably fixed to the dashboard, the windshield, the rear-view mirror, a visor, or another interior surface of a vehicle. Device D500 includes a loudspeaker 85 and an implementation of array R100. In this particular example, device D500 includes an implementation R102 of array R100 as four microphones arranged in a linear array. Such a device may be configured to transmit and receive voice communications data wirelessly via one or more codecs, such as the examples listed above. Alternatively or additionally, such a device may be configured to support half- or full-duplex telephony via communication with a telephone device such as a cellular telephone handset (e.g., using a version of the Bluetooth™ protocol as described above).

FIG. 43B shows a diagram of a portable multi-microphone implementation D600 of multi-microphone audio sensing device D10 that is a writing device (e.g., a pen or pencil). Device D600 includes an implementation of array R100. Such a device may be configured to transmit and receive voice communications data wirelessly via one or more codecs, such as the examples listed above. Alternatively or additionally, such a device may be configured to support half- or full-duplex telephony via communication with a device such as a cellular telephone handset and/or a wireless headset (e.g., using a version of the Bluetooth™ protocol as described above). Device D600 may include one or more processors configured to perform a spatially selective processing operation to reduce the level of a scratching noise 82, which may result from a movement of the tip of device D600 across a drawing surface 81 (e.g., a sheet of paper), in a signal produced by array R100.

The class of portable computing devices currently includes devices having names such as laptop computers, notebook computers, netbook computers, ultra-portable computers, tablet computers, mobile Internet devices, smartbooks, or smartphones. One type of such device has a slate or slab configuration as described above and may also include a slide-out keyboard. FIGS. 44A-D show another type of such device that has a top panel which includes a display screen and a bottom panel that may include a keyboard, wherein the two panels may be connected in a clamshell or other hinged relationship.

Figure 44A:
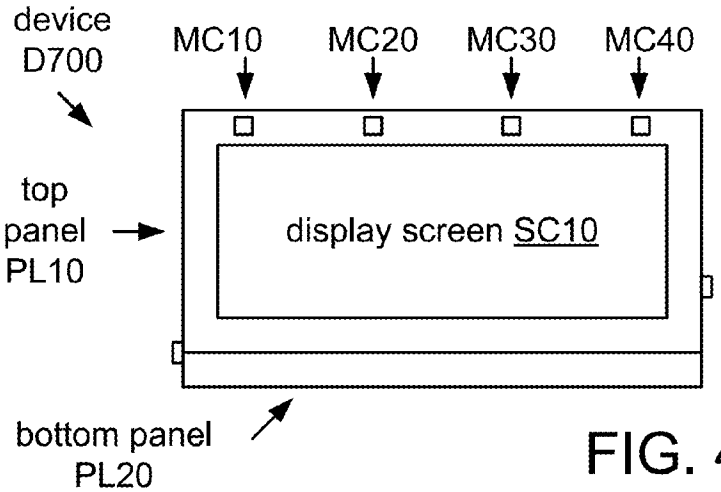
FIGS. 44A-B show views of computing device D700.
Figure 44B:
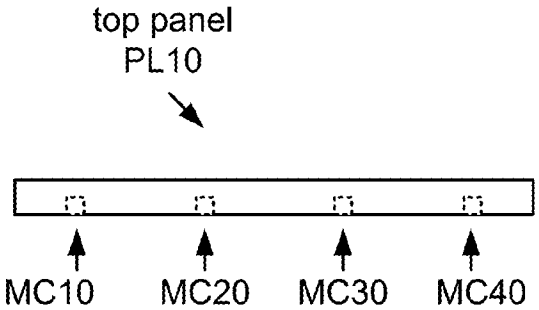
Figure 44C:
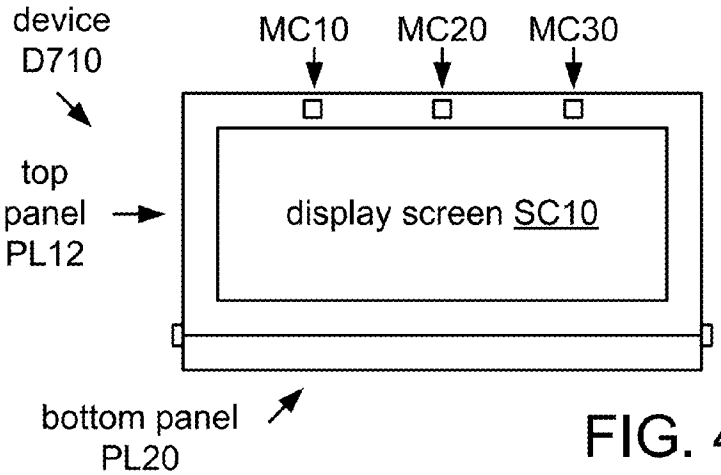
FIGS. 44C-D show views of computing device D710.
Figure 44D:
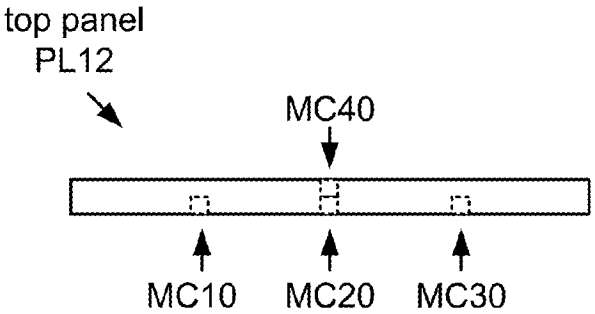

FIG. 44A shows a front view of an example of such an implementation D700 of device D10 that includes four microphones MC10, MC20, MC30, MC40 arranged in a linear array on top panel PL10 above display screen SC10. FIG. 44B shows a top view of top panel PL10 that shows the positions of the four microphones in another dimension. FIG. 44C shows a front view of another example of such a portable computing implementation D710 of device D10 that includes four microphones MC10, MC20, MC30, MC40 arranged in a nonlinear array on top panel PL12 above display screen SC10. FIG. 44D shows a top view of top panel PL12 that shows the positions of the four microphones in another dimension, with microphones MC10, MC20, and MC30 disposed at the front face of the panel and microphone MC40 disposed at the back face of the panel.

Figure 45:
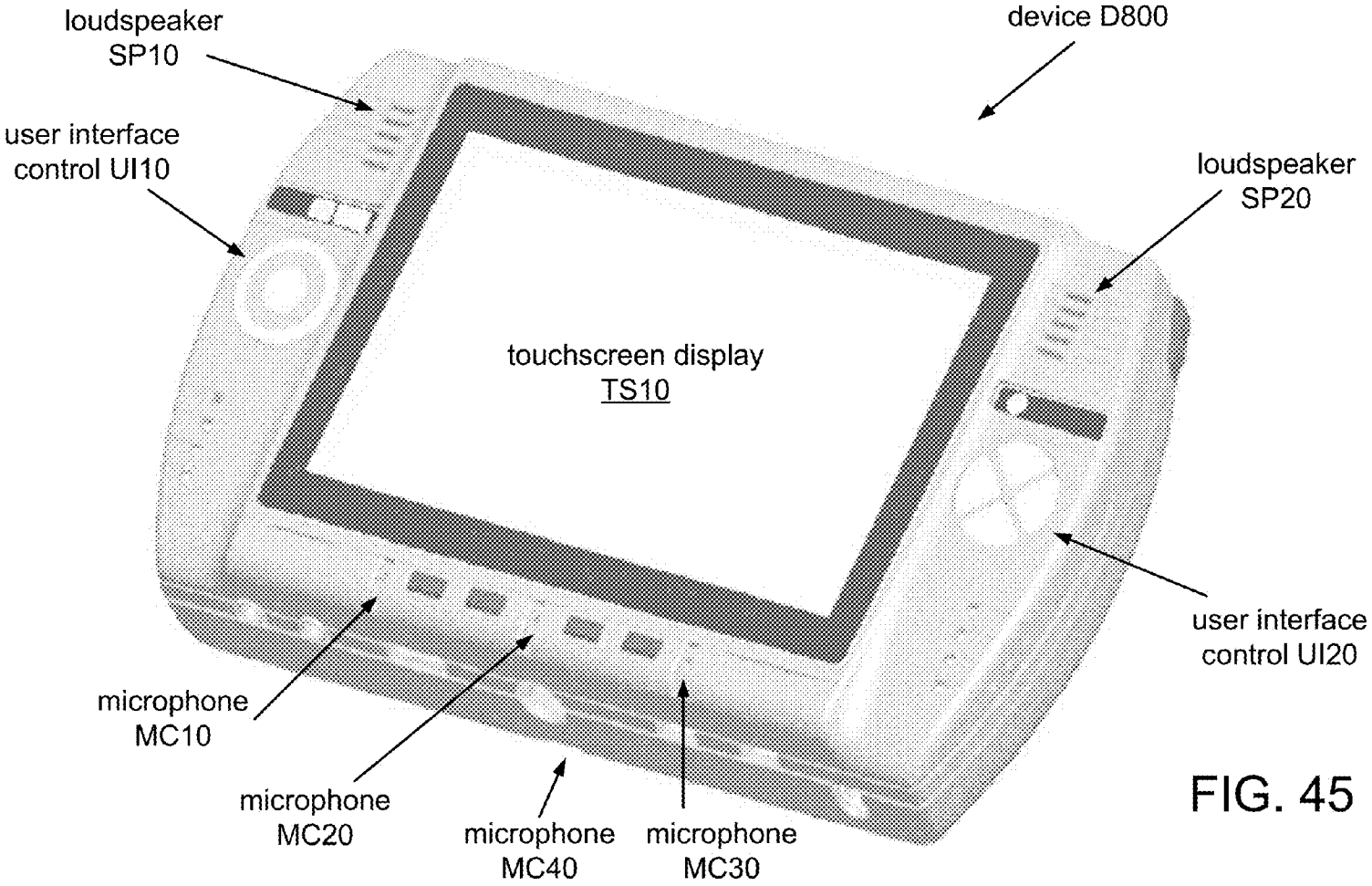
FIG. 45 shows a diagram of portable multimicrophone audio sensing device D800.

FIG. 45 shows a diagram of a portable multi-microphone implementation D800 of multimicrophone audio sensing device D10 for handheld applications. Device D800 includes a touchscreen display TS10, a user interface selection control UI10 (left side), a user interface navigation control UI20 (right side), two loudspeakers SP10 and SP20, and an implementation of array R100 that includes three front microphones MC10, MC20, MC30 and a back microphone MC40. Each of the user interface controls may be implemented using one or more of pushbuttons, trackballs, click-wheels, touchpads, joysticks and/or other pointing devices, etc. A typical size of device D800, which may be used in a browse-talk mode or a game-play mode, is about fifteen centimeters by twenty centimeters. Portable multimicrophone audio sensing device D10 may be similarly implemented as a tablet computer that includes a touchscreen display on a top surface (e.g., a "slate," such as the iPad (Apple, Inc.), Slate (Hewlett-Packard Co., Palo Alto, Calif.) or Streak (Dell Inc., Round Rock, Tex.)), with microphones of array R100 being disposed within the margin of the top surface and/or at one or more side surfaces of the tablet computer.

Figure 46B:
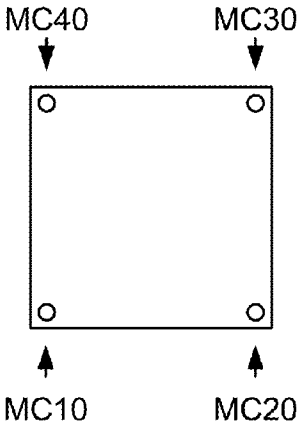
FIGS. 46A-D show top views of several examples of a conferencing device.
Figure 46D:
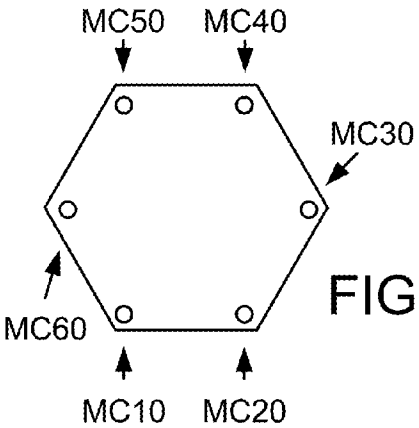
Figure 46A:
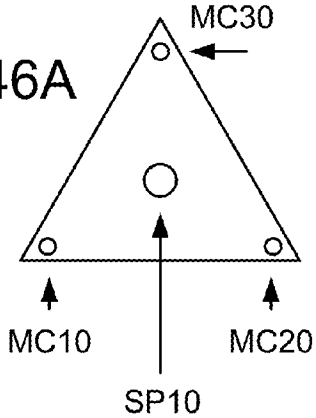
Figure 46C:
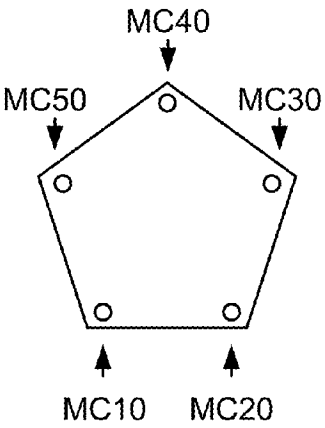

Applications of a VAD strategy as disclosed herein are not limited to portable audio sensing devices. FIGS. 46A-D show top views of several examples of a conferencing device. FIG. 46A includes a three-microphone implementation of array R100 (microphones MC10, MC20, and MC30). FIG. 46B includes a four-microphone implementation of array R100 (microphones MC10, MC20, MC30, and MC40). FIG. 46C includes a five-microphone implementation of array R100 (microphones MC10, MC20, MC30, MC40, and MC50). FIG. 46D includes a six-microphone implementation of array R100 (microphones MC10, MC20, MC30, MC40, MC50, and MC60). It may be desirable to position each of the microphones of array R100 at a corresponding vertex of a regular polygon. A loudspeaker SP10 for reproduction of the far-end audio signal may be included within the device (e.g., as shown in FIG. 46A), and/or such a loudspeaker may be located separately from the device (e.g., to reduce acoustic feedback). Additional far-field use case examples include a TV set-top box (e.g., to support Voice over IP (VoIP) applications) and a game console (e.g., Microsoft Xbox, Sony Playstation, Nintendo Wii).

It is expressly disclosed that applicability of systems, methods, and apparatus disclosed herein includes and is not limited to the particular examples shown in FIGS. 31 to 46D. The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as applications for voice communications at sampling rates higher than eight kilohertz (e.g., 12, 16, or 44 kHz).

Goals of a multi-microphone processing system as described herein may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing (e.g., spectral masking and/or another spectral modification operation based on a noise estimate, such as spectral subtraction or Wiener filtering) for more aggressive noise reduction.

The various elements of an implementation of an apparatus as disclosed herein (e.g., apparatus A100, MF100, A110, A120, A200, A205, A210, and/or MF200) may be embodied in any hardware structure, or any combination of hardware with software and/or firmware, that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein (e.g., apparatus A100, MF100, A110, A120, A200, A205, A210, and/or MF200) may also be implemented in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of selecting a subset of channels of a multichannel signal, such as a task relating to another operation of a device or system in which the processor is embedded (e.g., an audio sensing device). It is also possible for part of a method as disclosed herein to be performed by a processor of the audio sensing device (e.g., task T200) and for another part of the method to be performed under the control of one or more other processors (e.g., task T600).

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., method M100, M110, M120, M130, M132, M140, M142, and/or M200) may be performed by an array of logic elements such as a processor, and that the various elements of an apparatus as described herein may be implemented in part as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor-readable storage medium or transmitted by a computer data signal embodied in a carrier wave over a transmission medium or communication link.

The implementations of methods, schemes, and techniques disclosed herein may also be tangibly embodied (for example, in tangible, computer-readable features of one or more computer-readable storage media as listed herein) as one or more sets of instructions executable by a machine including an array of logic elements (e.g., a processor, microprocessor, microcontroller, or other finite state machine). The term "computer-readable medium" may include any medium that can store or transfer information, including volatile, nonvolatile, removable, and non-removable storage media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media, such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device (e.g., a handset, headset, or portable digital assistant (PDA)), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

The invention claimed is:

1. A method of processing an audio signal, said method comprising:

for each of a first plurality of consecutive segments of the audio signal, determining that voice activity is present in the segment;

for each of a second plurality of consecutive segments of the audio signal that occurs immediately after the first plurality of consecutive segments in the audio signal, determining that voice activity is not present in the segment;

using at least one array of logic elements, detecting that a transition in a voice activity state of the audio signal occurs during one among the second plurality of consecutive segments that is not the first segment to occur among the second plurality; and producing a voice activity detection signal that has, for each segment in the first plurality and for each segment in the second plurality, a corresponding value that indicates one among activity and lack of activity, wherein, for each of the first plurality of consecutive segments, the corresponding value of the voice activity detection signal indicates activity, and wherein, for each of the second plurality of consecutive segments that occurs before the segment in which the detected transition occurs, and based on said determining, for at least one segment of the first plurality, that voice activity is present in the segment, the corresponding value of the voice activity detection signal indicates activity, and wherein, for each of the second plurality of consecutive segments that occurs after the segment in which the detected transition occurs, and in response to said detecting that a transition in the speech activity state of the audio signal occurs, the corresponding value of the voice activity detection signal indicates a lack of activity.

2. The method according to claim 1, wherein said method comprises calculating a time derivative of energy for each of a plurality of different frequency components of the audio signal during said one among the second plurality of segments, and wherein said detecting that the transition occurs during said one among the second plurality of segments is based on the calculated time derivatives of energy.

3. The method according to claim 2, wherein said detecting that the transition occurs includes, for each of the plurality of different frequency components, and based on the corresponding calculated time derivative of energy, producing a corresponding indication of whether the frequency component is active, and wherein said detecting that the transition occurs is based on a relation between the number of said indications that indicate that the corresponding frequency component is active and a first threshold value.

4. The method according to claim 3, wherein said method comprises, for a segment that occurs prior to the first plurality of consecutive segments in the audio signal:

calculating a time derivative of energy for each of a plurality of different frequency components of the audio signal during the segment;

for each of the plurality of different frequency components, and based on the corresponding calculated time derivative of energy, producing a corresponding indication of whether the frequency component is active; and determining that a transition in a voice activity state of the audio signal does not occur during the segment, based on a relation between (A) the number of said indications that indicate that the corresponding frequency component is active and (B) a second threshold value that is higher than said first threshold value.

5. The method according to claim 3, wherein said method comprises, for a segment that occurs prior to the first plurality of consecutive segments in the audio signal:

calculating, for each of a plurality of different frequency components of the audio signal during the segment, a second derivative of energy with respect to time;

for each of the plurality of different frequency components, and based on the corresponding calculated second derivative of energy with respect to time, producing a corresponding indication of whether the frequency component is impulsive; and determining that a transition in a voice activity state of the audio signal does not occur during the segment, based on a relation between the number of said indications that indicate that the corresponding frequency component is impulsive and a threshold value.

6. The method according to claim 3, wherein said method comprises, for a segment that occurs prior to the first plurality of consecutive segments in the audio signal:

calculating, for each of a plurality of different frequency components of the audio signal during the segment, a second-order derivative of energy with respect to time;

for each of the plurality of different frequency components, and based on the corresponding calculated second-order derivative of energy with respect to time, producing a corresponding indication of whether the frequency component is impulsive; and determining that a transition in a voice activity state of the audio signal does not occur during the segment, based on a relation between the number of said indications that indicate that the corresponding frequency component is impulsive and a threshold value.

7. The method according to claim 1, wherein, for each of the first plurality of consecutive segments of the audio signal, said determining that voice activity is present in the segment is based on a difference between a first channel of the audio signal during the segment and a second channel of the audio signal during the segment, and wherein, for each of the second plurality of consecutive segments of the audio signal, said determining that voice activity is not present in the segment is based on a difference between a first channel of the audio signal during the segment and a second channel of the audio signal during the segment.

8. The method according to claim 7, wherein, for each segment of said first plurality and for each segment of said second plurality, said difference is a difference between a level of the first channel and a level of the second channel during the segment.

9. The method according to claim 7, wherein, for each segment of said first plurality and for each segment of said second plurality, said difference is a difference in time between an instance of a signal in the first channel during the segment and an instance of said signal in the second channel during the segment.

10. The method according to claim 7, wherein, for each segment of said first plurality, said determining that voice activity is present in the segment comprises calculating, for each of a first plurality of different frequency components of the audio signal during the segment, a difference between a phase of the frequency component in the first channel and a phase of the frequency component in the second channel, wherein said difference between the first channel during the segment and the second channel during the segment is one of said calculated phase differences, and wherein, for each segment of said second plurality, said determining that voice activity is not present in the segment comprises calculating, for each of the first plurality of different frequency components of the audio signal during the segment, a difference between a phase of the frequency component in the first channel and a phase of the frequency component in the second channel, wherein said difference between the first channel during the segment and the second channel during the segment is one of said calculated phase differences.

11. The method according to claim 10, wherein said method comprises calculating a time derivative of energy for each of a second plurality of different frequency components of the first channel during said one among the second plurality of segments, and wherein said detecting that the transition occurs during said one among the second plurality of segments is based on the calculated time derivatives of energy, and wherein a frequency band that includes the first plurality of frequency components is separate from a frequency band that includes the second plurality of frequency components.

12. The method according to claim 10, wherein, for each segment of said first plurality, said determining that voice activity is present in the segment is based on a corresponding value of a coherency measure that indicates a degree of coherence among the directions of arrival of at least the plurality of different frequency components, wherein said value is based on information from the corresponding plurality of calculated phase differences, and wherein, for each segment of said second plurality, said determining that voice activity is not present in the segment is based on a corresponding value of the coherency measure that indicates a degree of coherence among the directions of arrival of at least the plurality of different frequency components, wherein said value is based on information from the corresponding plurality of calculated phase differences.

13. The method according to claim 1, wherein said method comprises:

calculating a time derivative of energy for each of a plurality of different frequency components of the audio signal during a segment of one of the first and second pluralities of segments; and producing a voice activity detection indication for said segment of one of the first and second pluralities, wherein said producing the voice activity detection indication includes comparing a value of a test statistic for the segment to a value of a threshold, and wherein said producing the voice activity detection indication includes modifying a relation between the test statistic and the threshold, based on said calculated plurality of time derivatives of energy, and wherein a value of said voice activity detection signal for said segment of one of the first and second pluralities is based on said voice activity detection indication.

14. The method according to claim 1, wherein said method is performed by a communications device.

15. An apparatus for processing an audio signal, said apparatus comprising:

means for determining, for each of a first plurality of consecutive segments of the audio signal, that voice activity is present in the segment;

means for determining, for each of a second plurality of consecutive segments of the audio signal that occurs immediately after the first plurality of consecutive segments in the audio signal, that voice activity is not present in the segment;

means for detecting that a transition in a voice activity state of the audio signal occurs during one among the second plurality of consecutive segments; and means for producing a voice activity detection signal that has, for each segment in the first plurality and for each segment in the second plurality, a corresponding value that indicates one among activity and lack of activity, and wherein, for each of the first plurality of consecutive segments, the corresponding value of the voice activity detection signal indicates activity, and wherein, for each of the second plurality of consecutive segments that occurs before the segment in which the detected transition occurs, and based on said determining, for at least one segment of the first plurality, that voice activity is present in the segment, the corresponding value of the voice activity detection signal indicates activity, and wherein, for each of the second plurality of consecutive segments that occurs after the segment in which the detected transition occurs, and in response to said detecting that a transition in the speech activity state of the audio signal occurs, the corresponding value of the voice activity detection signal indicates a lack of activity.

16. The apparatus according to claim 15, wherein said apparatus comprises means for calculating a time derivative of energy for each of a plurality of different frequency components of the audio signal during said one among the second plurality of segments, and wherein said means for detecting that the transition occurs during said one among the second plurality of segments is configured to detect the transition based on the calculated time derivatives of energy.

17. The apparatus according to claim 16, wherein said means for detecting that the transition occurs includes means for producing, for each of the plurality of different frequency components, and based on the corresponding calculated time derivative of energy, a corresponding indication of whether the frequency component is active, and wherein said means for detecting that the transition occurs is configured to detect the transition based on a relation between the number of said indications that indicate that the corresponding frequency component is active and a first threshold value.

18. The apparatus according to claim 17, wherein said apparatus comprises:

means for calculating, for a segment that occurs prior to the first plurality of consecutive segments in the audio signal, a time derivative of energy for each of a plurality of different frequency components of the audio signal during the segment;

means for producing, for each of said plurality of different frequency components of said segment that occurs prior to the first plurality of consecutive segments in the audio signal, and based on the corresponding calculated time derivative of energy, a corresponding indication of whether the frequency component is active; and means for determining that a transition in a voice activity state of the audio signal does not occur during said segment that occurs prior to the first plurality of consecutive segments in the audio signal, based on a relation between (A) the number of said indications that indicate that the corresponding frequency component is active and (B) a second threshold value that is higher than said first threshold value.

19. The apparatus according to claim 17, wherein said apparatus comprises:

means for calculating, for a segment that occurs prior to the first plurality of consecutive segments in the audio signal, a second derivative of energy with respect to time for each of a plurality of different frequency components of the audio signal during the segment;

means for producing, for each of the plurality of different frequency components of said segment that occurs prior to the first plurality of consecutive segments in the audio signal, and based on the corresponding calculated second derivative of energy with respect to time, a corresponding indication of whether the frequency component is impulsive; and means for determining that a transition in a voice activity state of the audio signal does not occur during said segment that occurs prior to the first plurality of consecutive segments in the audio signal, based on a relation between the number of said indications that indicate that the corresponding frequency component is impulsive and a threshold value.

20. The apparatus according to claim 15, wherein, for each of the first plurality of consecutive segments of the audio signal, said means for determining that voice activity is present in the segment is configured to perform said determining based on a difference between a first channel of the audio signal during the segment and a second channel of the audio signal during the segment, and wherein, for each of the second plurality of consecutive segments of the audio signal, said means for determining that voice activity is not present in the segment is configured to perform said determining based on a difference between a first channel of the audio signal during the segment and a second channel of the audio signal during the segment.

21. The apparatus according to claim 20, wherein, for each segment of said first plurality and for each segment of said second plurality, said difference is a difference between a level of the first channel and a level of the second channel during the segment.

22. The apparatus according to claim 20, wherein, for each segment of said first plurality and for each segment of said second plurality, said difference is a difference in time between an instance of a signal in the first channel during the segment and an instance of said signal in the second channel during the segment.

23. The apparatus according to claim 20, wherein said means for determining that voice activity is present in the segment comprises means for calculating, for each segment of said first plurality and for each segment of said second plurality, and for each of a first plurality of different frequency components of the audio signal during the segment, a difference between a phase of the frequency component in the first channel and a phase of the frequency component in the second channel, wherein said difference between the first channel during the segment and the second channel during the segment is one of said calculated phase differences.

24. The apparatus according to claim 23, wherein said apparatus comprises means for calculating a time derivative of energy for each of a second plurality of different frequency components of the first channel during said one among the second plurality of segments, and wherein said means for detecting that the transition occurs during said one among the second plurality of segments is configured to detect that the transition occurs based on the calculated time derivatives of energy, and wherein a frequency band that includes the first plurality of frequency components is separate from a frequency band that includes the second plurality of frequency components.

25. The apparatus according to claim 23, wherein said means for determining, for each segment of said first plurality, that voice activity is present in the segment is configured to determine that said voice activity is present based on a corresponding value of a coherency measure that indicates a degree of coherence among the directions of arrival of at least the plurality of different frequency components, wherein said value is based on information from the corresponding plurality of calculated phase differences, and wherein said means for determining, for each segment of said second plurality, that voice activity is not present in the segment is configured to determine that voice activity is not present based on a corresponding value of the coherency measure that indicates a degree of coherence among the directions of arrival of at least the plurality of different frequency components, wherein said value is based on information from the corresponding plurality of calculated phase differences.

26. The apparatus according to claim 15, wherein said apparatus comprises:

means for calculating a time derivative of energy for each of a plurality of different frequency components of the audio signal during a segment of one of the first and second pluralities of segments; and means for producing a voice activity detection indication for said segment of one of the first and second pluralities, wherein said means for producing the voice activity detection indication includes means for comparing a value of a test statistic for the segment to a threshold value, and wherein said means for producing the voice activity detection indication includes means for modifying a relation between the test statistic and the threshold, based on said calculated plurality of time derivatives of energy, and wherein a value of said voice activity detection signal for said segment of one of the first and second pluralities is based on said voice activity detection indication.

27. An apparatus for processing an audio signal, said apparatus comprising:

a first voice activity detector configured to determine:

for each of a first plurality of consecutive segments of the audio signal, that voice activity is present in the segment, and for each of a second plurality of consecutive segments of the audio signal that occurs immediately after the first plurality of consecutive segments in the audio signal, that voice activity is not present in the segment;

a second voice activity detector configured to detect that a transition in a voice activity state of the audio signal occurs during one among the second plurality of consecutive segments; and a signal generator configured to produce a voice activity detection signal that has, for each segment in the first plurality and for each segment in the second plurality, a corresponding value that indicates one among activity and lack of activity, wherein, for each of the first plurality of consecutive segments, the corresponding value of the voice activity detection signal indicates activity, and wherein, for each of the second plurality of consecutive segments that occurs before the segment in which the detected transition occurs, and based on said determining, for at least one segment of the first plurality, that voice activity is present in the segment, the corresponding value of the voice activity detection signal indicates activity, and wherein, for each of the second plurality of consecutive segments that occurs after the segment in which the detected transition occurs, and in response to said detecting that a transition in the speech activity state of the audio signal occurs, the corresponding value of the voice activity detection signal indicates a lack of activity.

28. The apparatus according to claim 27, wherein said apparatus comprises a calculator configured to calculate a time derivative of energy for each of a plurality of different frequency components of the audio signal during said one among the second plurality of segments, and wherein said second voice activity detector is configured to detect said transition based on the calculated time derivatives of energy.

29. The apparatus according to claim 28, wherein said second voice activity detector includes a comparator configured to produce, for each of the plurality of different frequency components, and based on the corresponding calculated time derivative of energy, a corresponding indication of whether the frequency component is active, and wherein said second voice activity detector is configured to detect the transition based on a relation between the number of said indications that indicate that the corresponding frequency component is active and a first threshold value.

30. The apparatus according to claim 29, wherein said apparatus comprises:

a calculator configured to calculate, for a segment that occurs prior to the first plurality of consecutive segments in the audio signal, a time derivative of energy for each of a plurality of different frequency components of the audio signal during the segment; and a comparator configured to produce, for each of said plurality of different frequency components of said segment that occurs prior to the first plurality of consecutive segments in the audio signal, and based on the corresponding calculated time derivative of energy, a corresponding indication of whether the frequency component is active, wherein said second voice activity detector is configured to determine that a transition in a voice activity state of the audio signal does not occur during said segment that occurs prior to the first plurality of consecutive segments in the audio signal, based on a relation between (A) the number of said indications that indicate that the corresponding frequency component is active and (B) a second threshold value that is higher than said first threshold value.

31. The apparatus according to claim 29, wherein said apparatus comprises:

a calculator configured to calculate, for a segment that occurs prior to the first plurality of consecutive segments in the audio signal, a second derivative of energy with respect to time for each of a plurality of different frequency components of the audio signal during the segment; and a comparator configured to produce, for each of the plurality of different frequency components of said segment that occurs prior to the first plurality of consecutive segments in the audio signal, and based on the corresponding calculated second derivative of energy with respect to time, a corresponding indication of whether the frequency component is impulsive, wherein said second voice activity detector is configured to determine that a transition in a voice activity state of the audio signal does not occur during said segment that occurs prior to the first plurality of consecutive segments in the audio signal, based on a relation between the number of said indications that indicate that the corresponding frequency component is impulsive and a threshold value.

32. The apparatus according to claim 27, wherein said first voice activity detector is configured to determine, for each of the first plurality of consecutive segments of the audio signal, that voice activity is present in the segment, based on a difference between a first channel of the audio signal during the segment and a second channel of the audio signal during the segment, and wherein said first voice activity detector is configured to determine, for each of the second plurality of consecutive segments of the audio signal, that voice activity is not present in the segment, based on a difference between a first channel of the audio signal during the segment and a second channel of the audio signal during the segment.

33. The apparatus according to claim 32, wherein, for each segment of said first plurality and for each segment of said second plurality, said difference is a difference between a level of the first channel and a level of the second channel during the segment.

34. The apparatus according to claim 32, wherein, for each segment of said first plurality and for each segment of said second plurality, said difference is a difference in time between an instance of a signal in the first channel during the segment and an instance of said signal in the second channel during the segment.

35. The apparatus according to claim 32, wherein said first voice activity detector includes a calculator configured to calculate, for each segment of said first plurality and for each segment of said second plurality, and for each of a first plurality of different frequency components of the audio signal during the segment, a difference between a phase of the frequency component in the first channel and a phase of the frequency component in the second channel, wherein said difference between the first channel during the segment and the second channel during the segment is one of said calculated phase differences.

36. The apparatus according to claim 35, wherein said apparatus comprises a calculator configured to calculate a time derivative of energy for each of a second plurality of different frequency components of the first channel during said one among the second plurality of segments, and wherein said second voice activity detector is configured to detect that the transition occurs based on the calculated time derivatives of energy, and wherein a frequency band that includes the first plurality of frequency components is separate from a frequency band that includes the second plurality of frequency components.

37. The apparatus according to claim 35, wherein said first voice activity detector is configured to determine, for each segment of said first plurality, that said voice activity is present in the segment based on a corresponding value of a coherency measure that indicates a degree of coherence among the directions of arrival of at least the plurality of different frequency components, wherein said value is based on information from the corresponding plurality of calculated phase differences, and wherein said first voice activity detector is configured to determine, for each segment of said second plurality, that voice activity is not present in the segment based on a corresponding value of the coherency measure that indicates a degree of coherence among the directions of arrival of at least the plurality of different frequency components, wherein said value is based on information from the corresponding plurality of calculated phase differences.

38. The apparatus according to claim 27, wherein said apparatus comprises:

a third voice activity detector configured to calculate a time derivative of energy for each of a plurality of different frequency components of the audio signal during a segment of one of the first and second pluralities of segments; and a fourth voice activity detector configured to produce a voice activity detection indication for said segment of one of the first and second pluralities, based on a result of comparing a value of a test statistic for the segment to a threshold value, wherein said fourth voice activity detector is configured to modify a relation between the test statistic and the threshold, based on said calculated plurality of time derivatives of energy, and wherein a value of said voice activity detection signal for said segment of one of the first and second pluralities is based on said voice activity detection indication.

39. The apparatus according to claim 38, wherein the fourth voice activity detector is the first voice activity detector, and wherein said determining that voice activity is present or not present in the segment includes producing said voice activity detection indication.

40. A non-transitory computer-readable medium that stores machine-executable instructions that when executed by one or more processors cause the one or more processors to:

determine, for each of a first plurality of consecutive segments of a multichannel signal, and based on a difference between a first channel of the multichannel signal during the segment and a second channel of the multichannel signal during the segment, that voice activity is present in the segment;

determine, for each of a second plurality of consecutive segments of the multichannel signal that occurs immediately after the first plurality of consecutive segments in the multichannel signal, and based on a difference between a first channel of the multichannel signal during the segment and a second channel of the multichannel signal during the segment, that voice activity is not present in the segment;

detect that a transition in a voice activity state of the multichannel signal occurs during one among the second plurality of consecutive segments that is not the first segment to occur among the second plurality; and produce a voice activity detection signal that has, for each segment in the first plurality and for each segment in the second plurality, a corresponding value that indicates one among activity and lack of activity, wherein, for each of the first plurality of consecutive segments, the corresponding value of the voice activity detection signal indicates activity, and wherein, for each of the second plurality of consecutive segments that occurs before the segment in which the detected transition occurs, and based on said determining, for at least one segment of the first plurality, that voice activity is present in the segment, the corresponding value of the voice activity detection signal indicates activity, and wherein, for each of the second plurality of consecutive segments that occurs after the segment in which the detected transition occurs, and in response to said detecting that a transition in the speech activity state of the multichannel signal occurs, the corresponding value of the voice activity detection signal indicates a lack of activity.

41. The medium according to claim 40, wherein said instructions when executed by the one or more processors cause the one or more processors to calculate a time derivative of energy for each of a plurality of different frequency components of the first channel during said one among the second plurality of segments, and wherein said detecting that the transition occurs during said one among the second plurality of segments is based on the calculated time derivatives of energy.

42. The medium according to claim 41, wherein said detecting that the transition occurs includes, for each of the plurality of different frequency components, and based on the corresponding calculated time derivative of energy, producing a corresponding indication of whether the frequency component is active, and wherein said detecting that the transition occurs is based on a relation between the number of said indications that indicate that the corresponding frequency component is active and a first threshold value.

43. The medium according to claim 42, wherein said instructions when executed by one or more processors cause the one or more processors, for a segment that occurs prior to the first plurality of consecutive segments in the multichannel signal:

to calculate a time derivative of energy for each of a plurality of different frequency components of the first channel during the segment;

to produce, for each of the plurality of different frequency components, and based on the corresponding calculated time derivative of energy, a corresponding indication of whether the frequency component is active; and to determine that a transition in a voice activity state of the multichannel signal does not occur during the segment, based on a relation between (A) the number of said indications that indicate that the corresponding frequency component is active and (B) a second threshold value that is higher than said first threshold value.

44. The medium according to claim 42, wherein said instructions when executed by one or more processors cause the one or more processors, for a segment that occurs prior to the first plurality of consecutive segments in the multichannel signal:

to calculate, for each of a plurality of different frequency components of the first channel during the segment, a second derivative of energy with respect to time;

to produce, for each of the plurality of different frequency components, and based on the corresponding calculated second derivative of energy with respect to time, a corresponding indication of whether the frequency component is impulsive; and to determine that a transition in a voice activity state of the multichannel signal does not occur during the segment, based on a relation between the number of said indications that indicate that the corresponding frequency component is impulsive and a threshold value.

45. The medium according to claim 40, wherein, for each of the first plurality of consecutive segments of the audio signal, said determining that voice activity is present in the segment is based on a difference between a first channel of the audio signal during the segment and a second channel of the audio signal during the segment, and wherein, for each of the second plurality of consecutive segments of the audio signal, said determining that voice activity is not present in the segment is based on a difference between a first channel of the audio signal during the segment and a second channel of the audio signal during the segment.

46. The medium according to claim 45, wherein, for each segment of said first plurality and for each segment of said second plurality, said difference is a difference between a level of the first channel and a level of the second channel during the segment.

47. The medium according to claim 45, wherein, for each segment of said first plurality and for each segment of said second plurality, said difference is a difference in time between an instance of a signal in the first channel during the segment and an instance of said signal in the second channel during the segment.

48. The medium according to claim 45, wherein, for each segment of said first plurality, said determining that voice activity is present in the segment comprises calculating, for each of a first plurality of different frequency components of the multichannel signal during the segment, a difference between a phase of the frequency component in the first channel and a phase of the frequency component in the second channel, wherein said difference between the first channel during the segment and the second channel during the segment is one of said calculated phase differences, and wherein, for each segment of said second plurality, said determining that voice activity is not present in the segment comprises calculating, for each of the first plurality of different frequency components of the multichannel signal during the segment, a difference between a phase of the frequency component in the first channel and a phase of the frequency component in the second channel, wherein said difference between the first channel during the segment and the second channel during the segment is one of said calculated phase differences.

49. The medium according to claim 48, wherein said instructions when executed by one or more processors cause the one or more processors to calculate a time derivative of energy for each of a second plurality of different frequency components of the first channel during said one among the second plurality of segments, and wherein said detecting that the transition occurs during said one among the second plurality of segments is based on the calculated time derivatives of energy, and wherein a frequency band that includes the first plurality of frequency components is separate from a frequency band that includes the second plurality of frequency components.

50. The medium according to claim 48, wherein, for each segment of said first plurality, said determining that voice activity is present in the segment is based on a corresponding value of a coherency measure that indicates a degree of coherence among the directions of arrival of at least the plurality of different frequency components, wherein said value is based on information from the corresponding plurality of calculated phase differences, and wherein, for each segment of said second plurality, said determining that voice activity is not present in the segment is based on a corresponding value of the coherency measure that indicates a degree of coherence among the directions of arrival of at least the plurality of different frequency components, wherein said value is based on information from the corresponding plurality of calculated phase differences.

* * * * *